US006578504B2

(12) United States Patent
Nelson et al.

(10) Patent No.: US 6,578,504 B2
(45) Date of Patent: Jun. 17, 2003

(54) PROCESS FOR MANUFACTURING UNIBODY SHIRTS WITH SLEEVES

(75) Inventors: Michael Joseph Nelson, Neenah, WI (US); Brendon Frank Ribble, Menasha, WI (US); Joseph Richard Alberts, Greenville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/875,834

(22) Filed: Jun. 6, 2001

(65) Prior Publication Data

US 2002/0005155 A1 Jan. 17, 2002

Related U.S. Application Data

(60) Provisional application No. 60/210,125, filed on Jun. 7, 2000.

(51) Int. Cl.[7] ..... D05B 25/02; D05B 9/00

(52) U.S. Cl. ..... 112/475.06; 112/475.09

(58) Field of Search ..... 112/475.06, 475.04, 112/475.05, 475.07, 475.09, 122.3, 304

(56) References Cited

U.S. PATENT DOCUMENTS

| | | | |
|---|---|---|---|
| 3,230,546 A | | 1/1966 | Sabee |
| 3,338,992 A | | 8/1967 | Kinney |
| 3,341,394 A | | 9/1967 | Kinney |
| 3,502,763 A | | 3/1970 | Hartmann |
| 3,542,615 A | | 11/1970 | Dobo et al. |
| 3,692,618 A | | 9/1972 | Dorschner et al. |
| 3,699,591 A | * | 10/1972 | Brietkopf et al. |
| 3,802,817 A | | 4/1974 | Matsuki et al. |
| 3,849,241 A | | 11/1974 | Butin et al. |
| 3,873,999 A | * | 4/1975 | Artzt |
| 4,011,599 A | | 3/1977 | Chaney et al. |
| 4,041,203 A | | 8/1977 | Brock et al. |

(List continued on next page.)

FOREIGN PATENT DOCUMENTS

| | | | |
|---|---|---|---|
| DE | 903081 | * | 7/1949 |
| FR | 1545871 | | 11/1968 |

OTHER PUBLICATIONS

American Society for Testing Materials (ASTM) Designation: D 1175–80, Standard Text Methods for Abrasion Resistence of Textile Fabrics (Oscillatory Cylinder and Uniform Abrasion Methods), 13 pages, published May 1980. Discontinued in 1982 and replaced by D 4157–92 and D 4158–92.

(List continued on next page.)

*Primary Examiner*—Ismael Izaguirre
(74) *Attorney, Agent, or Firm*—Patricia A. Charlier

(57) ABSTRACT

The present invention provides a continuous process for the manufacture of a garment. A web of fabric including opposing web side edges is provided. The web of fabric is intermittently cut, thereby forming edges defining neck openings in the web of fabric. The opposing web side edges of the web of fabric are intermittently cut, thereby defining pairs of opposing indentations in the opposing web side edges of the web of fabric. The web of fabric is cut, thereby defining discrete garment-sized pieces. Each of the discrete garment-sized pieces of the web of fabric includes at least one neck opening, a front panel having a pair of opposing garment side edges, a back panel having a pair of opposing garment side edges, a portion of two pairs of the opposing indentations in the web side edges of the web of fabric, a pair of sleeve flaps, two garment end portions, and a pair of opposing piece side edges. The opposing piece side edges are proximate a pair of opposing garment bottom edges of the garment. The discrete garment-sized piece of the web of fabric is folded, whereby one of the garment bottom edges of the pair of opposing garment bottom edges is brought into contact with the other garment bottom edge. At least a portion of the pair of opposing garment side edges of the front panel is fastened to at least a portion of the pair of opposing garment side edges of the back panel to form a pair of garment side seams.

38 Claims, 12 Drawing Sheets

U.S. PATENT DOCUMENTS

| | | | | | |
|---|---|---|---|---|---|
| 4,089,279 | A | * | 5/1978 | Hess et al. | 112/304 |
| 4,176,408 | A | | 12/1979 | de Polo | |
| 4,340,563 | A | | 7/1982 | Appel et al. | |
| 4,510,626 | A | | 4/1985 | Bowditch | |
| 4,628,545 | A | | 12/1986 | Metzler | |
| 4,685,407 | A | | 8/1987 | Jünemann | |
| 4,821,658 | A | | 4/1989 | Hiramatsu et al. | |
| 4,870,918 | A | | 10/1989 | Hiramatsu et al. | |
| 4,875,240 | A | | 10/1989 | Barrett | |
| 4,931,115 | A | | 6/1990 | Pajunen | |
| 4,938,753 | A | | 7/1990 | Van Gompel et al. | |
| 4,957,054 | A | | 9/1990 | Sakuma et al. | |
| 5,060,588 | A | | 10/1991 | Sadlack et al. | |
| 5,145,727 | A | | 9/1992 | Potts et al. | |
| 5,169,706 | A | | 12/1992 | Collier, IV et al. | |
| 5,178,931 | A | | 1/1993 | Perkins et al. | |
| 5,188,885 | A | | 2/1993 | Timmons et al. | |
| 5,349,913 | A | | 9/1994 | Schramayr et al. | |
| 5,390,614 | A | | 2/1995 | Adamski, Jr. et al. | |
| 5,505,149 | A | | 4/1996 | Scharamayr et al. | |
| 5,513,590 | A | | 5/1996 | Allison et al. | |
| 5,555,835 | A | | 9/1996 | Compolucci | |
| 5,611,095 | A | | 3/1997 | Schneider | |
| 5,621,917 | A | | 4/1997 | Howsden | |
| 5,628,264 | A | * | 5/1997 | Adamski, Jr. et al. | 112/475.04 |
| 5,642,681 | A | | 7/1997 | Adamski, Jr. et al. | |
| 5,680,653 | A | | 10/1997 | Mathis et al. | |
| 5,724,674 | A | | 3/1998 | Covington et al. | |
| 5,795,433 | A | * | 8/1998 | Neidermeyer | 112/475.06 |
| 5,907,872 | A | | 6/1999 | Alberts et al. | |
| 6,098,557 | A | * | 8/2000 | Coullard et al. | 112/475.06 |
| 6,116,175 | A | | 9/2000 | Ito | |
| 6,240,561 | B1 | | 6/2001 | Mc Ginnis | |

OTHER PUBLICATIONS

American Society for Testing Materials (ASTM) Designation: D 4157–92, "Standard Test Method for Abrasion Resistance of Textile Fabrics (Oscillatory Cylinder Method)," pp. 351–354, published Aug. 1992.

American Society for Testing Materials (ASTM) Designation: D 4158–92, "Standard Test Method for Abrasion Resistance of Textile Fabrics (Uniform Abrasion Method)," pp. 355–360, published Aug. 1992.

American Society for Testing Materials (ASTM) Designation: D 1682–64 (Reapproved 1975), "Standard Test Methods for Breaking Load and Elongation of Textile Fabrics," pp. 454–459, published Oct. 1964.

American Society for Testing Materials (ASTM) Designation: D 1776–98, "Standard Practice for Conditioning and Testing Textiles," pp. 432–435, published Feb. 1999.

TAPPI Official Test Method T 402 om–93, "Standard Conditioning and Testing Atmospheres For Paper, Board, Pulp Handsheets, and Related Products," published by the TAPPI Press, Atlanta, Georgia, revised 1993, pp. 1–3.

* cited by examiner

PROCESS FOR MANUFACTURING UNIBODY SHIRTS WITH SLEEVES

This application claims the benefit of Prov. No. 60/210,125 filed Jun. 7, 2000.

BACKGROUND OF THE INVENTION

This invention pertains to a continuous process for the manufacture of garments such as shirts intended for everyday wear, and more particularly to a process for the continuous manufacture of tee-shirt type garments.

Manufacturers are always looking for new, cost-effective, high-speed continuous processes for manufacturing inexpensive clothing, both disposable and reusable garments, for everyday use. In addition, consumers are interested in dress and active wear that is comfortable and relatively inexpensive.

Previous methods used in clothing manufacture require pieces of fabric, such as cloth or woven material, to be cut from a larger bolt of the fabric into specific patterns. The pieces are then sewn together in a multi-step cut and piece process for assembly into finished articles of clothing. Such cut and piece processes are labor and time intensive. The process speeds typically depend on the speed of the final sewing stages of the cut and piece process.

SUMMARY OF THE INVENTION

Thus, there is a need to provide an improved process for manufacturing garments, including washable and disposable garments. There is also a need to provide comfortable and inexpensive active wear garments. In addition, the garments need to be easy to put on and durable during wear. In response to these needs, an improved cost effective, high speed process for manufacturing shirts, tee-shirts, wraps, robes, gowns, jackets, coats, and the like has been discovered.

One embodiment of the present invention is a continuous process for the manufacture of a shirt-type garment to be worn about the upper body.

Numerous features and advantages of the present invention will appear from the following description. In the description, reference is made to the accompanying drawings which illustrate desired embodiments of the invention. Such embodiments do not represent the full scope of the invention. Reference should, therefore, be made to the claims herein for interpreting the full scope of the invention.

BRIEF DESCRIPTION OF THE DRAWINGS

The above-mentioned and other features of the present invention and the manner of attaining them will become more apparent, and the invention itself will be better understood by reference to the following description of the invention, taken in conjunction with the accompanying drawings, wherein.

DEFINITIONS

Figure 1:
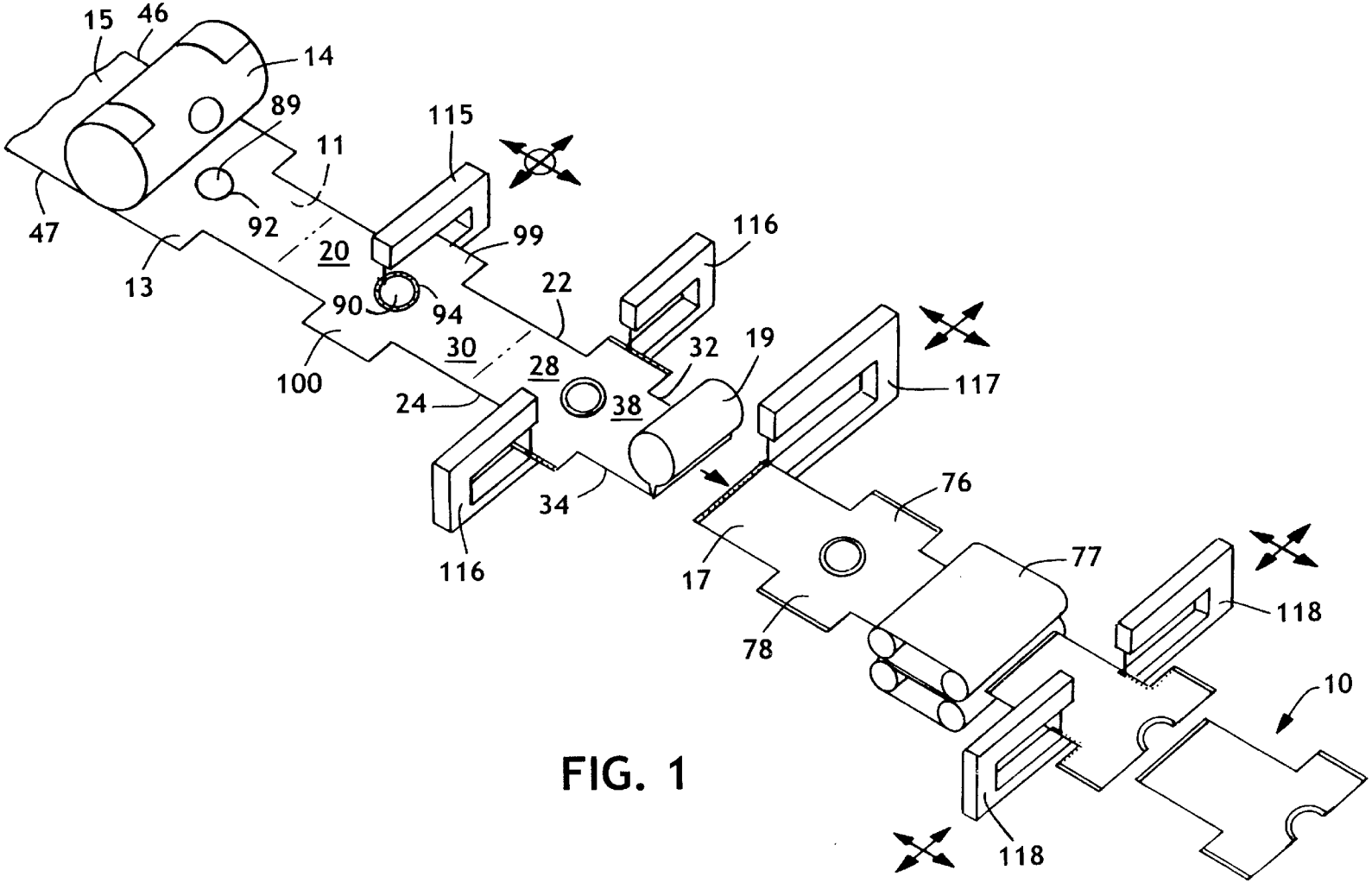
FIG. 1 is a diagram of one embodiment of the present invention.

Within the context of this specification, each term or phrase below will include the following meaning or meanings:

(a) "Bonded" refers to the joining, adhering, connecting, attaching, or the like, of two elements. Two elements will be considered to be bonded together when they are bonded directly to one another or indirectly to one another, such as when each is directly bonded to intermediate elements. The act of bonding, joining, adhering, connecting, attaching, or the like, of two elements is understood to include the two elements, such as edges, or regions adjacent the elements, such as edges.

(b) "Bonded carded fabric or web", "bonded carded web", and "bonded carded fabric" refer to fabric or webs made from staple fibers which are sent through a combing or carding unit, which breaks apart and aligns the staple fibers in the machine direction to form a generally machine direction-oriented fibrous nonwoven web. Such fibers are usually purchased in bales which are placed in a picker which separates the fibers prior to the carding unit. Once the web or fabric is formed, it is then bonded by one or more of several known bonding methods. One such bonding method is powder bonding, wherein a powdered adhesive is distributed through the web or fabric and then activated, usually by heating the fabric and adhesive with hot air. Another suitable bonding method is pattern boding, wherein heated calendar rolls or ultrasonic bonding equipment are used to bond the fibers together, usually in a localized bond pattern, though the fabric can be bonded across its entire surface if so desired. Another suitable and well-known bonding method, particularly when using bi-component staple fibers, is through-air bonding.

(c) "Cross machine direction" means a direction generally perpendicular to the machine direction.

(d) "Disposable" includes being disposed of after use, and not intended to be washed and reused.

(e) "Disposed", "disposed on", "disposed with", "disposed at", "disposed near", and variations thereof are intended to mean that one element can be integral or unitary with another element, or that one element can be a separate structure joined to or connected to or placed with or placed near another element.

(f) "Elasticity" and "elastic" include that property of a material by virtue of which it tends to substantially recover to its original size and shape after removal of a force causing deformation of the material.

(g) "Elastically connected" and "elastically connecting" refer to two elements being separated by and bonded to an elastic member, where the relative position of the two elements may change due to extension of the elastic member.

(h) "Elongation" includes the ratio of the extension of a material to the length of a material prior to the extension. Elongation is expressed in percent.

(i) "Extension", "extend", and "extended" include the change in length of a material due to stretching. Extension is expressed in units of length.

(j) "Fabric" is used to refer to all of the woven, knitted, and nonwoven webs.

(k) "Flexible" refers to materials or fabrics that are compliant and readily conform to the general shape and contours of an individual's body.

(l) "Force" includes a physical influence exerted by one body on another which produces acceleration of bodies that are free to move and deformation of bodies that are not free to move. Force is expressed in grams-force.

(m) "Foreshortened" and "foreshortening" include to shorten beforehand, that is, before a subsequent step.

(n) "Front" and "back" are used to designate relationships relative to the garment itself, rather than to suggest any position the garment assumes when it is positioned on a wearer.

(o) "Gatherable" material is one which, when bonded to the reticular web with the latter under tension, will gather, with the formation of puckers or gathers, to accommodate contraction of the reticulated web upon release of the tensioning forces.

(p) "Machine direction" means the direction in which it is produced or the length of fabric moving in the direction of the machine operations.

(q) "Meltblown fibers" means fibers formed by extruding a molten thermoplastic material through a plurality of fine, usually circular, die capillaries as molten threads or filaments into converging high velocity, usually hot gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example in U.S. Pat. No. 3,849,241 to Butin, et al. Meltblown fibers are microfibers which may be continuous or discontinuous, are generally smaller than 10 microns in average diameter, and are generally tacky when deposited onto a collecting surface.

(r) "Member" when used in the singular can have the dual meaning of a single element or a plurality of elements.

(s) "Multi-layer laminate" means a laminate wherein some of the layers are spunbond and some are meltblown such as a spunbond/meltblown/spunbond (SMS) laminate and other as disclosed in U.S. Pat. No. 4,041,203 to Brock et al., U.S. Pat. No. 5,169,706 to Collier et al., U.S. Pat. No. 5,145,727 to Potts et al., U.S. Pat. No. 5,178,931 to Perkins, et al., and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.75 to about 3 osy. Multi-layer laminates may also have various numbers of meltblown layers or multiple spunbond layers in many different configurations and may include other materials like films or coform materials.

(t) "Neckable material" means any material which can be necked.

(u) "Necked material" refers to any material which has been constricted in at least one dimension by processes such as, for example, drawing or gathering.

(v) "Non-elastic" or "inelastic" refers to any material that does not fall within the definition of "elastic".

(w) "Nonwoven fabric or web", "nonwoven web", and "nonwoven fabric" mean a web having a structure of individual fibers or threads which are interlaid, but not in an identifiable manner as in a knitted fabric. Nonwoven fabrics or webs have been formed from many processes such as, for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns.

(x) "Operatively joined" with reference to the attachment of an elastic member to another element means that the elastic member when attached to or connected to or treated with heat with the element gives that element elastic properties. With reference to the attachment of a non-elastic member to another element, it means that the member and element can be attached in any suitable manner that permits or allows them to perform the intended or described function of the joinder. The joining, attaching, connecting or the like can be either directly, such as joining either member directly to an element, or can be indirectly by means of another member or element disposed between the first member and the first element.

(y) "Pattern" includes any geometric or non-geometric form that can include, among others, a series of connected or unconnected lines or curves, a series of parallel or nonparallel or intersecting lines or curves, a series of linear or curvilinear lines, and the like, or any combinations thereof. The pattern can include a repeating form and/or non-repeating form.

(z) "Rupture" includes the breaking or tearing apart of a material. In tensile testing, rupture refers to the total separation of a material into two parts, either all at once or in stages, or the development of a hole in some materials.

(aa) "Stretch bonded" refers to an elastomeric strand being bonded to another member while the elastomeric strand is elongated at least about 25 percent of its relaxed length. Desirably, the term "stretch bonded" refers to the situation wherein the elastomeric strand is elongated at least about 50 percent, more desirably at least about 300 percent, of its relaxed length when it is bonded to the other member.

(bb) "Stretch bonded laminate" ("SBL") refers to a composite material having at least two layers in which one layer is a gatherable layer and the other layer is a stretchable, that is, elastic, layer. The layers are joined together when the stretchable layer is in a stretched condition so that upon relaxing the layers, the gatherable layer is gathered.

(cc) "Spunbonded fibers" refers to small diameter fibers which are formed by extruding molten thermoplastic material as filaments from a plurality of fine, usually circular capillaries or spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338, 992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns.

(dd) "Tension" includes a uni-axial force tending to cause the extension of a body or the balancing force within that body resisting the extension.

(ee) "Two-dimensional" refers to a garment, such as a diaper, that can be opened and laid in a flat condition without destructively tearing any structure. This type of garment does not have continuous leg and waist openings when opened and laid flat, and requires a fastening device, such as adhesive tapes, to attach the garment about the wearer.

(ff) "Three-dimensional" refers to a finished garment similar to shorts or pants in that they have continuous leg and waist openings that are bounded by the material of which the garment is made. This type of garment can be opened and laid flat only by destructively tearing it. This type of garment may or may not have manually tearable seams.

(gg) "Ultimate elongation" includes the elongation at the point of rupture.

These definitions are not intended to be limiting and these terms may be defined with additional language in the remaining portion of the specification.

DETAILED DESCRIPTION

Figure 3:
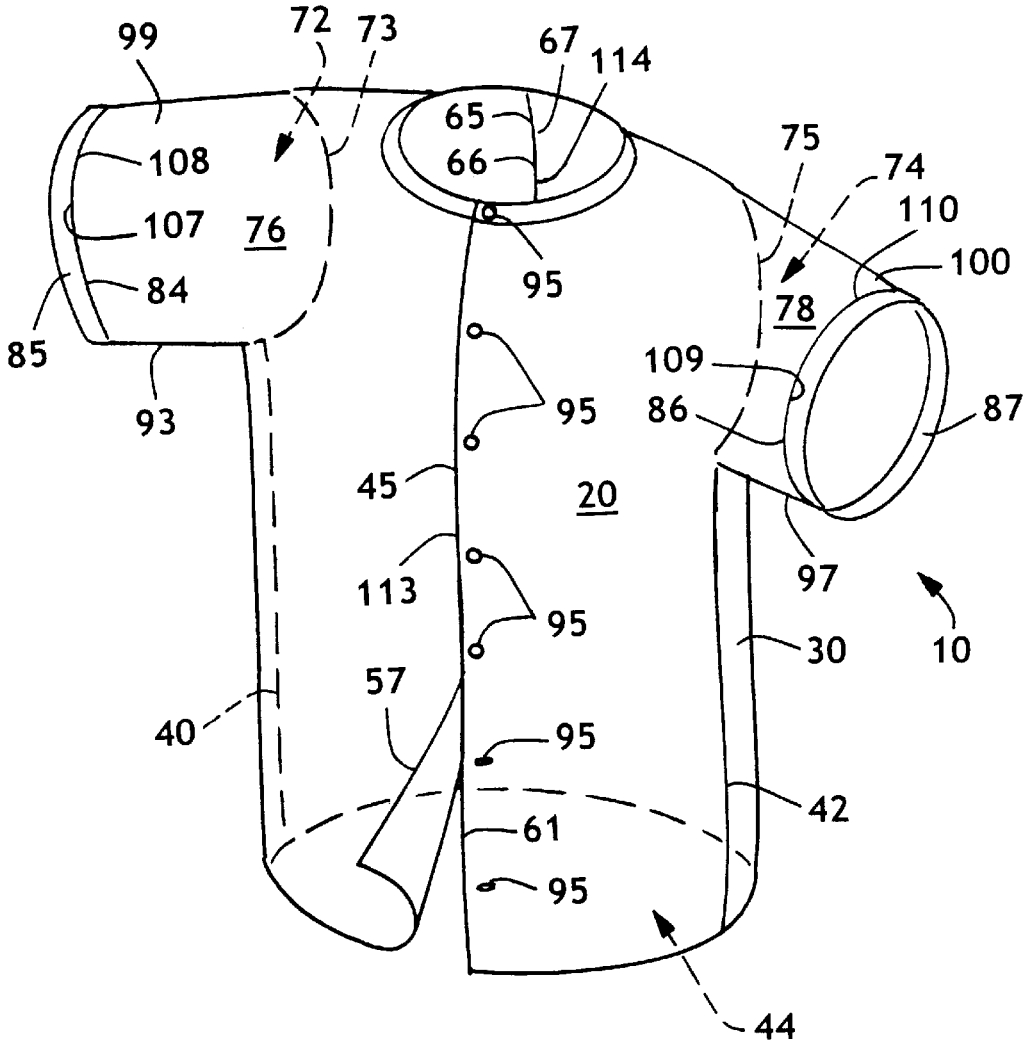
FIG. 3 is a perspective view of the front of a garment made by the present invention.
Figure 7:
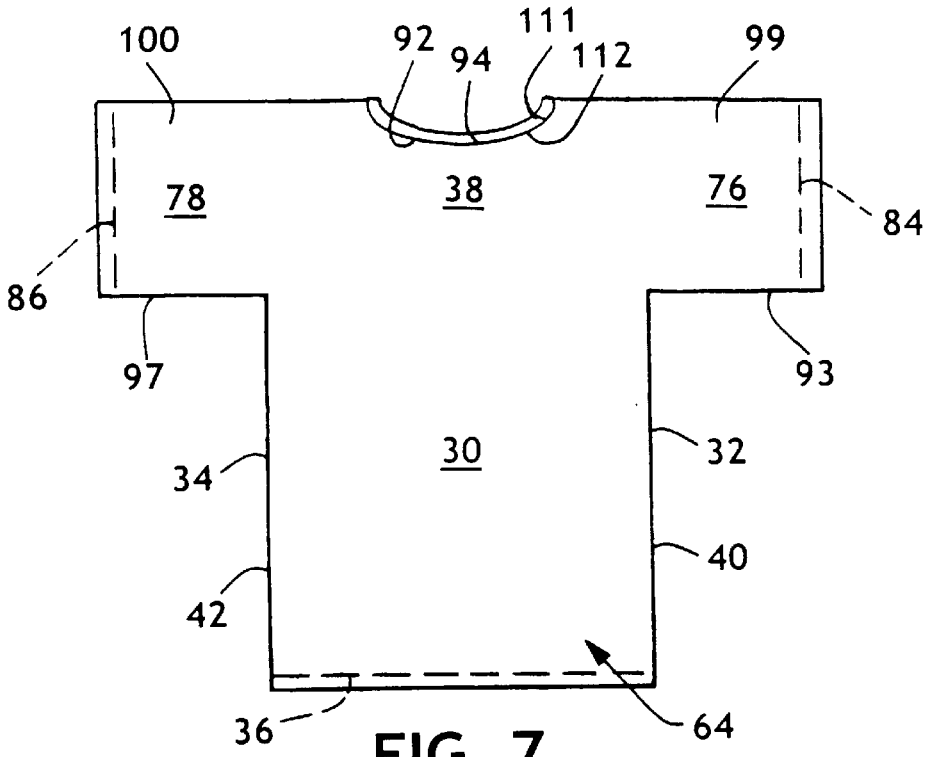
FIG. 7 is a back plan view of a garment made by the present invention in a post-assembled flat configuration.
Figure 8:
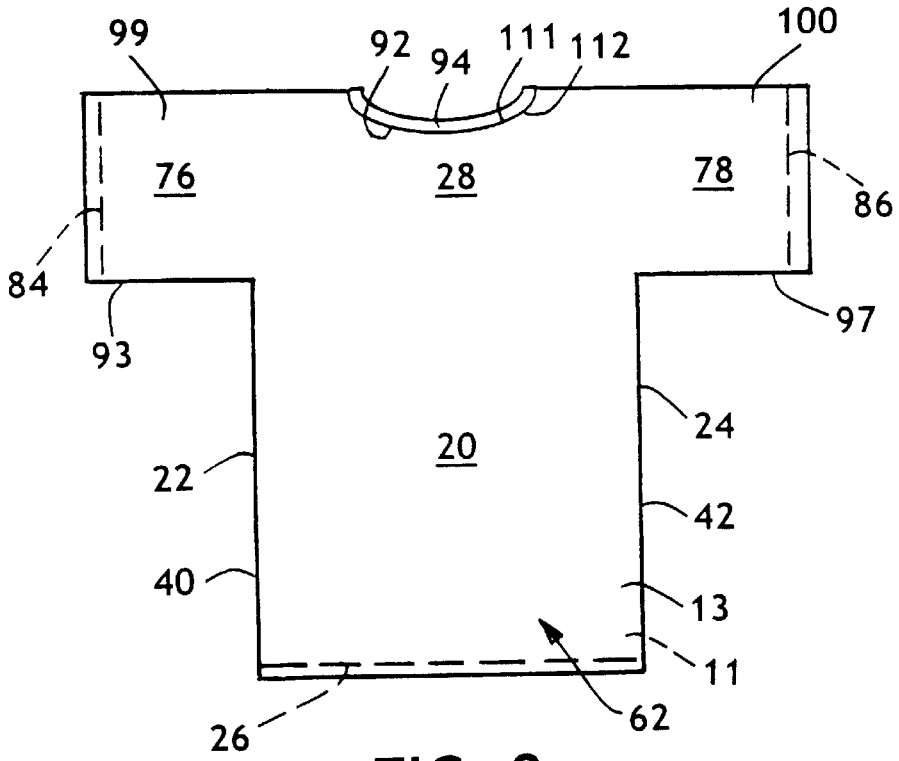
FIG. 8 is a front plan view of a garment made by the present invention in a post-assembled flat configuration.

The garment 10 is illustrated in FIGS. 1 and 3. The garment 10 includes opposing inner and outer surfaces 11 and 13, respectively. Within this application, the term "garment" is understood to mean shirt, tee-shirt, wrap, robe, gown, jacket, coat, or any type of upper body covering garment having variable lengths of the garment 10 itself and the sleeves (if any) as well as a variety of neck openings and garment openings, such as plackets. According to the preferred embodiment, see FIGS. 7 and 8, the garment 10 desirably comprises at least a front panel 20 and a back panel 30. The front panel 20 has a pair of garment side edges 22 and 24, a garment bottom edge 26 and a shoulder region 28 positioned between the garment side edges 22 and 24. The back panel 30 has a pair of garment side edges 32 and 34, a garment bottom edge 36 and a shoulder region 38 positioned between the garment side edges 32 and 34.

The garment side edge 22 is joined to the garment side edge 32 to form the garment side seam 40. The garment side edge 24 is joined to the garment side edge 34 to form the garment side seam 42. A portion of the garment side seams 40 and 42 is left unbonded or not joined, preferably in the shoulder regions 28 and 38, defining two opposing arm openings 72 and 74.

The finished garment 10 may include sleeves 76 and 78 so as to surround, at least partially, the arm openings 72 and 74, respectively, of the garment 10. In some embodiments, only one sleeve 76 or 78 may be included in the finished garment 10. The length of the sleeves 76 and 78 may vary from a length intended to at least cover the entire arm of the wearer to a caplet length or shorter. The sleeve opening end edges 84 and 86 of the sleeves 76 and 78, respectively, may be hemmed. For easier manufacture, the sleeve opening end edges 84 and 86 may be left unhemmed, facilitating easy machine cutoff.

In the embodiments of the garments 10 that do not include the sleeves 76 and 78, the unattached portions of the garment side edges 22 and 32 and the garment side edges 24, and 34, more specifically the arm opening edges 73 and 75 defining the arm openings 72 and 74, respectively, can be hemmed. For easier manufacture, the arm opening edges 73 and 75, defining the arm openings 72 and 74, may be left unhemmed, facilitating easy machine cutoff.

A neck opening 90, defined about its perimeter by edge 92, is located in at least one of the shoulder regions 28 and 38. The neck opening 90 is typically centered between the garment side edges 22, 24, 32, and 34, although such placement of the neck opening 90 is not required. The neck opening 90 may take on a variety of sizes and shapes, such as circular, oval, triangular, square, rectangular, multifaceted, asymmetric or irregular, or the like. While the placement of the neck opening 90 may be symmetrical between the shoulder regions 28 and 38, as well as between the garment side edges 22, 24, 32, and 34, typically, the placement of the neck opening 90 is configured so that a larger portion of the neck opening 90 is located in the front shoulder region 28.

Additionally, while the shape of the neck opening 90 can be symmetrical, typically, the shape of the neck opening 90 is asymmetrical as dictated by fashion and comfort. In some embodiments of the garment 10, the edge 92 of the neck opening 90 can be hemmed. For easier manufacture, the edge 92 of the neck opening 90 may be left unhemmed, facilitating easy machine cutoff.

Various styles of a collar 94 can also be attached to the edge 92 of the neck opening 90. The attachment of the collar 94 may be made non-refastenable by means as discussed below. In the alternative, the attachment of the collar 94 may be made refastenable by means as discussed below. The collars 94 include, but are not limited to, turtlenecks, mock turtlenecks, cowls, shirt collars, tee-shirt shirt ribbed edging, decorative edging, and the like known in the garment industry.

The garment bottom edges 26 and 36 of the garment 10 may also be hemmed. (Sewing equipment 117 is shown in FIG. 1). For easier manufacture, the garment bottom edges 26 and 36 of the garment 10 may be left unhemmed, facilitating easy machine cutoff.

The front panel 20, the back panel 30, or both may be cut or otherwise opened to form a slit 45 or 65 (shown in FIG. 3) such as a placket. The garment 10, including one or both slits 45 and 65, can be used as a wrap, gown, robe, or the like. The slit 45 has two edges 57 and 61. The slit 65 has two edges 66 and 67. Various fastening means, such as adhesive and mechanical type fasteners 95, see the discussion below, may be used to refastenably attach or secure the edges 57 and 61 or the edges 66 and 67 together to form reclosable or refastenable garments 10. The slits 45 and 65 of the front and back panels 20 and 30, respectively, may extend from the edge 92 of the neck opening 90 to the garment bottom edges 26 and 36, respectively. In the alternative, the slits 45 and 65 may extend over only a portion of the panels 20 and 30 between the edge 92 of the neck opening 90 to the garment bottom edges 26 and 36, respectively. When the garment 10 comprises both a slit 45 in the front panel 20 and a slit 65 in the back panel 30, the slits 45 and 65 may be similar or dissimilar in size, structure, shape, and the like. It is understood that the term 'similar' as used herein is interpreted to include identical and varying levels of similarity. It is also understood that the term 'dissimilar' as used herein is interpreted to include different and varying levels of dissimilarity.

Figure 5:
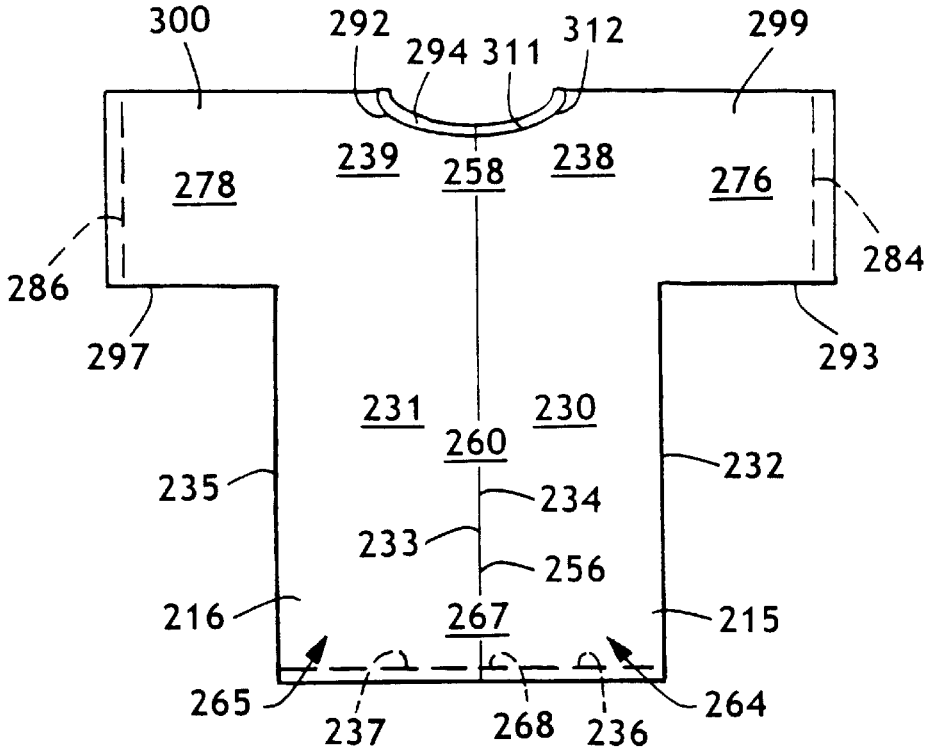
FIG. 5 is a back plan view of a garment made by the present invention in a post-assembled flat configuration.
Figure 6:
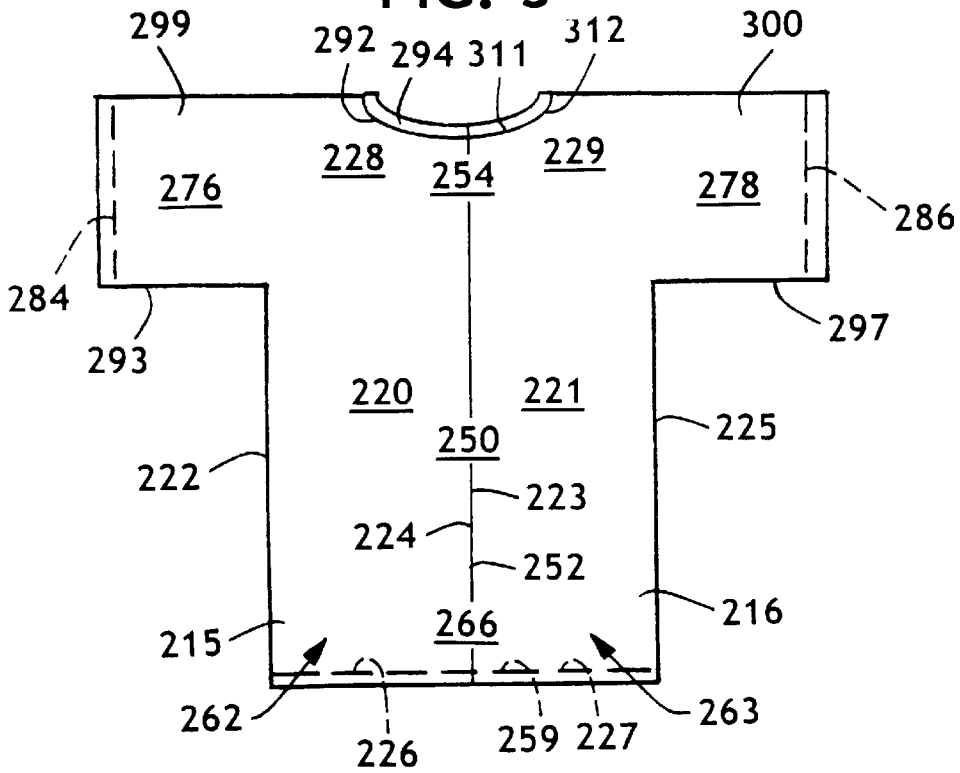
FIG. 6 is a front plan view of a garment made by the present invention in a post-assembled flat configuration.

An alternate embodiment of the invention is illustrated in FIGS. 5 and 6. The garment 210 includes opposing inner and outer surfaces 211 and 213. According to this embodiment, the garment 210 desirably comprises a right front panel 220, a left front panel 221, a right back panel 230, and a left back panel 231. The right front panel 220 has a garment side edge 222 and a side edge 224, a garment bottom edge 226 and a shoulder region 228 positioned between the garment side edge 222 and the side edge 224. The left front panel 221 has a side edge 223 and a garment side edge 225, a garment bottom edge 227 and a shoulder region 229 positioned between the side edge 223 and the garment side edge 225. The right back panel 230 has a garment side edge 232 and a side edge 234, a garment bottom edge 236 and a shoulder region 238 positioned between the garment side edge 232 and the side edge 234. The left back panel 231 has a side edge 233 and a garment side edge 235, a garment bottom edge 237 and a shoulder region 239 positioned between the side edge 233 and the garment side edge 235.

At least a portion of the side edge 224 is joined to at least a portion of the side edge 223 to form a center seam 252, a front shoulder region 254, and a front panel 250. At least a portion of the side edge 234 is joined to at least a portion of the side edge 233 to form a center seam 256, a back shoulder region 258, and a back panel 260. The garment side edge 222 is joined to the garment side edge 232 to form a garment side seam 240. The garment side edge 225 is joined to the garment side edge 235 to form a garment side seam 242. A portion of the garment side seams 240 and 242 are left unbonded or not joined, in the shoulder regions 254 and 258, defining two opposing arm openings 272 and 274.

In another embodiment of the present invention, the side edges 223 and 224 or a portion thereof (or, alternatively, in the alternative or in addition, side edges 233 and 234 or a portion thereof) may be left unjoined, thereby forming a placket (or, alternatively, plackets) in the garment 210. The garment 210 having at least a portion of the center seams 252 and 256 left unattached can be used in this form as a wrap, gown, or robe, or the like. Various closure devices, discussed below, could be utilized to form reclosable or refastenable center seams 252 or 256 or portions thereof. In other embodiments, the center seams 252 and 256, or portions thereof, may be constructed as non-refastenable seams.

In some embodiments of the garment 210, one or both of the center seams 252 and 256 may be non-refastenable. Non-refastenable center seams 252 and 256 may be formed by any suitable means such as ultrasonic sealing, adhesive bonding, heat sealing, sewing, tape, or the like known in the art. The non-refastenable center seams 252 and 256 may be constructed on a continuous or intermittent basis. One suitable method of forming such center seams 252 and 256 is disclosed in U.S. Pat. No. 4,938,753 issued Jul. 3, 1990, to Van Gompel et al., which is incorporated herein by reference. The center seams 252 and 256 may be bonded together to form non-refastenable center seams 252 and 256.

In various embodiments of the garment 210, one or both of the center seams 252 and 256 may be refastenable. The refastenable means for securing edges include adhesive and mechanical type fasteners 295. The adhesive and mechanical type fasteners include buttons and button holes, snaps, buckles, clasps, hooks and loops, end extensions, tabs, tape, and the like which are designed or adapted to interlock or engage some type of complementary device or the inner surface 211 or outer surface 213 of the garment 210. The refastenable center seams 252 and 256 may be constructed on a continuous or intermittent basis. In addition, elasticized fasteners may also be used in assuring better fit of the garment 210.

Figure 4:
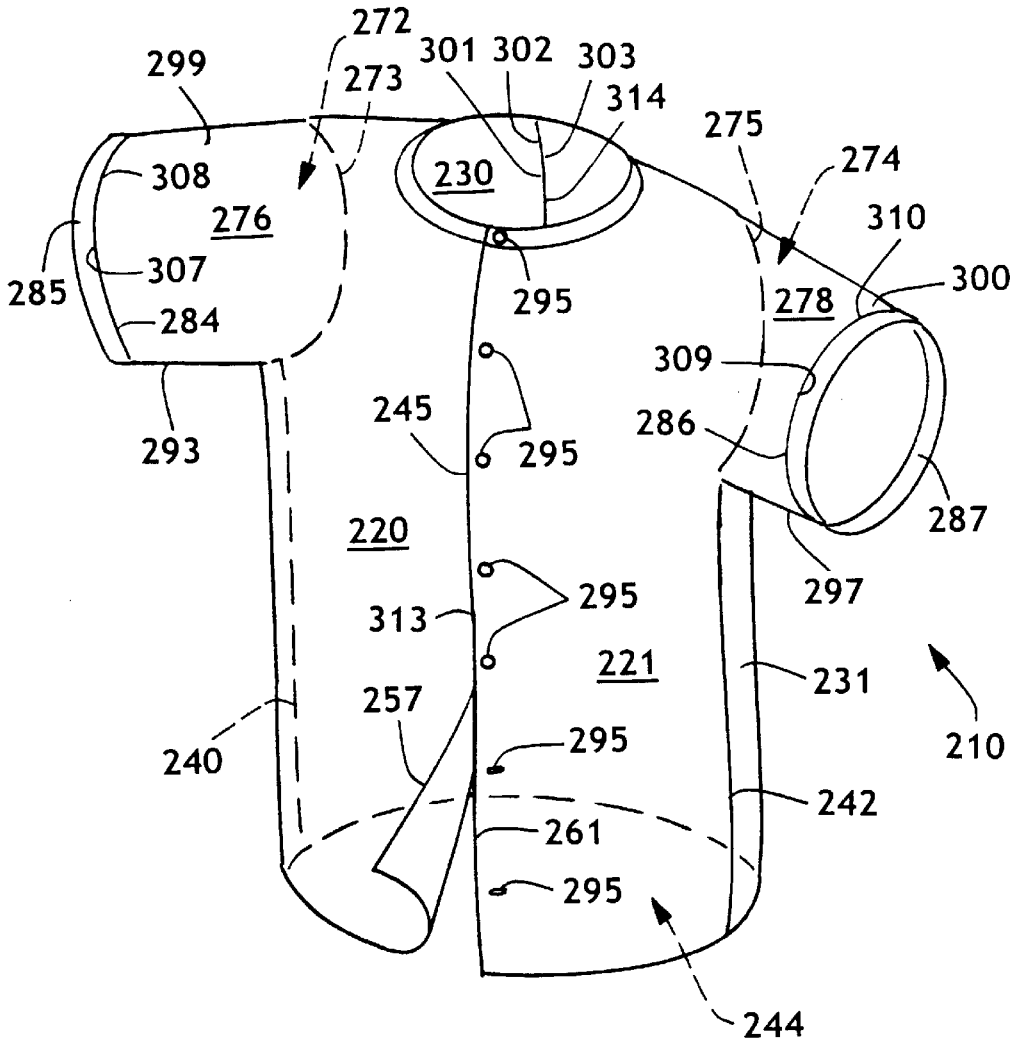
FIG. 4 is a perspective view of the front of a garment made by the present invention.

In various embodiments of the present invention, the front panel 250, the back panel 260, or both panels 250 and 260 may be cut or otherwise opened to form a slit 245 or 301 (shown in FIG. 4) such as a placket. The garment 210 including one or both slits 245 and 301 can be used as a wrap, gown, robe, or the like. The slit 245 has two edges 257 and 261. The slit 301 has two edges 302 and 303. Various fastening means, such as adhesive and mechanical type fasteners 295, see the discussion below, may be used to refastenably attach or secure the edges 257 and 261 and the edges 302 and 303 to form reclosable or refastenable garments 210. The slits 245 and 301 of the front and back panels 250 and 260, respectively, may extend from the edge 292 of the neck opening 290 to the garment bottom edges 259 and 268, respectively. In the alternative, the slits 245 and 301 may extend over only a portion of the panels 220 and 230 between the edge 292 of the neck opening 290 to the garment bottom edges 259 and 268, respectively. When the garment 210 comprises both a slit 245 in the front panel 250 and a slit 301 in the back panel 260, the slits 245 and 301 may be similar or dissimilar in size, structure, shape, and the like. It is understood that the term 'similar' as used herein is interpreted to include identical and varying levels of similarity. It is also understood that the term 'dissimilar' as used herein is interpreted to include different and varying levels of dissimilarity.

In some embodiments, the edges 257 and 261 of the slit 245 and the edges 302 and 303 of the slit 301 may be refastenably attached or secured to each other. Various fastening means, such as adhesive and mechanical type fasteners 295, see the discussion above, may be used to refastenably attach or secure the edges 257 and 261 or the edges 302 and 303 together of the slits 245 and 301, respectively.

The finished garment 210 may include sleeves 276 and 278 so as to surround, at least partially, the arm openings 272 and 274, respectively, of the garment 210. In some embodiments, only one sleeve 276 or 278 may be included in the finished garment 210. The length of the sleeves 276 and 278 may vary from a length intended to cover at least the entire arm of the wearer to a caplet length or shorter. The sleeve opening end edges 284 and 286 of the sleeves 276 and 278, respectively, may be hemmed. For easier manufacture, the sleeve opening end edges 284 and 286 may be left unhemmed, facilitating easy machine cutoff.

In the embodiments of the garments 210 that do not include the sleeves 276 and 278, the unattached portions of the garment side edges 222 and 232 and the garment side edges 225 and 235, more specifically the arm opening edges 273 and 275 defining the arm openings 272 and 274, respectively, can be hemmed. For easier manufacture, the unattached portion of the arm opening edges 273 and 275, defining the arm openings 272 and 274, may be left unhemmed, facilitating easy machine cutoff.

A neck opening 290, defined about its perimeter by edge 292, is located in at least one of the shoulder regions 254 and 258. The neck opening 290 is typically centered between the garment side edges 222 and 232 and the garment side edges 225 and 235, although such placement of the neck opening 290 is not required. The neck opening 290 may take on a variety of sizes and shapes, such as circular, oval, triangular, square, rectangular, multi-faceted, asymmetric or irregular, or the like. While the placement of the neck opening 290 may be symmetrical between the shoulder regions 254 and 258, as well as between the garment side edges 222 and 232 and the garment side edges 225 and 235, typically, the placement of the neck opening 290 is configured so that a larger portion of the neck opening 290 is located in the front shoulder region 254.

Additionally, while the shape of the neck opening 290 can be symmetrical, typically, the shape of the neck opening 290 is asymmetrical as dictated by fashion and comfort. In some embodiments of the garment 210, the edge 292 of the neck opening 290 can be hemmed. For easier manufacture, the edge 292 of the neck opening 290 may be left unhemmed, facilitating easy machine cutoff.

Various styles of a collar 294 can also be attached to the edge 292 of the neck opening 290. The attachment of the collar 294 may be made non-refastenable by means as discussed below. In the alternative, the attachment of the collar 294 may be made refastenable by means as discussed below. The collars 294 include, but are not limited to, turtlenecks, mock turtlenecks, cowls, shirt collars, tee-shirt ribbed edging, decorative edging, and the like known in the garment industry.

The garment bottom edges 226, 227, 236, and 237 of the garment 210 may also be hemmed. For easier manufacture, the garment bottom edges 226, 227, 236, and 237 of the garment 210 may be left unhemmed, facilitating easy machine cutoff.

Another embodiment of the present invention is a continuous process for the manufacture of a garment 10 (see FIGS. 1 and 3) for wearing about the upper body comprising at least a front panel 20, a back panel 30, a neck opening 90 defined about its perimeter by edge 92, arm openings 72 and 74 defined about their perimeters by arm opening edges 73 and 75, respectively, a lower body opening 44 defined about its perimeter by garment bottom edges 26 and 36. The garment 10 comprises an inner surface 11 and an outer surface 13. The garment 10 may comprise a single layer web of fabric 15 or may comprise a multi-layer laminate web of fabric 15. In some embodiments of the present invention, the garment 10 may comprise multiple layers of the web of fabric 15. In some embodiments, the garment 10 may comprise multiple layers of the web of fabric 15. The present invention requires at least one web of fabric 15 in a single continuous process to create garments 10.

In one embodiment of the present invention (see FIG. 1), one web of fabric 15 of sufficient width of fabric to make the garment 10 is provided to produce the garments 10. The desired web of fabric 15 is nonwoven although any disposable or washable fabric can be used. (See the discussion below). The web of fabric 15 is typically unwound from a roll or other source. (Not shown).

The web of fabric 15 is desirably compliant and soft feeling to the wearer. The following description of materials from which the web of fabric 15 may be formed would also be used for the materials to form the inner surface 11 and the outer surface 13 of a multi-layer laminate web of fabric 15.

The web of fabric 15 may be any suitable material, such as a woven material, a nonwoven material, a fibrous or a polymeric film material and may be, although they need not necessarily be, an elastic material or of a stretchable nature. Suitable fibrous webs may utilize any suitable natural and/or synthetic fibers, for example, woven or nonwoven webs of fibers made of acrylic polymers, polyester, polyamide, glass, polyolefins, e.g., polyethylene and polypropylene, cellulosic derivatives such as rayon, cotton, silk, wool, pulp, paper and the like, as well as blends or combinations of any two or more of the foregoing. The web of fabric 15 may also comprise polymeric film layers such as polyethylene, polypropylene, polyamide, polyester, acrylic polymers, and compatible mixtures, blends and copolymers thereof.

The web of fabric 15 may be liquid pervious, permitting liquids to readily penetrate into its thickness, or impervious, resistant to the penetration of liquids into its thickness. The web of fabric 15 may be made from a wide range of materials, such as natural fibers (e.g. rayon, wood, or cotton fibers), synthetic fibers (e.g. polyester or polypropylene fibers), or from a combination of natural and synthetic fibers or reticulated foams and apertured plastic films. The web of fabric 15 may be woven, nonwoven, or film such as spunbonded, carded, or the like. A suitable web of fabric 15 may be carded and thermally bonded by means well known to those skilled in the fabric art.

Alternatively, the web of fabric 15 may be derived from a spunbonded web. In a desired embodiment, the web of fabric 15 is spunbonded polypropylene nonwoven, meltblown polypropylene nonwoven and spunbonded polypropylene nonwoven laminate (SMS). The total basis weight is from about 0.4 to about 1.0 osy (more desirably 0.6 osy) and is made with about 86% spunbonded nonwoven and 14% meltblown nonwoven. A pigment such as titanium dioxide may be incorporated into the web of fabric 15. Such a spunbonded meltblown nonwoven laminate material is available from Kimberly-Clark Corporation, Roswell, Ga. The basis weight of the SMS material may vary from about 0.4 to about 1.0 osy.

In other desired embodiments, the web of fabric 15 is spunbonded polypropylene nonwoven with a wire-weave bond pattern having a grab tensile of 19 pounds as measured by ASTM D1682 and D1776, a Taber 40 cycle abrasion rating of 3.0 as measured by ASTM D1175 and Handle-O-Meter MD value of 6.6 grams and CD value of 4.4 grams using TAPPI method T402. Such a spunbonded material is available from Kimberly-Clark Corporation, Roswell, Ga. The web of fabric 15 has a weight of from about 0.5 oz. per square yard (osy) to about 1.5 osy, desirably about 0.7 osy.

The web of fabric 15 may be constructed of a single spunbonded polypropylene nonwoven web having a basis weight of about 0.5 oz/yd$^2$ (17 gsm) to about 1.5 oz/yd$^2$ (51 gsm). In the structure of the garment 10, the web of fabric 15 desirably comprises a material having a basis weight of from about 0.5 oz/yd$^2$ (17 gsm) to about 1.5 oz/yd$^2$ (51 gsm). Lesser or greater basis weights may be used in the other regions of the garment 10, such as the sleeves 73 and 75, the cuffs 85 and 87, and the collar 94. Since the garment 10 is typically intended for active wear, the web of fabric 15 or portions thereof, can be made of materials having a basis weight that is abrasion resistant.

The web of fabric 15 may be any soft and flexible sheet. The web of fabric 15 may permit submersion in fresh water or salt water or treated water (chlorinated or brominated) and still retain its integrity. The web of fabric 15 may comprise, for example, a nonwoven web or sheet of a spunbonded, meltblown or bonded-carded web composed of synthetic polymer filaments, such as polypropylene, polyethylene, polyesters or the like, or a web of natural polymer filaments such as rayon or cotton. The web of fabric 15 may be selectively embossed or perforated with discrete slits or holes extending therethrough.

The web of fabric 15 may be further dyed, pigmented, or imprinted with any suitable color. Desirably, the web of fabric 15 is dyed, pigmented, or printed with a material which does not irritate or bleed the color onto the skin of the wearer.

For embodiments wherein the web of fabric 15 is a multi-layer laminate, both the outer surface 13 and the inner surface 11 are desirably compliant and soft feeling to the wearer. The following description of materials from which the outer surface 13 may be formed may also be used to form the material of the inner surface 11.

The outer surface 13 may be any suitable gatherable material, such as a woven material, a nonwoven material, a fibrous or a polymeric film material and may be, although they need not necessarily be, an elastic material or of a stretchable nature. Suitable fibrous gatherable webs may utilize any suitable natural and/or synthetic fibers, for example, woven or nonwoven webs of fibers made of acrylic polymers, polyester, polyamide, glass, polyolefins, e.g., polyethylene and polypropylene, cellulosic derivatives such as rayon, cotton, silk, wool, pulp, paper and the like, as well as blends or combinations of any two or more of the foregoing. The gatherable webs may also comprise polymeric film layers such as polyethylene, polypropylene, polyamide, polyester, acrylic polymers, and compatible mixtures, blends and copolymers thereof.

The outer surface 13 may be liquid pervious, permitting liquids to readily penetrate into its thickness, or impervious, resistant to the penetration of liquids into its thickness. The outer surface 13 may be made from a wide range of materials, such as natural fibers (e.g. rayon, wood, or cotton fibers), synthetic fibers (e.g. polyester or polypropylene fibers), or from a combination of natural and synthetic fibers or reticulated foams and apertured plastic films. The outer surface 13 may be woven, nonwoven, or film such as spunbonded, carded, or the like. A suitable material for the outer surface 13 may be carded and thermally bonded by means well known to those skilled in the fabric art.

Alternatively, the outer surface 13 may be derived from a spunbonded web. In a desired embodiment, the outer surface 13 is spunbonded polypropylene nonwoven, meltblown polypropylene nonwoven and spunbonded polypropylene nonwoven laminate (SMS). The total basis weight is from about 0.4 to about 1.0 osy (more desirably 0.6 osy) and is made with about 86% spunbonded nonwoven and 14% meltblown nonwoven. A pigment such as titanium dioxide may be incorporated into the outer surface 13 and the inner surface 11. Such spunbonded meltblown nonwoven laminate material is available from Kimberly-Clark Corporation, Roswell, Ga. The basis weight of the SMS material may vary from about 0.4 to about 1.0 osy.

In other desired embodiments, the outer surface 13 is spunbonded polypropylene nonwoven with a wire-weave bond pattern having a grab tensile of 19 pounds as measured by ASTM D1682 and D1776, a Taber 40 cycle abrasion rating of 3.0 as measured by ASTM D1175 and Handle-O-Meter MD value of 6.6 grams and CD value of 4.4 grams using TAPPI method T402. Such spunbonded material is available from Kimberly-Clark Corporation, Roswell, Ga. The outer surface 13 has a weight of from about 0.5 oz. per square yard (osy) to about 1.5 osy, desirably about 0.7 osy.

The outer surface 13 may be constructed of a single spunbonded polypropylene nonwoven web having a basis weight of about 0.5 oz/yd$^2$ (17 gsm) to about 1.5 oz/yd$^2$ (51 gsm). In the structure of the garment 10, the outer surface 13 desirably comprises a material having a basis weight of from about 0.5 oz/yd$^2$ (17 gsm) to about 1.5 oz/yd$^2$ (51 gsm). Lesser or greater basis weights may be used in the other regions of the garment 10. Since the garment 10 is typically intended for active wear, the outer surface 13 or portions thereof, can be made of materials having a basis weight which is abrasion resistant.

The inner surface 11 may be any soft and flexible sheet. The inner surface 11 may permit submersion in fresh water or salt water or treated water (chlorinated or brominated) and still retain its integrity. The inner surface 11 may comprise, for example, a nonwoven web or sheet of a spunbonded, meltblown, or bonded-carded web composed of synthetic polymer filaments, such as polypropylene, polyethylene, polyesters or the like, or a web of natural polymer filaments such as rayon or cotton. The inner surface 11 may be selectively embossed or perforated with discrete slits or holes extending therethrough. Suitable adhesives for adhering the laminate layers can be obtained from Findley Adhesives, Inc. of Wauwatosa, Wis.

The outer surface 13 and the inner surface 11 may be further dyed, pigmented, or imprinted with any suitable color. Desirably, the inner surface 11 is either dyed, pigmented, or printed with a material which does not irritate or bleed the color onto the skin of the wearer.

Another embodiment of the present invention is a continuous process for the manufacture of a garment 10 (see FIGS. 1 and 3) for wearing about the upper body comprising at least a front panel 20, a back panel 30, a neck opening 90 defined about its perimeter by edge 92, sleeve flaps 99 and 100, and a lower body opening 44 defined about its perimeter by garment bottom edges 26 and 36. The garment 10 comprises an inner surface 11 and an outer surface 13. The garment 10 may comprise a single layer web of fabric 15 or may comprise a multi-layer laminate web of fabric 15. The materials comprising the web of fabric 15 have been discussed above. In some embodiments, the garment 10 may comprise multiple layers of the web of fabric 15.

The web of fabric 15 of sufficient width of fabric to make the garment 10 is provided to produce the garments 10. The desired web of fabric 15 is nonwoven although any disposable or washable fabric can be used. (See the discussion above). The web of fabric 15 is typically unwound from a roll or other source. (Not shown).

The web of fabric 15 includes a pair of opposing web side edges 46 and 47. A repeating series of pairs of opposing indentations 69 and 71 are cut into the web side edges 46 and 47 of the web of fabric 15 by the die cutter 14. (See FIG. 1). The location of the opposing indentations 69 and 71 correspond to the garment side edges 22 and 24, and the garment side edges 32 and 34, respectively, of the finished garment 10. The opposing indentations 69 and 71 may be produced by a die cut operation, an ultrasonic operation, or any other suitable method of operation. The material to be removed from the opposing indentations 69 and 71 may be removed by any method known in the art, desirably a vacuum source (not shown).

The opposing indentations 69 and 71 may take on a variety of sizes and shapes, such as oval, triangular, square, rectangular, multi-faceted, asymmetric or irregular, or the like. The pattern of the opposing indentations 69 and 71 is restricted only by fashion and the minimum amount of web of fabric 15 that must remain having a sufficient integrity to withstand the remaining steps or operations of the process of manufacture. The opposing indentations 69 and 71 may be similar or dissimilar in shape, structure, size, and the like from each other within the finished garment 10.

In some embodiments, the operation of cutting the opposing indentations 69 and 71 into the web side edges 46 and 47 of the web of fabric 15 may be eliminated. As the pattern of the garment 10 is restricted only by fashion and the minimum amount of web of fabric 15 that must remain having a sufficient integrity to withstand the operations or steps of the process of manufacture, one can simply design the garment 10 such that this operation of cutting the opposing indentations 69 and 71 into the web side edges 46 and 47 (or, alternatively, the garment side edges 22 and 24 and the garment side edges 32 and 34) the web of fabric 15 is not required. As discussed above, the arm openings 72 and 74 may be created by leaving a portion of the garment side edges 22 and 32 and the garment side edges 24 and 34, respectively, unattached.

A repeating series of openings 89 are cut by the die cutter 14 into the web of fabric 15. The location of the opening 89 corresponds to the neck opening 90 in the finished garment 10. The openings 89 may be produced by a die cut operation, an ultrasonic operation, or any other suitable method of operation known in the art. It is understood that while FIG. 1 shows the die cutter 14 cutting the opening 89 and the opposing indentations 69 and 71, these cutting operations could be performed by separate devices and at different stages within the manufacturing process. The material to be removed from the openings 89 may be removed by any method known in the art, desirably a vacuum source (not shown). The opening 89 may take on a variety of sizes and shapes, such as slit, circular, oval, triangular, square, rectangular, multi-faceted, asymmetric or irregular, or the like. The pattern of the opening 89 is restricted only by fashion and the minimum amount of web of fabric 15 that must remain having a sufficient integrity to withstand the remaining steps or operations of the process of manufacture.

The placement of the opening 89 in relation to two pairs of opposing indentations 69 and 71, while in a typical garment 10, the opening 89 is centrally located between the two pairs of opposing indentations 69 and 71, is restricted only by fashion and the minimum amount of web of fabric 15 that must remain having sufficient integrity to withstand the remaining steps or operations of the process of manufacture. For example, the placement of the opening 89 between the two pairs of opposing indentations 69 and 71 may be symmetrically or asymmetrically located.

The web of fabric 15 is cut by a die cutter 19 into discrete garment-sized pieces 17 wherein each discrete garment-sized piece 17 contains at least one opening 89, two pairs of opposing indentations 69 and 71, one pair of opposing web side edges 46 and 47, one pair of opposing garment bottom edges 26 and 36, and opposing garment end portions 62 and 64. The location of the opposing web side edges 46 and 47 of the web of fabric 15 corresponds to a sleeve opening end edge 84 of a sleeve flap 99 proximate the garment side edge 22 of the front panel 20 and garment side edge 32 of the back panel 30 and a sleeve opening end edge 86 of a sleeve flap 100 proximate the garment side edge 24 of the front panel 20 and the garment side edge 34 of the back panel 30, respectively, in the finished garment 10. It is understood that while the opposing web side edges 46 and 47 of the web of fabric 15 (or, alternatively, the discrete garment-sized piece 17) may typically become the sleeve opening end edges 84 and 86 in the finished garment 10, fabric may be removed from or added to the web side edges 46 and 47 to create the sleeve opening end edges 84 and 86 in the finished garment 10.

The opposing garment end portions 62 and 64 are adjacent to the garment bottom edge 26 of the front panel 20 and the garment bottom edge 36 of the back panel 30, respectively, in the finished garment 10. The location of the opposing piece side edges 35 and 37 of the discrete garment-sized piece 17 correspond to the garment bottom edge 26 of the front panel 20 and the garment bottom edge 36 of the back panel 30, respectively, in the finished garment 10. It is understood that while the opposing piece side edges 35 and 37 of the discrete garment-sized piece 17 may typically become the garment bottom edges 26 and 36 in the finished garment 10, fabric may be removed from or added to the piece side edges 35 and 37 to create the garment bottom edges 26 and 36 in the finished garment 10.

Each discrete garment-sized piece 17 of the web of fabric 15 is transported, typically by vacuum screens, belts, or conveyors, through hemming, folding, and fastening operations (not shown). The folding operations are desirably carried out by tuckers and folders, as well as any other known means. The discrete garment-sized piece 17 of the web of fabric 15 is folded by a folder 77 so as to bring together the opposing garment end portions 62 and 64 such that web side edge 46 of the web of fabric 15 is folded on to itself, bringing the garment side edge 22 of the front panel 20 and the garment side edge 32 of the back panel 30 together. The web side edge 47 of the web of fabric 15 is folded on to itself, bringing the garment side edge 24 of the front panel 20 and the garment side edge 34 of the back panel 30 together.

The mating of the garment side edge 22 and the garment side edge 32 as well as the mating of the garment side edge 24 and the garment side edge 34 form the garment side seams 40 and 42, respectively, of the garment 10. It may be desirable to redirect (or reorient) the discrete garment-sized piece 17 of the web of fabric to allow easy bonding of the garment side seams 40 and 42 of the garment 10. The turning operations are desirably carried out by turn rolls and turn tables, as well as any other known means. The discrete garment-sized piece 17 of the web of fabric 15 may be reoriented 90 degrees (not shown).

In various embodiments of the present invention, one or both of the garment side seams 40 and 42 can be constructed as non-refastenable seams or as refastenable seams. Any excess material of the web of fabric 15 may be removed from the edges of the garment side seams 40 and 42 to reduce and smooth out the garment side seams 40 and 42. The non-refastenable garment side seams 40 and 42 may be formed by any suitable means such as ultrasonic sealing, adhesive bonding, tape, heat sealing, sewing, or any method of fastening known in the art. (Sewing equipment 118 is shown in FIG. 1). The non-refastenable garment side seams 40 and 42 may be constructed on a continuous or intermittent basis. One suitable method of forming such garment side seams 40 and 42 is disclosed in U.S. Pat. No. 4,938,753 issued Jul. 3, 1990, to Van Gompel et al., which is incorporated herein by reference. The garment side seams 40 and 42 may be bonded together to form non-refastenable garment side seams 40 and 42.

In other embodiments of the present invention, the garment side edges 22 and 32 and the garment side edges 24 and 34 of the garment 10 may be held together in the finished garment 10 to form refastenable garment side seams 40 and 42, respectively. The refastenable means for securing the garment side edges 22 and 32 and the garment side edges 24 and 34 of the garment 10 include refastenable adhesive and mechanical type fasteners 95. The adhesive and mechanical type fasteners 95 include buttons and button holes, snaps, buckles, clasps, hooks and loops, end extensions, tabs, tape, and the like which are designed or adapted to interlock or engage some type of a complementary device or the outer surface 13 or the inner surface 11 of the garment 10.

In addition, elasticized fasteners 95 may also be used in assuring better fit of the garment 10. If the garment 10 includes refastenable garment side seams 40 and 42, the refastenable means are desirably strategically placed on the web of fabric 15 before the web of fabric 15 is cut into discrete garment-sized pieces 17. The folding and redirection operations may be eliminated when refastenable garment side seams 40 and 42 are included in the garment 10. However, there may be packaging reasons for which one would still carry out these two steps.

Figure 12:
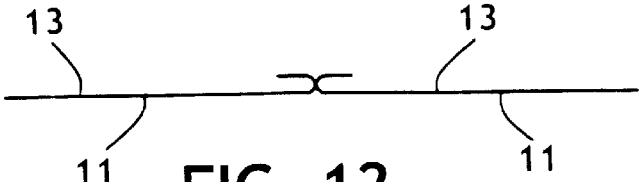
FIG. 12 is a cross sectional view of a seam.

The garment side seams 40 and 42 of the present invention may take on a variety of structures or configurations known in the art. One embodiment of the garment side seams 40 and 42 is an out-turned configuration as illustrated in FIG. 12. Such configured garment side seams 40 and 42 are formed by securing together at least a portion of the out-turned portions of the garment side edges 22 and 32 and the garment side edges 24 and 34, respectively. The inner surface 11 of the garment side edges 22 and 24 of the front panel 20 and the garment side edges 32 and 34 of the back panel 30, respectively, are brought into contact with each other, respectively.

Figure 13:
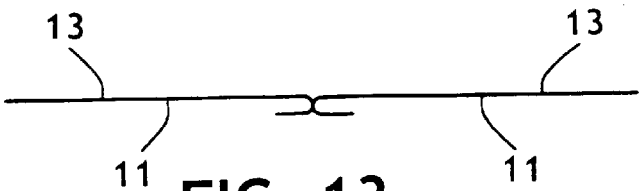
FIG. 13 is a cross sectional view of a seam.

Another embodiment of the garment side seams 40 and 42 is an in-turned configuration as illustrated in FIG. 13. Such configured garment side seams 40 and 42 are formed by securing together at least a portion of the in-turned portions of the garment side edges 22 and 32 and the garment side edges 24 and 34, respectively. The outer surface 13 of the garment side edges 22 and 24 of the front panel 20 and the garment side edges 32 and 34 of the back panel 30 are brought into contact with each other, respectively.

Figure 11:
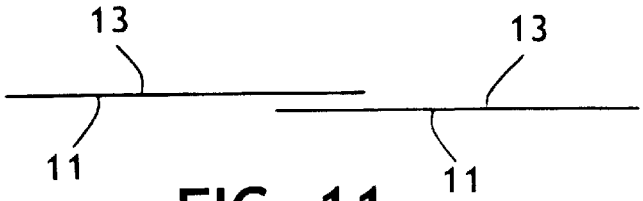
FIG. 11 is a cross sectional view of a seam.

Another embodiment of the garment side seams 40 and 42 is an over-lapped configuration as illustrated in FIG. 11. Such configured garment side seams 40 and 42 are formed by securing together at least a portion of the over-lapped portions of the garment side edges 22 and 32 and the garment side edges 24 and 34, respectively. The inner surface 11 of one of the garment side edges 22 and 32 and one of the garment side edges 24 and 34 are brought into contact with the outer surface 13 of the other side edge of each pair of side edges.

Figure 14:
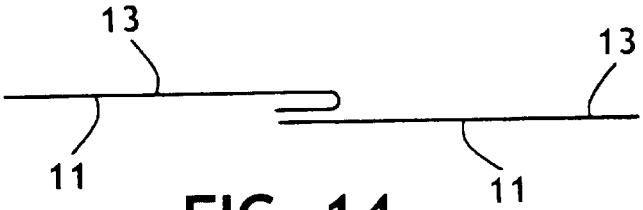
FIG. 14 is a cross sectional view of a seam.

Another embodiment of the garment side seams 40 and 42 is an over-lapped configuration as illustrated in FIG. 14. Such a configured garment side seam 40 is formed by folding the garment side edge 22 or the garment side edge 32. The outer surface 13 of the folded portion and the inner surface 11 of the unfolded portion of the garment side edge 22 or 32 and the corresponding portion of the front panel 20 or the back panel 30, respectively, are brought into contact with the inner surface 11 or the outer surface 13 of the non-folded garment side edge 32 or 22 and the corresponding portion of the back panel 30 or the front panel 20.

The garment side seam 42 is formed by folding back the garment side edge 24 or the garment side edge 34. The outer surface 13 of the folded portion and the inner surface 11 of the unfolded portion of the garment side edges 24 or 34 and the corresponding portion of the front panel 20 or the back panel 30, respectively, are brought into contact with the inner surface 11 or the outer surface 13 of the non-folded garment side edge 34 or 24 and the corresponding portion of the back panel 30 or the front panel 20. It is understood that the folding back of a garment side edge 22, 24, 32, or 34 could be performed such that the inner surface 11 would be exposed along the fold.

The garment end portions 62 and 64 of the discrete garment-sized pieces 17 web of fabric 15 may be hemmed in the finished garment 10. The garment end portions 62 and 64 can be hemmed by any method or style known in the art. In some embodiments, it may be desirable to leave the garment end portions 62 and 64 unhemmed. The garment bottom edges 26 and 36 of the discrete garment-sized pieces 17 web of fabric 15 may be hemmed in the finished garment 10. The garment bottom edges 26 and 36 can be hemmed by any method or style known in the art. In some embodiments, it may be desirable to leave the garment bottom edges 26 and 36 unhemmed.

Figure 9:
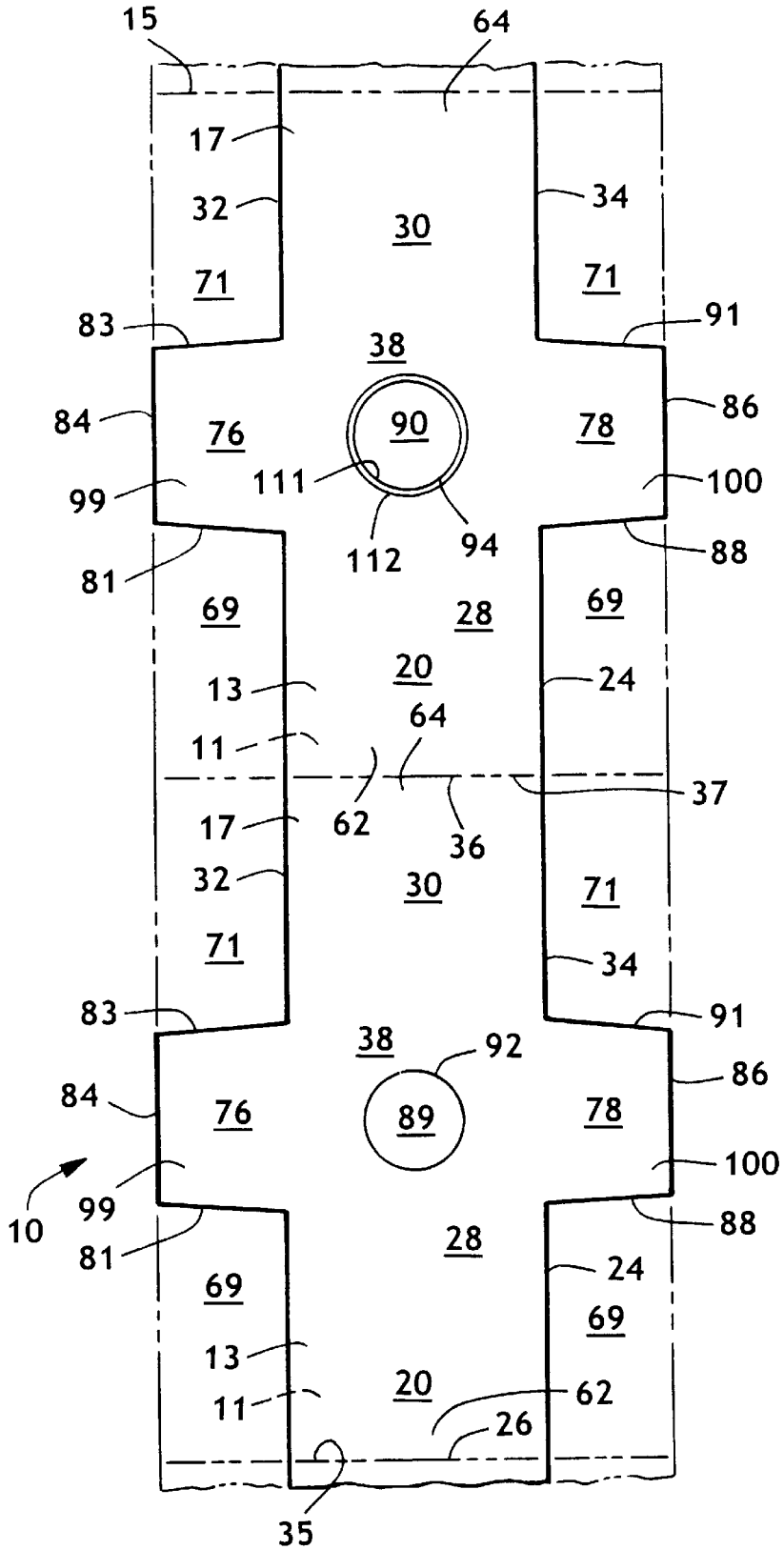
FIG. 9 is a top plan view of a garment made by the present invention in a pre-assembled flat configuration.

As shown in FIG. 9, the garment 10 includes sleeve flaps 99 and 100. The sleeve flaps 99 and 100 may take on a variety of sizes and shapes, such as circular, oval, triangular, square, rectangular, multi-faceted, asymmetric or irregular, or the like. The pattern of the sleeve flaps 99 and 100 is restricted only by fashion and the minimum amount of the material of the sleeve flaps 99 and 100 that is necessary to complete the remaining steps or operations of the process of manufacture. In some embodiments, only one sleeve 76 or 78 may be included in the finished garment 10. The sleeves 76 and 78, alternately the sleeve flaps 99 and 100, may be similar or dissimilar in shape, structure, material, size, and the like from each other within the finished garment 10.

The sleeve flap 99 has a pair of sleeve side edges 81 and 83, and a sleeve opening end edge 84 extending between the sleeve side edges 81 and 83. It is understood that the sleeve flap 99 could be made of multiple pieces of material or materials. The sleeve flap 99 is folded so as to bring together the opposing sleeve side edges 81 and 83 to form a sleeve seam 93 of the sleeve 76.

The sleeve flap 100 has a pair of sleeve side edges 88 and 91, and a sleeve opening end edge 86 extending between the sleeve side edges 88 and 91. It is understood that the sleeve flap 100 could be made of multiple pieces of material or materials. The sleeve flap 100 is folded so as to bring together the opposing sleeve side edges 88 and 91 to form a sleeve seam 97 of the sleeve 78.

It may be desirable to redirect (or reorient) the discrete garment-sized pieces 17 to allow easy fastening of the sleeve seams 93 and 97 of the sleeves 76 and 78, respectively, of the garment 10. The discrete garment-sized pieces 17 may be reoriented 90 degrees (not shown). The sleeve seams 93 and 97 can be non-refastenable seams or refastenable seams. Any excess material of the fabric pieces 99 and 100 can be removed from their respective edges of the sleeve seams 93 and 97 to reduce and smooth out the sleeve seams 93 and 97. The non-refastenable sleeve seams 93 and 97 may be formed by any suitable means such as ultrasonic sealing, adhesive bonding, tape, heat sealing, sewing, or other methods of fastening as known in the art, as discussed above. The non-refastenable sleeve seams 93 and 97 may be constructed on a continuous or intermittent basis.

In other embodiments, the opposing pair of the sleeve side edges 81 and 83 and the opposing pair of the sleeve side edges 88 and 91 of the sleeves 76 and 78, respectively, may be held together in the finished garment 10 to form refastenable sleeve seams 93 and 97. The refastenable means for securing the opposing pair of the sleeve side edges 81 and 83 and the opposing pair of the sleeve side edges 88 and 91 of the sleeves 76 and 78, respectively, include refastenable adhesive and mechanical type fasteners 95. The adhesive and mechanical type fasteners 95 include buttons and button holes, snaps, buckles, clasps, hooks and loops, end extensions, tabs, tape, and the like which are designed or adapted to interlock or engage some type of a complementary device or the inner surface 11 or the outer surface 13 of the garment 10. The refastenable sleeve seams 93 and 97 may be constructed on a continuous or intermittent basis.

In addition, elasticized fasteners may also be used in assuring better fit of the sleeves 76 and 78 of the garment 10. If the garment 10 includes refastenable sleeve seams 93 and 97, the refastenable means are desirably strategically placed on the sleeve flaps 99 and 100 before or after the web of fabric 15 is cut into discrete garment-sized pieces 17 of the web of fabric 15. The folding and redirection operations may be eliminated when refastenable sleeve seams 93 and 97 are included in the garment 10. However, there may be packaging reasons for which one would still carry out these two steps.

The sleeve seams 93 and 97 of the present invention may take on a variety of structures or configurations known in the art. One embodiment of the sleeve seams 93 and 97 is an out-turned configuration as illustrated in FIG. 12. Such configured sleeve seams 93 and 97 are formed by securing together at least a portion of the out-turned portions of the sleeve side edges 81 and 83 and the sleeve side edges 88 and 91 of the sleeve flaps 99 and 100, respectively. The inner surface 11 of the sleeve side edges 81 and 83 and the sleeve side edges 88 and 91 of the sleeve flaps 99 and 100, respectively, are brought into contact with each other of the pair.

Another embodiment of the sleeve seams 93 and 97 is an in-turned configuration as illustrated in FIG. 13. Such configured sleeve seams 93 and 97 are formed by securing together at least a portion of the in-turned portions of the sleeve side edges 81 and 83 and the sleeve side edges 88 and 91 of the sleeve flaps 99 and 100, respectively. The outer surface 13 of the sleeve side edges 81 and 83 and the sleeve side edges 88 and 91 of sleeve flaps 99 and 100, respectively, are brought into contact with each other of the pair.

Another embodiment of the sleeve seams 93 and 97 is an over-lapped configuration as illustrated in FIG. 11. Such configured sleeve seams 93 and 97 are formed by securing together at least a portion of the over-lapped portions of the sleeve side edges 81 and 83 and the sleeve side edges 88 and 91 of the sleeve flaps 99 and 100, respectively. The inner surface 11 of one of the sleeve side edges 81 or 83 and the sleeve side edges 88 or 91 of the sleeve flaps 99 and 100, respectively, are brought into contact with the outer surface 13 of the other sleeve side edge 81 or 83 and the sleeve side edge 88 or 91 of the sleeve flap 99 and 100, respectively.

Another embodiment of the sleeve seams 93 and 97 is an over-lapped configuration as illustrated in FIG. 14. Such configured sleeve seams 93 and 97 are formed by folding back the sleeve side edge 81 or 83 and the sleeve side edge 88 or 91 of the sleeve flaps 99 and 100, respectively. The outer surface 13 of the folded portions and the inner surface of the unfolded portions of the sleeve side edge 81 or 83 and the sleeve side edge 88 or 91 and the corresponding portions of the sleeve flaps 99 and 100, respectively, are brought into contact with the inner surface 11 or the outer surface 13 of the non-folded sleeve side edges 81 or 83 and the sleeve side edges 88 or 91 and the corresponding portions of the sleeves flaps 99 and 100, respectively. It is understood that the folding back of a sleeve side edge 81, 83, 88, or 91 could be performed such that the inner surface 11 would be exposed along the fold.

The sleeve opening end edges 84 and 86 of the sleeves 76 and 78, respectively, (in the alternative, the sleeve opening end edges 84 and 86 of the sleeve flaps 99 and 100, respectively) can be hemmed by any method or style known in the art. In some embodiments, it may be desirable to leave the sleeve opening end edges 84 and 86 unhemmed.

In other embodiments, cuffs 85 and 87 may be attached to the sleeve opening end edges 84 and 86, respectively, of the sleeves 76 and 78, respectively, of the garment 10, forming cuff seams 108 and 110, respectively. The attachment of the cuffs 85 and 87 may be made non-refastenable by means as discussed above. (Sewing equipment 116 is shown in FIG. 1). In the alternative, the attachment of the cuffs 85 and 87 may be made refastenable by means as discussed above. The cuff seams 108 and 110 may be constructed on a continuous or intermittent basis. The cuffs 85 and 87 may take on a variety of sizes and shapes. The cuffs 85 and 87 may be similar or dissimilar in shape, structure, material, size, and the like from each other within the finished garment 10. The pattern of the cuffs 85 and 87 is restricted only by the fashion and the minimum amount of the material of the cuffs 85 and 87 that is necessary to complete the remaining steps or operations of the process of manufacture.

The cuff seams 108 and 110 of the present invention may take on a variety of structures or configurations known in the art. One embodiment of the cuff seams 108 and 110 is an out-turned configuration as illustrated in FIG. 12. Such configured cuff seams 108 and 110 are formed by securing together at least a portion of the out-turned portions of the cuff edge 107 and the sleeve opening end edge 84 and the cuff edge 109 and the sleeve opening end edge 86, respectively, of the garment 10. The inner surface 11 of the cuff edges 107 and 109 of the cuffs 85 and 87, respectively, is brought into contact with the inner surface 11 of the sleeve opening edges 84 and 86 of the sleeves 76 and 78, respectively.

Another embodiment of the cuff seams 108 and 110 is an in-turned configuration as illustrated in FIG. 13. Such configured cuff seams 108 and 110 are formed by securing together at least a portion of the in-turned portions of the cuff edge 107 and the sleeve opening edge 84 and the cuff edge 109 and the sleeve opening edge 86, respectively, of the garment 10. The outer surface 13 of the cuff edges 107 and 109 of the cuffs 85 and 87, respectively, is brought into contact with the outer surface 13 of the sleeve opening edges 84 and 86 of the sleeves 76 and 78, respectively.

Another embodiment of the cuff seams 108 and 110 is an over-lapped configuration as illustrated in FIG. 11. Such configured cuff seams 108 and 110 are formed by securing together at least a portion of the over-lapped portions of the cuff edge 107 and the sleeve opening edge 84 and the cuff edge 109 and the sleeve opening edge 86 of the sleeves 76 and 78, respectively. The inner surface 11 of one of the cuff edge 107 or the sleeve opening edge 84 and the cuff edge 109 or the sleeve opening edge 86, is brought into contact with the outer surface 13 of the other cuff edge 107 or the sleeve opening edge 84 and the cuff edge 109 or the sleeve opening edge 86 of the sleeves 76 and 78, respectively.

Another embodiment of the cuff seams 108 and 110 is an over-lapped configuration as illustrated in FIG. 14. Such configured cuff seams 108 and 110 are formed by folding back the cuff edge 107 or the sleeve opening end edge 84 and the cuff edge 109 or the sleeve opening end edge 86 of the sleeves 76 and 78, respectively. The outer surface 13 of the folded portions and the inner surface 11 of the unfolded portions of the cuff edge 107 or the sleeve opening end edge 84 and the cuff edge 109 or the sleeve opening end edge 86 and the corresponding portions of the cuffs 85 and 87 or the sleeves 76 and 78 are brought into contact with the inner surface 11 or the outer surface 13 of the unfolded cuff edge 107 or 109 or the sleeve opening end edge 84 or 86 and the corresponding portions of the cuffs 85 and 87 or the sleeves 76 and 78. It is understood that the folding back of a cuff edge 107 or 109 or a sleeve opening end edge 84 or 86 could be performed such that the inner surface 11 would be exposed along the fold.

The materials used for the cuffs 85 and 87 may be the same as the materials used for the other portions of the garment 10. In some embodiments, it is desirable that the materials used for the cuffs 85 and 87 have an elastic element such that the cuffs 85 and 87 will conform to the portion of the wearer's arms that come into contact with the cuffs 85 and 87.

The edge 92 of the neck opening 90 can be hemmed by any method or style known in the art. In some embodiments, it may be desirable to leave the edge 92 of the neck opening 90 unhemmed.

In other embodiments, a collar 94 may be attached to the edge 92 of the neck opening 90 of the garment 10, thereby forming a collar seam 112. The attachment of the collar 94 may be made non-refastenable by means as discussed above. (Sewing equipment 115 is shown in FIG. 1). In the alternative, the attachment of the collar 94 may be made refastenable by means as discussed above. The collar seam 112 may be constructed on a continuous or intermittent basis. The collar 94 may take on a variety of sizes and shapes. The pattern of the collar 94 is restricted only by fashion and the minimum amount of the material of the collar 94 that is necessary to complete the remaining steps or operations of the process of manufacture.

The collar seam 112 of the present invention may take on a variety of structures or configurations known in the art. One embodiment of the collar seam 112 is an out-turned configuration as illustrated in FIG. 12. Such a configured collar seam 112 is formed by securing together at least a portion of the out-turned portions of the collar edge 111 of the collar 94 and the edge 92 of the neck opening 90 of the garment 10. The inner surface 11 of the collar edge 111 of the collar 94 is brought into contact with the inner surface 11 of the edge 92 of the neck opening 90.

Another embodiment of the collar seam 112 is an in-turned configuration as illustrated in FIG. 13. Such a configured collar seam 112 is formed by securing together at least a portion of the in-turned portions of the collar edge 111 of the collar 94 and the edge 92 of the neck opening 90 of the garment 10. The outer surface 13 of the collar edge 111 of the collar 94 is brought into contact with the outer surface 13 of the edge 92 of the neck opening 90.

Another embodiment of the collar seam 112 is an over-lapped configuration as illustrated in FIG. 11. Such a configured collar seam 112 is formed by securing together at least a portion of the over-lapped portions of the collar edge 111 of the collar 94 and the edge 92 of the neck opening 90 of the garment 10. The inner surface 11 of the collar edge 111 of the collar 94 or the edge 92 of the neck opening 90 is brought into contact with the outer surface 13 of the other, the collar edge 111 or the edge 92.

Another embodiment of the collar seam 112 is an over-lapped configuration as illustrated in FIG. 14. Such a configured collar seam 112 is formed by folding back the collar edge 111 of the collar 94 or the edge 92 of the neck opening 90. The outer surface 13 of the folded portions and the inner surface 11 of the unfolded portions of the collar edge 111 of the collar 94 or the edge 92 of the neck opening 90 and the corresponding portions of the collar 94 or the front and back panels 20 and 30 are brought into contact with the inner surface 11 or the outer surface 13 of the unfolded collar edge 111 of the collar 94 or the edge 92 of the neck opening 90 and the corresponding portions of the collar 94 or the front and back panels 20 and 30. It is understood that the folding back of the collar edge 111 of the collar 94 or the edge 92 of the neck opening 90 could be performed such that the inner surface 11 would be exposed along the fold.

Figure 15:
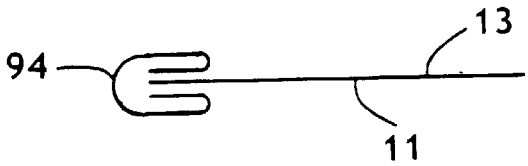
FIG. 15 is a cross sectional view of a seam.

Another embodiment of the collar seam 112 is an over-lapped configuration as illustrated in FIG. 15. Such a configured collar seam 112 is formed by folding the collar 94 about or over the edge 92 of the neck opening 90. The collar edges 111 of the collar 94 may be folded under bringing the outer surface 13 of the collar 94 into contact with the edge 92 of the neck opening and any portion of the adjacent material of the front panel 20, the back panel 30, or both as desired. The collar edges 111 may be left exposed by not being folding under.

Figure 16:
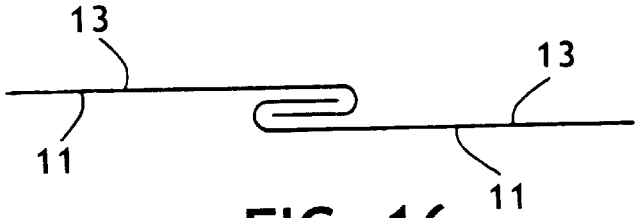
FIG. 16 is a cross sectional view of a seam.

Another embodiment of the collar seam 112 is an over-lapped configuration as illustrated in FIG. 16. Such a configured collar seam 112 is formed by folding the collar edge 111 such that the inner surface 11 of the collar 94 is brought into contact with itself. The edge 92 of the neck opening 90 is folded such that the outer surface 13 of the front panel 20, the back panel 30, or both are brought into contact with itself. The collar edge 111 is inserted into the fold of the edge 92 of the neck opening 90. The edge 92 of the neck opening 90 is inserted into the fold of the collar edge 111. In another embodiment, the collar edge 111 is folded such that the outer surface 13 of the collar 94 is brought into contact with itself. The edge 92 of the neck opening 90 is folded such that the inner surface 11 of the front panel 20, the back panel 30, or both are brought into contact with itself. This configured collar seam 112 may be used with any seam describe herein.

The materials used for the collar 94 may be the same as the materials used for the other portions of the garment 10. In some embodiments, it is desirable that the materials used for the collar 94 have an elastic element such that the collar 94 will conform to the portion of the wearer's neck that comes into contact with the collar 94.

In various embodiments of the present invention, the front panel 20, the back panel 30, or both panels 20 and 30 may be cut or otherwise opened to form a slit 45 or 65 (shown in FIG. 3) such as a placket. The slit 45 has two edges 57 and 61. The slit 65 has two edges 66 and 67. The slits 45 and 65 of the front and back panels 20 and 30, respectively, may extend from the edge 92 of the neck opening 90 to the garment bottom edges 26 and 36, respectively. In the alternative, the slits 45 and 65 may extend over only a portion of the panels 20 and 30 between the edge 92 of the neck opening 90 to the garment bottom edges 26 and 36, respectively. When the garment 10 comprises both a slit 45 in the front panel 20 and a slit 65 in the back panel 30, the slits 45 and 65 may be similar or dissimilar in size, structure, shape, and the like.

In some embodiments, the edges 57 and 61 of the slit 45 and the edges 66 and 67 of the slit 65 may be refastenably attached or secured to each other. The edges 57 and 61 may be secured together to form the front seam 113. The edges 66 and 67 may be secured together to form the back seam 114. Various fastening means, such as adhesive and mechanical type fasteners 95, see the discussion above, may be used to refastenably attach or secure the edges 57 and 61 or the edges 66 and 67 together of the slits 45 and 65, respectively.

Another embodiment of the present invention is a continuous process for the manufacture of a garment 210 (see FIGS. 2 and 4) for wearing about the upper body comprising a garment 210 having at least a front panel 250, a back panel 260, a neck opening 290 defined about its perimeter by edge 292, arm openings 272 and 274 defined about their perimeters by arm opening edges 273 and 275, respectively, and a lower body opening 244 defined about its perimeter by garment bottom edges 259 and 268. The garment 210 comprises an inner surface 211 and an outer surface 213. The garment 210 may comprise single layer webs of fabric 215 and 216, multi-layer laminate webs of fabric 215 and 216, or a combination of a single layer web of fabric and a multi-layer laminate web of fabric 215 and 216. In some embodiments, the garment 210 may comprise multiple layers of the webs of fabric 215 and 216 or various combinations of fabric.

In one embodiment of the present invention (See FIG. 2), two webs of fabric 215 and 216 of sufficient width of fabric to make the garment 210 is provided to produce the garments 210. The desired webs of fabric 215 and 216 are nonwoven although any disposable or washable fabric can be used. (See the discussion below). The webs of fabric 215 and 216 are typically unwound from rolls or other sources (not shown).

The webs of fabric 215 and 216 are desirably compliant and soft feeling to the wearer. The following description of materials from which the webs of fabric 215 and 216 may be formed would also be used for the materials to form the inner surface 211 and the outer surface 213 of multi-layer laminate webs of fabric 215 or 216.

The webs of fabric 215 and 216 may be any suitable material, such as a woven material, a nonwoven material, a fibrous or a polymeric film material and may be, although they need not necessarily be, an elastic material or of a stretchable nature. Suitable fibrous webs may utilize any suitable natural and/or synthetic fibers, for example, woven or nonwoven webs of fibers made of acrylic polymers, polyester, polyamide, glass, polyolefins, e.g., polyethylene and polypropylene, cellulosic derivatives such as rayon, cotton, silk, wool, pulp, paper and the like, as well as blends or combinations of any two or more of the foregoing. The webs of fabric 215 and 216 may also comprise polymeric film layers such as polyethylene, polypropylene, polyamide, polyester, acrylic polymers, and compatible mixtures, blends and copolymers thereof.

The webs of fabric 215 or 216 may be liquid pervious, permitting liquids to readily penetrate into its thickness, or impervious, resistant to the penetration of liquids into its thickness. The webs of fabric 215 and 216 may be made from a wide range of materials, such as natural fibers (e.g. rayon, wood, or cotton fibers), synthetic fibers (e.g. polyester or polypropylene fibers), or from a combination of natural and synthetic fibers or reticulated foams and apertured plastic films. The webs of fabric 215 and 216 may be woven, nonwoven, or film such as spunbonded, carded, or the like. The suitable webs of fabric 215 and 216 may be carded, and thermally bonded by means well known to those skilled in the fabric art.

Alternatively, the webs of fabric 215 and 216 may be derived from a spunbonded web. In a desired embodiment, the webs of fabric 215 and 216 are spunbonded polypropylene nonwoven, meltblown polypropylene nonwoven and spunbonded polypropylene nonwoven laminate (SMS). The total basis weight is from about 0.4 to about 1.0 osy (more desirably 0.6 osy) and is made with about 86% spunbonded nonwoven and 14% meltblown nonwoven. A pigment such as titanium dioxide may be incorporated into the webs of fabric 215 and 216. Such a spunbonded meltblown nonwoven laminate material is available from Kimberly-Clark Corporation, Roswell, Ga. The basis weight of the SMS material may vary from about 0.4 to about 1.0 osy.

In other desired embodiments, the webs of fabric 215 and 216 are spunbonded polypropylene nonwoven with a wire-weave bond pattern having a grab tensile of 19 pounds as measured by ASTM D1682 and D1776, a Taber 40 cycle abrasion rating of 3.0 as measured by ASTM D1175 and Handle-O-Meter MD value of 6.6 grams and CD value of 4.4 grams using TAPPI method T402. Such a spunbonded material is available from Kimberly-Clark Corporation, Roswell, Ga. The webs of fabric 215 and 216 have a weight of from about 0.5 oz. per square yard (osy) to about 1.5 osy, desirably about 0.7 osy.

The webs of fabric 215 and 216 may be constructed of a single spunbonded polypropylene nonwoven web having a basis weight of about 0.5 oz/yd$^2$ (17 gsm) to about 1.5 oz/yd$^2$ (51 gsm). In the structure of the garment 210, the webs of fabric 215 and 216 desirably comprise a material having a basis weight of from about 0.5 oz/yd$^2$ (17 gsm) to about 1.5 oz/yd$^2$ (51 gsm). Lesser or greater basis weights may be used in the other regions of the garment 210, such as the sleeves 276 and 278, the cuffs 285 and 287, and the collar 294. Since the garment 210 is typically intended for active wear, the webs of fabric 215 and 216 or portions thereof, can be made of materials having a basis weight that is abrasion resistant.

The webs of fabric 215 and 216 may be any soft and flexible sheet. The webs of fabric 215 and 216 may permit submersion in fresh water or salt water or treated water (chlorinated or brominated) and still retain its integrity. The webs of fabric 215 and 216 may comprise, for example, a nonwoven web or sheet of a spunbonded, meltblown, or bonded-carded web composed of synthetic polymer filaments, such as polypropylene, polyethylene, polyesters or the like, or a web of natural polymer filaments such as rayon or cotton. The webs of fabric 215 and 216 may be selectively embossed or perforated with discrete slits or holes extending therethrough.

The webs of fabric 215 and 216 may be further dyed, pigmented, or imprinted with any suitable color. Desirably, the webs of fabric 215 and 216 are dyed, pigmented, or printed with a material which does not irritate or bleed the color onto the skin of the wearer.

The webs of fabric 215 and 216 may be made of the same material or may be made of different materials. In addition, the webs of fabric 215 and 216 may be both made of single layered materials, both multi-layered materials, or one of single layered materials and the other of multi-layered materials.

For embodiments wherein the webs of fabric 215 and 216 are a multi-layer laminate, both the outer surface 213 and the inner surface 211 are desirably compliant and soft feeling to the wearer. The following description of materials from which the outer surface 213 may be formed may also be used to form the material of the inner surface 211.

The outer surface 213 may be any suitable gatherable material, such as a woven material, a nonwoven material, a fibrous or a polymeric film material and may be, although it need not necessarily be, an elastic material or of a stretchable nature. Suitable fibrous gatherable webs may utilize any suitable natural and/or synthetic fibers, for example, woven or nonwoven webs of fibers made of acrylic polymers, polyester, polyamide, glass, polyolefins, e.g., polyethylene and polypropylene, cellulosic derivatives such as rayon, cotton, silk, wool, pulp, paper and the like, as well as blends or combinations of any two or more of the foregoing. The gatherable webs may also comprise polymeric film layers such as polyethylene, polypropylene, polyamide, polyester, acrylic polymers, and compatible mixtures, blends and copolymers thereof.

The outer surface 213 may be liquid pervious, permitting liquids to readily penetrate into its thickness, or impervious, resistant to the penetration of liquids into its thickness. The outer surface 213 may be made from a wide range of materials, such as natural fibers (e.g. rayon, wood, or cotton fibers), synthetic fibers (e.g. polyester or polypropylene fibers), or from a combination of natural and synthetic fibers or reticulated foams and apertured plastic films. The outer surface 213 may be woven, nonwoven, or film such as spunbonded, carded, or the like. A suitable material for the outer surface 213 may be carded and thermally bonded by means well known to those skilled in the fabric art.

Alternatively, the outer surface 213 may be derived from a spunbonded web. In a desired embodiment, the outer surface 213 is spunbonded polypropylene nonwoven, meltblown polypropylene nonwoven and spunbonded polypropylene nonwoven laminate (SMS). The total basis weight is from about 0.4 to about 1.0 osy (more desirably 0.6 osy) and is made with about 86% spunbonded nonwoven and 14% meltblown nonwoven. A pigment such as titanium dioxide may be incorporated into the outer surface 213 and the inner surface 211. Such spunbonded meltblown nonwoven laminate material is available from Kimberly-Clark Corporation, Roswell, Ga. The basis weight of the SMS material may vary from about 0.4 to about 1.0 osy.

In other desired embodiments, the outer surface 213 is spunbonded polypropylene nonwoven with a wire-weave bond pattern having a grab tensile of 19 pounds as measured by ASTM D1682 and D1776, a Taber 40 cycle abrasion rating of 3.0 as measured by ASTM D1175 and Handle-O-Meter MD value of 6.6 grams and CD value of 4.4 grams using TAPPI method T402. Such spunbonded material is available from Kimberly-Clark Corporation, Roswell, Ga. The outer surface 213 has a weight of from about 0.5 oz. per square yard (osy) to about 1.5 osy, desirably about 0.7 osy.

The outer surface 213 may be constructed of a single spunbonded polypropylene nonwoven web having a basis weight of about 0.5 oz/yd$^2$ (17 gsm) to about 1.5 oz/yd$^2$ (51 gsm). In the structure of the garment 210, the outer surface 213 desirably comprises a material having a basis weight of from about 0.5 oz/yd$^2$ (17 gsm) to about 1.5 oz/yd$^2$ (51 gsm). Lesser or greater basis weights may be used in the other regions of the garment 210. Since the garment 210 is typically intended for active wear, the outer surface 213 or portions thereof, can be made of materials having a basis weight which is abrasion resistant.

The inner surface 211 may be any soft and flexible sheet. The inner surface 211 may permit submersion in fresh water or salt water or treated water (chlorinated or brominated) and still retain its integrity. The inner surface 211 may comprise, for example, a nonwoven web or sheet of a spunbonded, meltblown, or bonded-carded web composed of synthetic polymer filaments, such as polypropylene, polyethylene, polyesters, or the like, or a web of natural polymer filaments such as rayon or cotton. The inner surface 211 may be selectively embossed or perforated with discrete slits or holes extending therethrough. Suitable adhesives for adhering the laminate layers can be obtained from Findley Adhesives, Inc. of Wauwatosa, Wis.

The outer surface 213 and the inner surface 211 may be further dyed, pigmented, or imprinted with any suitable color. Desirably, the inner surface 211 is either dyed, pigmented, or printed with a material which does not irritate or bleed the color onto the skin of the wearer.

One type of embodiments of the present invention is a continuous process for the manufacture of a garment 210 (see FIGS. 2 and 4) for wearing about the upper body comprising at least a front panel 250, a back panel 260, a neck opening 290 defined about its perimeter by edge 292, sleeve flaps 299 and 300, and a lower body opening 244 defined about its perimeter by garment end portions 266 and 267. The garment 210 comprises an inner surface 211 and an outer surface 213. The garment 210 may comprise single layer webs of fabric 215 and 216 or may comprise multi-layer laminate webs of fabric 215 and 216. The materials comprising the webs of fabric 215 and 216 have been discussed above. In some embodiments, the garment 210 may comprise multiple layers of webs of fabric 215 and 216.

The webs of fabric 215 and 216 of sufficient width of fabric to make the garment 210 are provided to produce the garments 210. The desired webs of fabric 215 and 216 are nonwoven although any disposable or washable fabric can be used. (See the discussion above). The webs of fabric 215 and 216 are typically unwound from rolls or other sources. (Not shown).

The web of fabric 215 includes a pair of opposing web side edges 246 and 247. A repeating series of opposing indentations 269 and 271 is cut by the die cutter 214 into the web side edge 246 of the web of fabric 215. (See FIG. 2). The location of the opposing indentations 269 and 271 corresponds to the garment side edges 222 and 232, respectively, of the finished garment 210. The opposing indentations 269 and 271 may be produced by a die cut operation, an ultrasonic operation, or any other suitable method of operation. The material to be removed from the opposing indentations 269 and 271 may be removed by any method known in the art, desirably a vacuum source (not shown).

Figure 2:
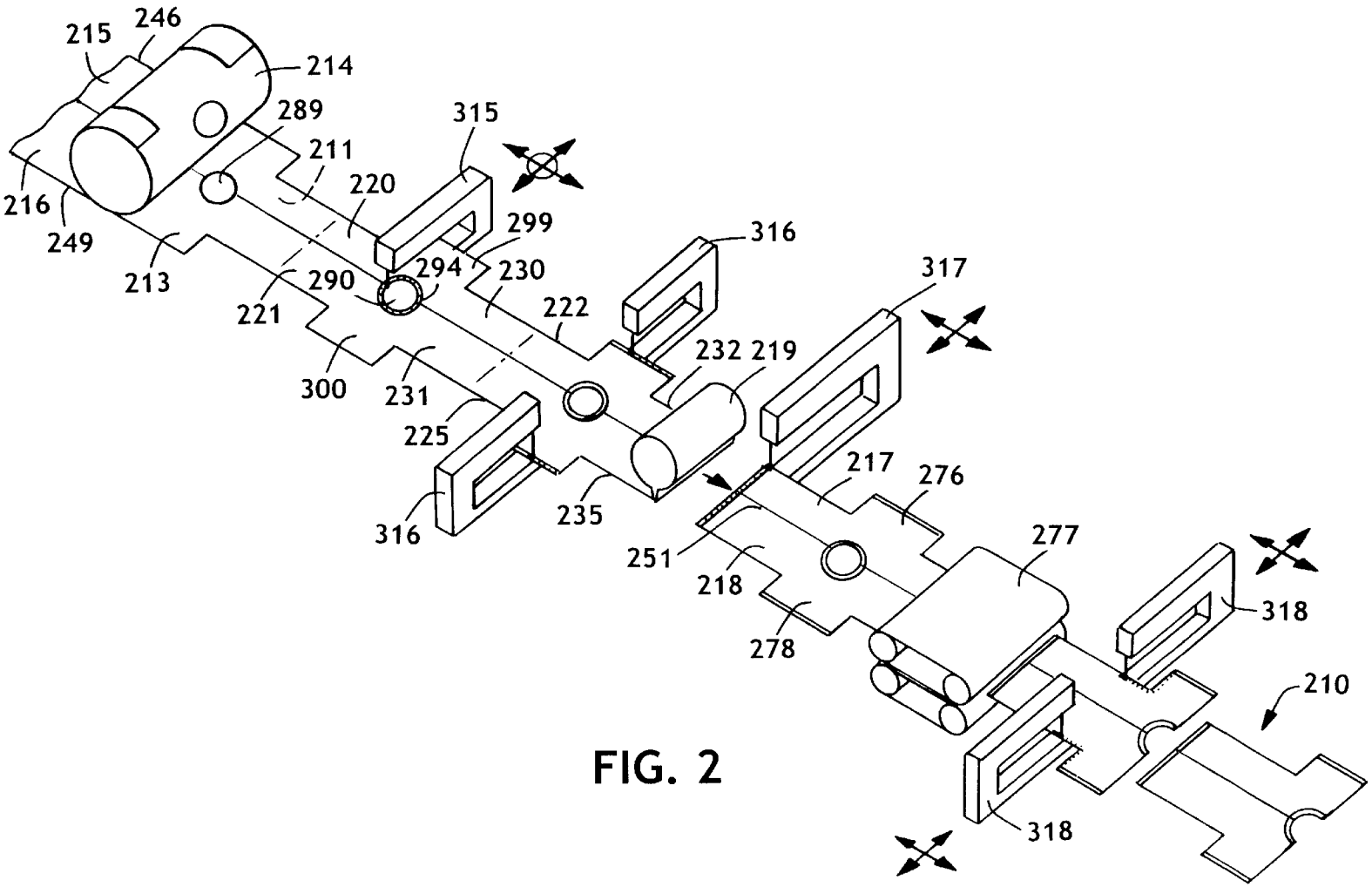
FIG. 2 is a diagram of another embodiment of the present invention.

The web of fabric 216 includes a pair of opposing web side edges 248 and 249. A repeating series of opposing indentations 269 and 271 is cut by the die cutter 214 into the web side edge 249 of the web of fabric 216. (See FIG. 2). The location of the opposing indentations 269 and 271 corresponds to the garment side edges 225 and 235 of the finished garment 210. The opposing indentations 269 and 271 may be produced by a die cut operation, an ultrasonic operation, or any other suitable method of operation. It is understood that while FIG. 2 shows the die cutter 214 cutting the opposing indentations 269 and 271 into the webs of fabric 215 and 216 (or, alternatively, the web of fabric 215), these operations could be performed by separate devices and at different stages within the manufacturing process.

The opposing indentations 269 and 271 may take on a variety of sizes and shapes, such as a slit, circular, oval, triangular, square, rectangular, multi-faceted, asymmetric or irregular, or the like. The pattern of the opposing indentations 269 and 271 is restricted only by fashion and the minimum amount of the webs of fabric 215 and 216 that must remain having a sufficient integrity to withstand the remaining steps or operations of the process of manufacture. The indentations 271 may be similar or dissimilar in shape, structure, size, and the like from each other or from the indentations 269 within the finished garment 210. Alternatively, the garment side edges 222 and 232 and the garment side edges 225 and 235 may be similar or dissimilar from each other.

Figure 19:
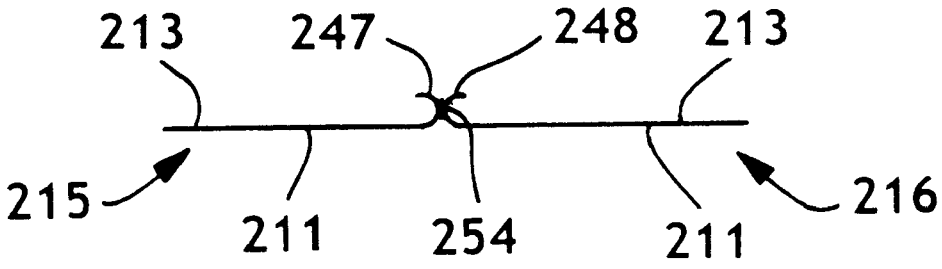
FIG. 19 is a cross sectional view of the side by side orientation of the webs of fabric.

In one embodiment of the present invention (see FIG. 2), the two webs of fabric 215 and 216 of sufficient width of fabric to make the garment 210 are combined to produce the garments 210. The desired fabric is nonwoven although any disposable or washable fabric can be used. The two webs of fabric 215 and 216 are unwound from rolls (not shown) and brought together in a side by side orientation (see FIG. 19) and fastened together at the web side edge 247 of the web of fabric 215 and the web side edge 248 of the web of fabric 216, defining a center seam 251 on the composite web of fabric 253. In some embodiments, portions of the center seam 251 may be left unfastened by intermittently fastening the web side edges 247 and 248 of the webs of fabric 215 and 216, respectively. In other embodiments, the center seam 251 may be constructed on a continuous basis. The desired method of fastening is ultrasonic sealing, although other methods of fastening, such as heat sealing, adhesives, tape, sewing, or any other method of fastening known in the art can be used.

Figure 18:
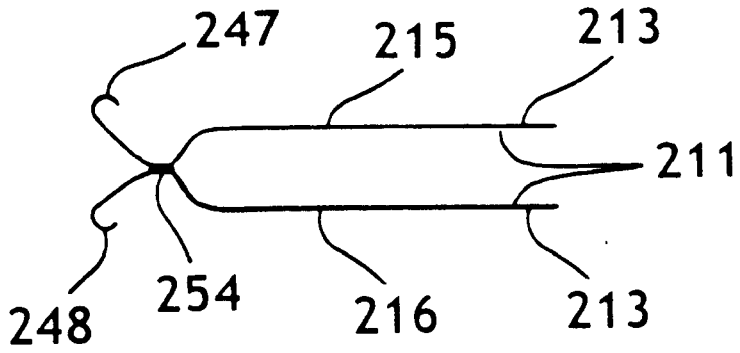
FIG. 18 is a cross sectional view of the face to face orientation of the webs of fabric.

In another type of embodiment, the two webs of fabric 215 and 216 to make the garment 210 are combined to produce the garments 210. The two webs of fabric 215 and 216 are unwound from rolls and brought together in a face to face (or, alternatively, back to back) orientation and fastened together at the web side edge 247 of the web of fabric 215 and the web side edge 248 of the web of fabric 216, defining the center seam 251 of the composite web of fabric 253. (See FIG. 18).

The center seam 251, or portions thereof, can be constructed as a non-refastenable seam, as a refastenable seam, or as a combination of a non-refastenable seam and a refastenable seam. Any excess material from the webs of fabric 215 and 216 may be removed from the web side edges 247 and 248 (or, alternatively, the side edges 223, 224, 233, and 234) of the center seam 251 to reduce and smooth out the center seam 251. The non-refastenable center seam 251 may be formed by any suitable means such as ultrasonic sealing, adhesive bonding, tape, heat sealing, sewing, or the like known in the art. The non-refastenable center seam 251 may be constructed on a continuous or intermittent basis. One suitable method of forming such a center seam 251 is disclosed in U.S. Pat. No. 4,938,753 issued Jul. 3, 1990, to Van Gompel et al., which is incorporated herein by reference. The center seam 251 may be bonded together to form a non-refastenable center seam 251. See the discussion above for center seams 252 and 256.

In other embodiments of the present invention, the web side edges 247 and 248 (or, alternatively, the side edges 223 and 224 and the side edges 233 and 234) of the webs of fabric 215 and 216, respectively, may be held together in the finished garment 210 to form the refastenable center seam 251. The refastenable means for securing the web side edges 247 and 248 of the webs of fabric 215 and 216 include refastenable adhesive and mechanical type fasteners 295. The adhesive and mechanical type fasteners 295 include buttons and button holes, snaps, buckles, clasps, hooks and loops, end extensions, tabs, tape, and the like which are designed or adapted to interlock or engage some type of a complementary device or the outer surface 213 or the inner surface 211 of the garment 210. The refastenable center seams 251 may be constructed on a continuous or intermittent basis.

In addition, elasticized fasteners 295 may also be used in assuring better fit of the garment 210. If the garment 210 includes a refastenable center seam 251, the refastenable means is desirably strategically placed on the webs of fabric 215 and 216 before the webs of fabric 215 and 216 are cut into garment-sized pieces 217 and 218. The folding and redirection operations may be eliminated when a refastenable center seam 251 is included in the garment 210. However, there may be packaging reasons for which one would still carry out these two steps.

Figure 21:
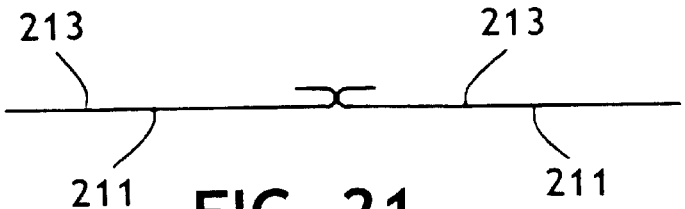
FIG. 21 is a cross sectional view of a seam.

The center seam 251 of the present invention may take on a variety of structures or configurations known in the art. One embodiment of the center seam 251 is an out-turned configuration as illustrated in FIG. 21. Such a configured center seam 251 is formed by securing together at least a portion of the out-turned portions of the web side edges 247 and 248. The inner surface 211 of the web side edges 247 and 248 of the webs of fabric 215 and 216, respectively, are brought into contact with each other.

Figure 22:
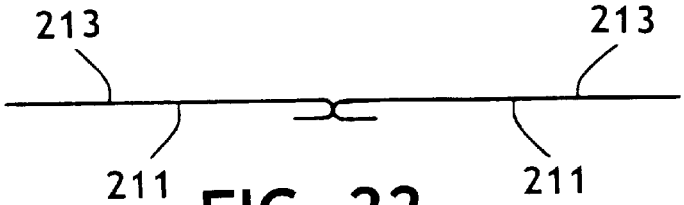
FIG. 22 is a cross sectional view of a seam.

Another embodiment of the center seam 251 is an in-turned configuration as illustrated in FIG. 22. Such a configured center seam 251 is formed by securing together at least a portion of the in-turned portions of the web side edges 247 and 248. The outer surfaces 213 of the web side edges 247 and 248 of the webs of fabric 215 and 216, respectively, are brought into contact with each other.

Figure 20:
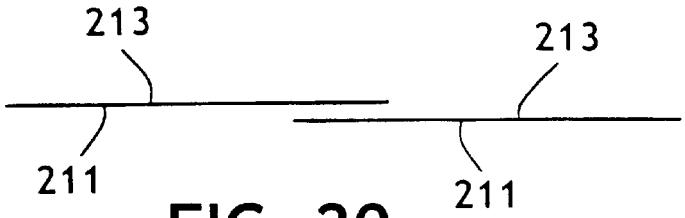
FIG. 20 is a cross sectional view of a seam.

Another embodiment of the center seam 251 is an over-lapped configuration as illustrated in FIG. 20. Such a configured center seam 251 is formed by securing together at least a portion of the over-lapped portions of the web side edges 247 and 248. The inner surface 211 of one of the web side edges 247 and 248 of the webs of fabric 215 and 216, respectively, is brought into contact with the outer surface 213 of the other web side edge 247 or 248, respectively.

Figure 23:
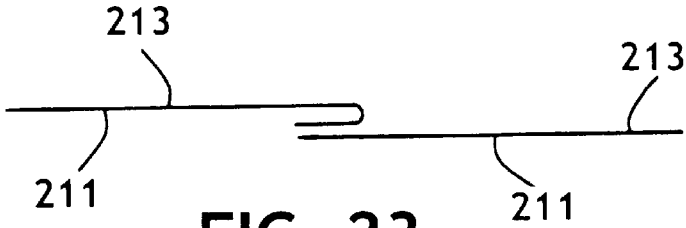
FIG. 23 is a cross sectional view of a seam.

Another embodiment of the center seam 251 is an over-lapped configuration as illustrated in FIG. 23. Such a configured center seam 251 is formed by folding back the web side edge 247 (or, alternatively, the web side edge 248). The outer surface 213 of the folded portion and the inner surface of the unfolded portion of the web side edge 247 and the corresponding portions of the web of fabric 215 (or, alternatively, of the web side edge 248 and the corresponding portions of the web of fabric 216) are brought into contact with the inner surface 211 or the outer surface 213 of the web side edge 248 and the corresponding portions of the web of fabric 216 (or, alternatively, of the web side edge 247 and the corresponding portions of the web of fabric 215). It is understood that the folding back of a web side edge 247 or 248 could be performed such that the inner surface 211 would be exposed along the fold.

The opposing indentations 269 and 271 of the web side edges 246 and 249 of the webs of fabric 215 and 216, respectively, may be cut by the die cutter 214 into the web side edges 246 and 249 before or after the two webs of fabric 215 and 216 are fastened together to form the composite web of fabric 253. The material to be removed from the opposing indentations 269 and 271 may be removed by any method known in the art, desirably a vacuum source (not shown). As the pattern of the garment 210 is restricted only by fashion and the minimum amount of the webs of fabric 215 and 216 (or, alternatively, the composite web of fabric 253) that must remain having a sufficient integrity to withstand the operations or steps of the process of manufacture, one can simply design the garment 210 such that this operation of cutting the opposing indentations 269 and 271 into the webs of fabric 215 and 216 (or, alternatively, the composite web of fabric 253) is not required. In some embodiments, the operation of cutting the opposing indentations 269 and 271 into the web side edges 246 and 249 of the webs of fabric 215 and 216, respectively, may be eliminated. The arm openings 272 and 274 may be created by leaving a portion of the garment side edges 222 and 232 and a portion of the garment side edges 225 and 235, respectively, unattached.

When the webs of fabric 215 and 216 are combined to form the composite web of fabric 253, the opposing indentations 269 and 271 are typically positioned or arranged such that the opposing indentations 269 and 271 form a repeating series of pairs of opposing indentations 269 and 271 in the web side edges 246 and 249. However, such a placement or arrangement is not required in the present invention. The placement of the opposing indentations 269 and 271 in relation to each other, while in a typical garment 210, the opposing indentations 269 and 271 are located to be directly opposing, is restricted only by fashion and the minimum amount of the webs of fabric 215 and 216 (or, alternatively, the composite web of fabric 253) that must remain having sufficient integrity to withstand the remaining steps or operations of the process of manufacture. The opposing indentations 269 and 271 may be similar or dissimilar in shape, structure, size, and the like from each other within the finished garment 210.

A repeating series of openings 289 are cut by the die cutter 214 into at least one of the webs of fabric 215 and 216 (or, alternatively, the composite web of fabric 253). It is understood that while FIG. 2 shows the die cutter 214 cutting the opening 289 and the opposing indentations 269 and 271, these cutting operations could be performed by separate devices and at different stages within the manufacturing process. The location of the opening 289 corresponds to the neck opening 290 in the finished garment 210. The openings 289 may be produced by a die cut operation, an ultrasonic operation, or any other suitable method of operation. The openings 289 may be cut into at least one of the webs of fabric 215 and 216 before or after the webs of fabric 215 and 216 are combined to form the composite web of fabric 253.

The opening 289 may take on a variety of sizes and shapes, such as slit, circular, oval, triangular, square, rectangular, multi-faceted, asymmetric or irregular, or the like.

The material to be removed from the openings 289 may be removed by any method known in the art, desirably a vacuum source. The pattern of the opening 289 is restricted only by fashion and the minimum amount of the webs of fabric 215 and 216 (or, alternatively, the composite web of fabric 253) that must remain having a sufficient integrity to withstand the remaining steps or operations of the process of manufacture.

Figure 17:
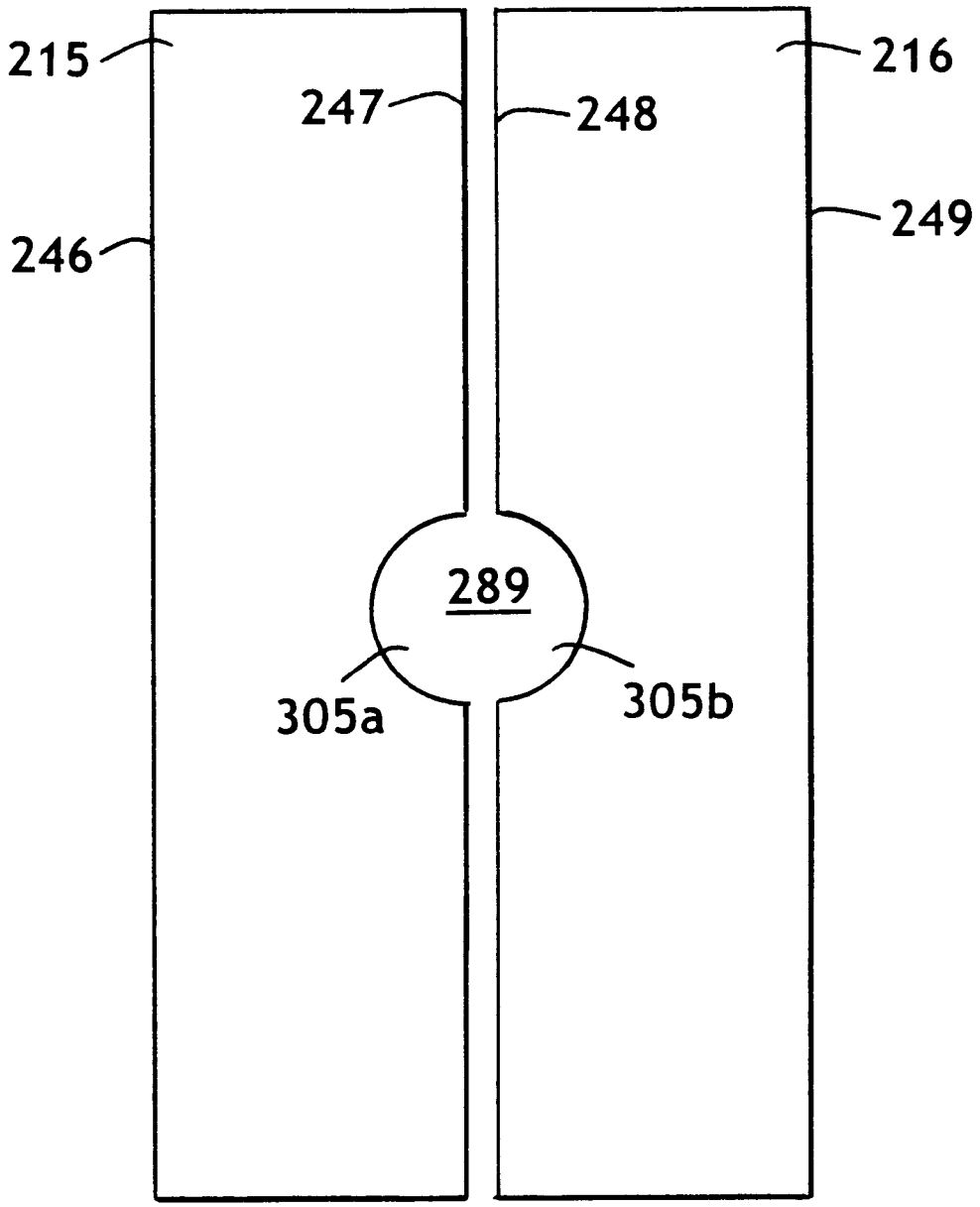
FIG. 17 is a top plan view of a garment made by the present invention in a pre-assembled flat configuration.

In alternative embodiments of the present invention, the openings 289 may be comprised of the indentations 305*a* cut into the web side edge 247 of the web of fabric 215 and the indentations 305*b* cut into the web side edge 248 of the web of fabric 216 prior to the combining of the webs of fabric 215 and 216 to form the composite web of fabric 253. (See FIG. 17). An indentation 305*a* and an indentation 305*b* are combined to form the opening 289.

The placement of the opening 289 in relation to two pairs of opposing indentations 269 and 271, while in a typical garment 210, the opening 289 is centrally located between the two pairs of opposing indentations 269 and 271, is restricted only by fashion and the minimum amount of the webs of fabric 215 and 216 (or, alternatively, the composite web of fabric 253) that must remain having sufficient integrity to withstand the remaining steps or operations of the process of manufacture. For example, the placement of the opening 289 between the two pairs of opposing indentations 269 and 271 may be symmetrically or asymmetrically located.

The composite web fabric 253 is cut by the die cutter 219 into discrete garment-sized pieces 255 wherein each discrete garment-sized piece 255 contains at least one opening 289, two pairs of opposing indentations 269 and 271, one pair of opposing web side edges 246 and 249, one pair of opposing garment bottom edges 259 and 268, and opposing garment end portions 266 and 267. The location of the opposing web side edges 246 and 249 of the composite web of fabric 253 corresponds to a sleeve opening end edge 284 of a sleeve flap 299 proximate the garment side edge 222 of the right front panel 220 (or, alternatively, the front panel 250) and the garment side edge 232 of the right back panel 230 (or, alternatively, the back panel 260), and a sleeve opening end edge 286 of a sleeve flap 300 proximate the garment side edge 225 of the left front panel 221 (or, alternatively, the front panel 250) and the garment side edge 235 of the left back panel 231 (or, alternatively, the back panel 260), respectively, in the finished garment 210. It is understood that while the opposing web side edges 246 and 247 of the web of fabric 215 (or, alternatively, the composite web of fabric 253 or the discrete garment-sized piece 255) may typically become the sleeve opening end edges 284 and 286 in the finished garment 210, fabric may be removed from or added to the web side edges 246 and 247 to create the sleeve opening end edges 284 and 286 in the finished garment 210.

The opposing garment end portions 266 and 267 are adjacent to the garment bottom edge 259 of the front panel 250 and the garment bottom edge 268 of the back panel 260, respectively, in the finished garment 210. The location of the opposing piece side edges 279 and 280 of the discrete garment-sized piece 255 corresponds to the garment bottom edge 259 of the front panel 250 and the garment bottom edge 268 of the back panel 260, respectively, in the finished garment 210. It is understood that while the opposing piece side edges 279 and 280 of the discrete garment-sized piece 255 may typically become the garment bottom edges 259 and 268 in the finished garment 210, fabric may be removed from or added to the piece side edges 279 and 280 to create the garment bottom edges 259 and 268 in the finished garment 210.

Each discrete garment-sized piece 255 of the composite web of fabric 253 is transported typically by vacuum screens, belts, or conveyors, through hemming, folding, and fastening operations (not shown). The folding operations are desirably carried out by tuckers and folders, as well as any other known means. The discrete garment-sized piece 255 of the composite web of fabric 253 is folded by a folder 277 so as to bring together the opposing garment end portions 266 and 267 such that the web side edge 246 of the composite web of fabric 253 is folded onto itself, bringing the garment side edge 222 of the front panel 250 and the garment side edge 232 of the back panel 260 together. The web side edge 249 of the composite web of fabric 253 is folded onto itself, bringing the garment side edge 225 of the front panel 250 and the garment side edge 235 of the back panel 260 together.

In other embodiments, the webs of fabric 215 and 216 may be cut into garment-sized pieces 217 and 218, respectively, before the webs of fabric 215 and 216 are combined to form the composite web of fabric 253. The garment-sized pieces 217 and 218 of the webs of fabric 215 and 216 are fastened together to form the discrete garment-sized piece 255 of the composite web of fabric 253. The garment-sized pieces 217 and 218 are combined to form the discrete garment-sized piece 255 such that each discrete garment-sized piece 255 contains at least an opening 289, two pairs of opposing indentations 269 and 271, one pair of opposing web side edges 246 and 249, and opposing garment end portions 266 and 267, as described above.

The garment-sized pieces 217 and 218 of the webs of fabric 215 and 216 may be folded before or after the garment-sized pieces 217 and 218 are fastened together to form the discrete garment-sized piece 255 of the composite web of fabric 253. The folding operations are desirably carried out by tuckers and folders, as well as any other known means. The garment-sized piece 217 is folded by the folder 277 so as to bring together the opposing garment end portions 262 and 264 such that the garment-sized piece 217 is folded onto itself, bringing a right front panel 220 and a right back panel 230 together. The web side edge 246 folds onto itself, bringing the garment side edge 222 of the right front panel 220 and the garment side edge 232 of the right back panel 230 together. The web side edge 247 folds onto itself, forming the side edge 224 of the right front panel 220 and the side edge 234 of the right back panel 230. The garment-sized piece 217 contains at least one pair of opposing indentations 269 and 271, the web side edge 246, and the opposing garment end portions 262 and 264.

The garment-sized piece 218 is folded by the folder 277 so as to bring together the opposing garment end portions 263 and 265 such that the garment-sized piece 218 is folded onto itself forming a left front panel 221 and a left back panel 231. The web side edge 248 folds onto itself, forming the side edge 223 of the left front panel 221 and the side edge 233 of the left back panel 231. The web side edge 249 folds onto itself, bringing the garment side edge 225 of the left front panel 221 and the garment side edge 235 of the left back panel 231 together. The garment-sized piece 218 contains at least one pair of opposing indentations 269 and 271, the web side edge 247, and the opposing garment end portions 263 and 265. It is understood that the folding operations on the garment-sized pieces 217 and 218, while shown in FIG. 2 to be carried out simultaneously by one folder 277, these folding operations could be performed by separate devices and at different stages within the manufacturing process.

The side edges 224 and 223 of the right and left front panels 220 and 221, respectively, are fastened together to form a portion of the center seam 251 and the front panel 250. The side edges 234 and 233 of the right and left back panels 230 and 231, respectively, are fastened together to form a portion of the center seam 251 and the back panel 260.

The center seam 251, or portions thereof, can be constructed as a non-refastenable seam, as a refastenable seam, or as a combination of a non-refastenable seam and a refastenable seam. Any excess material from the webs of fabric 215 and 216 may be removed from the side edges 223, 224, 233, and 234 of the center seam 251 to reduce and smooth out the center seam 251. The non-refastenable center seam 251 may be formed by any suitable means such as ultrasonic sealing, adhesive bonding, tape, heat sealing, sewing, or any method known in the art. The non-refastenable center seam 251 may be constructed on a continuous or intermittent basis. See the discussion above for center seams 252 and 256.

In other embodiments of the present invention, the side edges 223, 224, 233, and 234 of the garment 210 may be held together in the finished garment 210 to form the refastenable center seam 251. The refastenable means for securing the side edges 223, 224, 233, and 234 of the garment 210 include refastenable adhesive and mechanical type fasteners 295. The adhesive and mechanical type fasteners 295 include buttons and button holes, snaps, buckles, clasps, hooks and loops, end extensions, tabs, tape, and the like which are designed or adapted to interlock or engage some type of a complementary device or the outer surface 213 or the inner surface 211 of the garment 210. A refastenable center seam 251 may be constructed on a continuous or intermittent basis.

In addition, elasticized fasteners 295 may also be used in assuring better fit of the garment 210. If the garment 210 includes a refastenable center seam 251, the refastenable means are desirably strategically placed on the webs of fabric 215 and 216 before the webs of fabric 215 and 216 are cut into garment-sized pieces 217 and 218. The folding and redirection operations may be eliminated when a refastenable center seam 251 is included in the garment 210. However, there may be packaging reasons for which one would still carry out these two steps.

The center seam 251 of the present invention may take on a variety of structures or configurations known in the art. One embodiment of the center seam 251 is an out-turned configuration as illustrated in FIG. 21. Such a configured center seam 251 is formed by securing together at least a portion of the out-turned portions of the side edges 223 and 224 and the side edges 233 and 234, respectively. The inner surface 211 of the right and left front panels 220 and 221 and inner surface 211 of the right and left back panels 230 and 231, respectively, are brought into contact with each other.

Another embodiment of the center seam 251 is an in-turned configuration as illustrated in FIG. 22. Such a configured center seam 251 is formed by securing together at least a portion of the in-turned portions of the side edges 223 and 233 and the side edges 224 and 234, respectively. The outer surface 213 of the right and left front panels 220 and 221 and the outer surface of the right and left back panels 230 and 231, respectively, are brought into contact with each other.

Another embodiment of the center seam 251 is an over-lapped configuration as illustrated in FIG. 20. Such a configured center seam 251 is formed by securing together at least a portion of the over-lapped portions of the side edges 223 and 233 and the side edges 224 and 234, respectively. The inner surface 211 of one of the right or left front panels 220 and 221 and the inner surface 211 of the right or left back panels 230 and 231 are brought into contact with the outer surface 213 of the other panel of each pair.

Another embodiment of the center seam 251 is an over-lapped configuration as illustrated in FIG. 23. Such a configured center seam 251 is formed by folding back the side edges 224 and 234 (or, alternatively, the side edges 223 and 233). The outer surface 213 of the folded portion and the inner surface 211 of the unfolded portion of the side edges 224 and 234 and the corresponding portions of the right front and right back panels 220 and 230, respectively, (or, alternatively, of the side edges 223 and 233 and the corresponding portions of the left front and left back panels 221 and 231, respectively) are brought into contact with the inner surface 211 or the outer surface 213 of the side edges 223 and 233 and the corresponding portions of the left front and left back panels 221 and 231, respectively (or, alternatively, of the side edges 224 and 234 and the corresponding portions of the right front and right back panels 220 and 230). It is understood that the folding back of a side edge, such as the side edges 223, 224, 233, and 234, could be performed such that the inner surface 211 would be exposed along the fold.

The locations of the garment end portion 262 of the right front panel 220 and the garment end portion 263 of the left front panel 221 correspond to the garment end portion 266 of the front panel 250 in the finished garment 210. The locations of the garment end portion 264 of the right back panel 230 and the garment end portion 265 of the left back panel 231 correspond to the garment end portion 267 of the back panel 260 in the finished garment 210.

In the embodiments where the webs of fabric 215 and 216 or the garment-sized pieces 217 and 218 are fastened together prior to the folding step, each discrete garment-sized piece 255 of the composite web of fabric 253 is transported, typically by vacuum screens, belts, or conveyors, through hemming, folding, and fastening operations. The folding operations are desirably carried out by tuckers and folders, as well as any other known means. The discrete garment-sized piece 255 of the web of fabric 253 is folded by the folder 277 so as to bring together the opposing garment end portions 266 and 267 such that the web side edge 246 of the composite web of fabric 253 is folded on to itself, bringing the garment side edge 222 of the front panel 250 and the garment side edge 232 of the back panel 260 together. The web side edge 249 of the composite web of fabric 253 is folded on to itself, bringing the garment side edge 225 of the front panel 250 and the garment side edge 235 of the back panel 260 together.

The mating of the garment side edge 222 and the garment side edge 232 as well as the mating of the garment side edge 225 and the garment side edge 235 form the garment side seams 240 and 242, respectively, of the garment 210. It may be desirable to redirect (or reorient) the discrete garment-sized piece 255 of the composite web of fabric 253 to allow easy bonding of the garment side seams 240 and 242 of the garment 210. The turning operations are desirably carried out by turn rolls and turn tables, as well as any other known means. The discrete garment-sized piece 255 of the composite web of fabric 253 may be reoriented 90 degrees (not shown).

In various embodiments of the present invention, one or both of the garment side seams 240 and 242 can be constructed as non-refastenable seams or as refastenable seams. Any excess material from the webs of fabric 215 and 216 may be removed from the edges of the garment side seams 240 and 242 to reduce and smooth out the garment side seams 240 and 242. The non-refastenable garment side seams 240 and 242 may be formed by any suitable means such as ultrasonic sealing, adhesive bonding, tape, heat sealing, sewing, or any method of fastening known in the art. (Sewing equipment 318 is shown in FIG. 2). The non-refastenable garment side seams 240 and 242 may be constructed on a continuous or intermittent basis. One suitable method of forming such garment side seams 240 and 242 is disclosed in U.S. Pat. No. 4,938,753 issued Jul. 3, 1990, to Van Gompel et al., which is incorporated herein by reference. The garment side seams 240 and 242 may be bonded together to form non-refastenable garment side seams 240 and 242.

In other embodiments of the present invention, the garment side edges 222 and 232 and the garment side edges 225 and 235 of the garment 210 may be held together in the finished garment 210 to form refastenable garment side seams 240 and 242, respectively. The refastenable means for securing the garment side edges 222 and 232 and the garment side edges 225 and 235 of the garment 210 include refastenable adhesive and mechanical type fasteners 295. The adhesive and mechanical type fasteners 295 include buttons and button holes, snaps, buckles, clasps, hooks and loops, send extensions, tabs, tape, and the like which are designed or adapted to interlock or engage some type of a complementary device or the outer surface 213 or the inner surface 211 of the garment 210.

In addition, elasticized fasteners 295 may also be used in assuring better fit of the garment 210. If the garment 210 includes refastenable garment side seams 240 and 242, the refastenable means are desirably strategically placed on the webs of fabric 215 and 216 before the webs of fabric 215 and 216 are cut into garment-sized pieces 217 and 218. The folding and redirection operations may be eliminated when refastenable garment side seams 240 and 242 are included in the garment 210. However, there may be packaging reasons for which one would still carry out these two steps.

The garment side seams 240 and 242 of the present invention may take on a variety of structures or configurations known in the art. One embodiment of the garment side seams 240 and 242 is an out-turned configuration as illustrated in FIG. 21. Such configured garment side seams 240 and 242 are formed by securing together at least a portion of the out-turned portions of the garment side edges 222 and 232 and the garment side edges 225 and 235, respectively. The inner surface 211 of the garment side edges 222 and 225 of the front panel 250 and the garment side edges 232 and 235 of the back panel 260, respectively, are brought into contact with each other for each pair of side edges.

Another embodiment of the garment side seams 240 and 242 is an in-turned configuration as illustrated in FIG. 22. Such configured garment side seams 240 and 242 are formed by securing together at least a portion of the in-turned portions of the garment side edges 222 and 232 and the garment side edges 225 and 235, respectively. The outer surface 213 of the garment side edges 222 and 225 of the front panel 250 and the garment side edges 232 and 235 of the back panel 260, respectively, are brought into contact with each other for each pair of side edges.

Another embodiment of the garment side seams 240 and 242 is an over-lapped configuration as illustrated in FIG. 20. Such configured garment side seams 240 and 242 are formed by securing together at least a portion of the over-lapped portions of the garment side edges 222 and 232 and the garment side edges 225 and 235, respectively. The inner surface 211 of one of the garment side edges 222 and 232 and one of the garment side edges 225 and 235 are brought into contact with the outer surface 213 of the other side edges of each pair of side edges.

Another embodiment of the garment side seams 240 and 242 is an over-lapped configuration as illustrated in FIG. 23. Such a configured garment side seam 240 is formed by folding back the garment side edge 222 or the garment side edge 232. The outer surface 213 of the folded portion and the inner surface 211 of the unfolded portion of the garment side edge 222 or 232 and the corresponding portion of the front panel 220 (or, alternatively, the front panel 250) or the back panel 230 (or, alternatively, the back panel 260), respectively, are brought into contact with the inner surface 211 or the outer surface 213 of the non-folded side edge and the corresponding portion of the front panel 220 (or, alternatively, the front panel 250) or the back panel 230 (or, alternatively, the back panel 260).

The garment side edge 242 is formed by folding back the garment side edge 225 or the garment side edge 235. The outer surface 213 of the folded portion and the inner surface 211 of the unfolded portion of the garment side edge 225 or 235 and the corresponding portion of the front panel 221 (or, alternatively, the front panel 250) or the back panel 231 (or, alternatively, the back panel 260), respectively, are brought into contact with the inner surface 211 or the outer surface 213 of the non-folded side edge and the corresponding portion of the front panel 221 (or, alternatively, the front panel 250) or the back panel 231 (or, alternatively, the back panel 260). It is understood that the folding back of a garment side edge 222, 232, 225, or 235 could be performed such that the inner surface 211 would be exposed along the fold.

The garment end portions 266 and 267 of the discrete garment-sized piece 255 of the composite web of fabric 253 may be hemmed in the finished garment 210. In some embodiments, it may be desirable to hem the garment end portions 262, 263, 264, and 265 of the garment-sized pieces 217 and 218 of the webs of fabric 215 and 216, respectively, before fastening the garment-sized pieces 217 and 218 together to form the discrete garment-sized piece 255 of the composite web of fabric 253. The garment end portions 266 and 267 of the discrete garment-sized piece 255 (or, alternatively, garment end portions 262, 263, 264, and 265 of the garment-sized pieces 217 and 218) can be hemmed by any method or style known in the art. In some embodiments, it may be desirable to leave the garment end portions 266 and 267 of the discrete garment-sized piece 255 (or, alternatively, garment end portions 262, 263, 264, and 265 of the garment-sized pieces 217 and 218) unhemmed.

The garment bottom edges 259 and 268 of the discrete garment-sized piece 255 of the composite web of fabric 253 may be hemmed in the finished garment 210. In some embodiments, it may be desirable to hem the garment bottom edges 226, 227, 236, and 237 of the garment-sized pieces 217 and 218 of the webs of fabric 215 and 216, respectively, before fastening the garment-sized pieces 217 and 218 together to form the discrete garment-sized piece 255 of the composite web of fabric 253. The garment bottom edges 259 and 268 of the discrete garment-sized piece 255 (or, alternatively, garment bottom edges 226, 227, 236, and 237 of the garment-sized pieces 217 and 218) can be hemmed by any method or style known in the art. (Sewing equipment 317 is shown in FIG. 2). In some embodiments, it may be desirable to leave the garment bottom edges 259 and 268 of the discrete garment-sized piece 255 (or, alternatively, garment bottom edges 226, 227, 236, and 237 of the garment-sized pieces 217 and 218) unhemmed.

Figure 10:
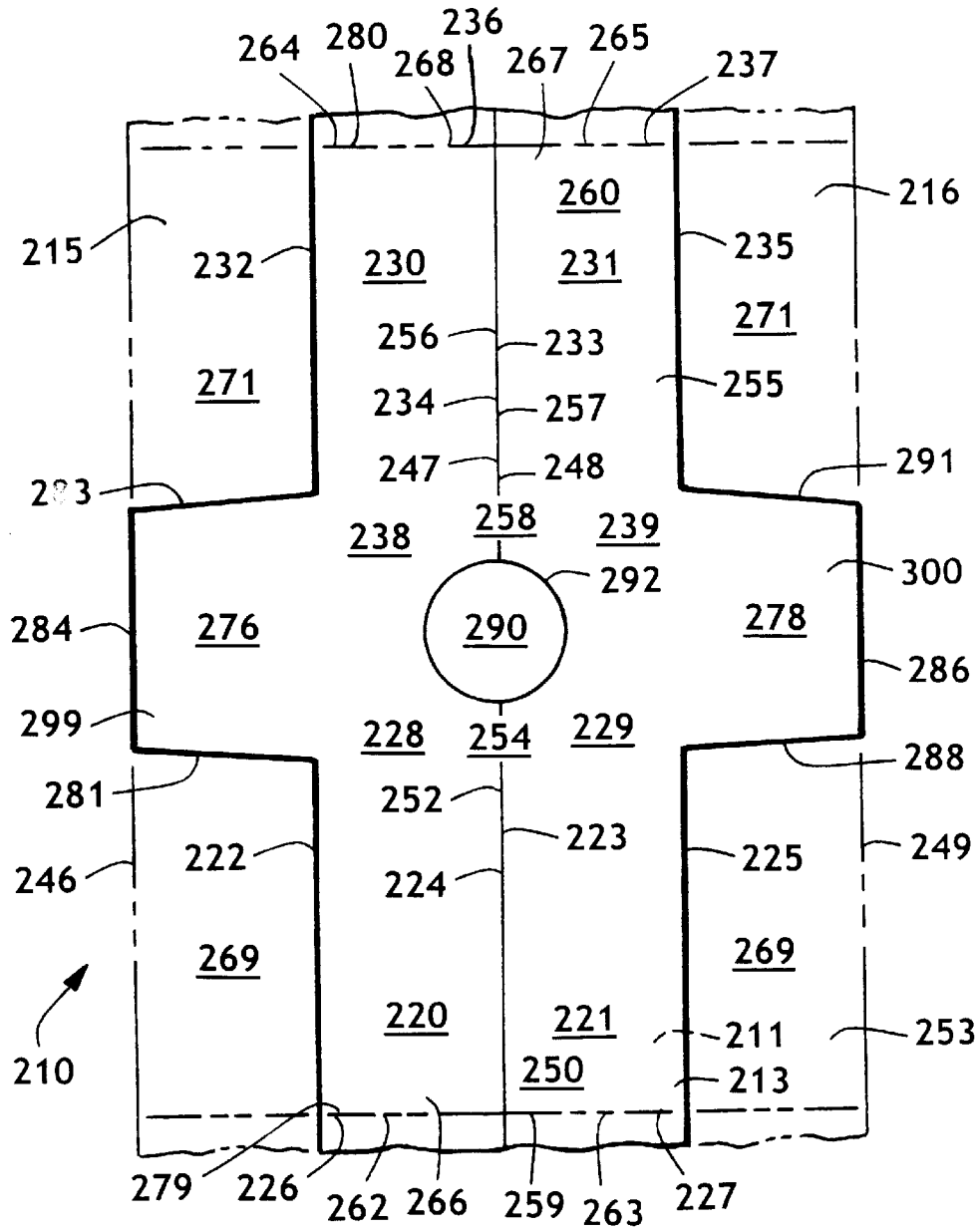
FIG. 10 is a top plan view of a garment made by the present invention in a pre-assembled flat configuration.

In some embodiments of the present invention, the garment 210 includes sleeves 276 and 278 (see FIGS. 5, 6, and 10). The sleeves 276 and 278 are made from the sleeve flaps 299 and 300. The sleeve flaps 299 and 300 may take on a variety of sizes and shapes, such as a slit, circular, oval, triangular, square, rectangular, multi-faceted, asymmetric or irregular, or the like. The pattern of the sleeve flaps 299 and 300 (or, alternatively, the sleeves 276 and 278) is restricted only by fashion and the minimum amount of the material of the sleeve flaps 299 and 300 that is necessary to complete the remaining steps or operations of the process of manufacture. The sleeves 276 and 278, alternately the sleeve flaps 299 and 300, may be similar or dissimilar in shape, structure, material, size, and the like from each other within the finished garment 210. In some embodiments, only one sleeve 276 or 278 may be included in the finished garment 210.

The sleeve flap 299 has a pair of sleeve side edges 281 and 283, and a sleeve opening end edge 284 extending between the sleeve side edges 281 and 283. It is understood that the piece of the sleeve flap 299 could be made of multiple pieces of material or materials. The sleeve flap 299 is folded so as to bring together the opposing sleeve side edges 281 and 283 to form a sleeve seam 293 of the sleeve 276.

The sleeve flap 300 has a pair of sleeve side edges 288 and 291, and a sleeve opening end edge 286 extending between the sleeve side edges 281 and 283. It is also understood that the sleeve flap 300 could be made of multiple pieces of material or materials. The sleeve flap 300 is folded so as to bring together the opposing sleeve side edges 288 and 291 to form a sleeve seam 297 of the sleeve 278.

It may be desirable to redirect (or reorient) the garment-sized pieces 217 and 218 (or, alternatively, the discrete garment-sized piece 255) to allow easy fastening of the sleeve seams 293 and 297 of the sleeves 276 and 278, respectively, of the garment 210. The garment-sized pieces 217 and 218 (or, alternatively, the discrete garment-sized piece 255) may be reoriented 90 degrees (not shown). The sleeve seams 293 and 297 can be non-refastenable seams or refastenable seams. Any excess material of the sleeve flaps 299 and 300 can be removed from their respective edges of the sleeve seams 293 and 297 to reduce and smooth out the sleeve seams 293 and 297. The non-refastenable sleeve seams 293 and 297 may be formed by any suitable means such as ultrasonic sealing, adhesive bonding, tape, heat sealing, sewing, or any method of fastening known in the art, as discussed above. The non-refastenable sleeve seams 293 and 297 may be constructed on a continuous or intermittent basis.

In other embodiments, the opposing pair of the sleeve side edges 281 and 283 and the opposing pair of the sleeve side edges 288 and 291 of the sleeves 276 and 278, respectively, may be held together in the finished garment 210 to form refastenable sleeve seams 293 and 297. The refastenable means for securing the opposing pair of the sleeve side edges 281 and 283 and the opposing pair of the sleeve side edges 288 and 291 of the sleeves 276 and 278, respectively, include refastenable adhesive and mechanical type fasteners 295. The adhesive and mechanical type fasteners 295 include buttons and button holes, snaps, buckles, clasps, hooks and loops, end extensions, tabs, tape, and the like which are designed or adapted to interlock or engage some type of a complementary device or the inner surface 211 or the outer surface 213 of the garment 210. The refastenable sleeve seams 293 and 297 may be constructed on a continuous or intermittent basis.

In addition, elasticized fasteners 295 may also be used in assuring better fit of the sleeves 276 and 278 of the garment 210. If the garment 210 includes refastenable sleeve seams 293 and 297, the refastenable means are desirably strategically placed on the sleeve flaps 299 and 300 before the opposing indentations 269 and 271 are cut into the web side edges 246 and 249 of the composite web of fabric 253 (or, alternatively, the webs of fabric 215 and 216). The folding and redirection operations may be eliminated when refastenable sleeve seams 293 and 297 are included in the garment 210. However, there may be packaging reasons for which one would still carry out these two steps.

The sleeve seams 293 and 297 of the present invention may take on a variety of structures or configurations known in the art. One embodiment of the sleeve seams 293 and 297 is an out-turned configuration as illustrated in FIG. 21. Such configured sleeve seams 293 and 297 are formed by securing together at least a portion of the out-turned portions of the sleeve side edges 281 and 283 and the sleeve side edges 288 and 291 of the sleeve flaps 299 and 300, respectively. The inner surface 211 of the sleeve side edges 281 and 283 and the sleeve side edges 288 and 291 of the sleeve flaps 299 and 300, respectively, are brought into contact with each other of the pair.

Another embodiment of the sleeve seams 293 and 297 is an in-turned configuration as illustrated in FIG. 22. Such configured sleeve seams 293 and 297 are formed by securing together at least a portion of the in-turned portions of the sleeve side edges 281 and 283 and the sleeve side edges 288 and 291 of the sleeve flaps 299 and 300, respectively. The outer surface 213 of the sleeve side edges 281 and 283 and the sleeve side edges 288 and 291 of sleeve flaps 299 and 300, respectively, are brought into contact with each other of the pair.

Another embodiment of the sleeve seams 293 and 297 is an over-lapped configuration as illustrated in FIG. 20. Such configured sleeve seams 293 and 297 are formed by securing together at least a portion of the over-lapped portions of the sleeve side edges 281 and 283 and the sleeve side edges 288 and 291 of the sleeve flaps 299 and 300, respectively. The inner surface 211 of one of the sleeve side edges 281 or 283 and the sleeve side edges 288 or 291 of the sleeve flaps 299 and 300 are brought into contact with the outer surface 213 of the other sleeve side edge 281 or 283 and the sleeve side edge 288 or 291 of the sleeve flap 299 and 300, respectively.

Another embodiment of the sleeve seams 293 and 297 is an over-lapped configuration as illustrated in FIG. 23. Such configured sleeve seams 293 and 297 are formed by folding back the sleeve side edges 281 or 283 and the sleeve side edges 288 and 291 of the sleeve flaps 299 and 300, respectively. The outer surface 213 of the folded portions and the inner surface 211 of the unfolded portions of the sleeve side edges 281 or 283 and the sleeve side edges 288 or 291 and the corresponding portions of the sleeve flaps 299 and 300, respectively, are brought into contact with the inner surface 211 or the outer surface 213 of the non-folded sleeve side edge and the corresponding portions of the sleeve flaps 299 and 300, respectively. It is understood that the folding back of a sleeve side edge 281, 283, 288, or 291 could be performed such that the inner surface 211 would be exposed along the fold.

The sleeve opening end edges 284 and 286 of the sleeves 276 and 278, respectively, (in the alternative, the sleeve opening end edges 284 and 286 of the sleeve flaps 299 and 300) can be hemmed by any method or style known in the art. In some embodiments, it may be desirable to leave the sleeve opening end edges 284 and 286 unhemmed.

In other embodiments, cuffs 285 and 287 may be attached to the sleeve opening end edges 284 and 286, respectively, of the sleeves 276 and 278, respectively, of the garment 210, forming cuff seams 308 and 310, respectively. The attachment of the cuffs 285 and 287 may be made non-refastenable by means as discussed above. (Sewing equipment 316 is shown in FIG. 2). In the alternative, the attachment of the cuffs 285 and 287 may be made refastenable by means as discussed above. The cuff seams 308 and 310 may be constructed on a continuous or intermittent basis. The cuffs 285 and 287 may take on a variety of sizes and shapes. The cuffs 285 and 287 may be similar or dissimilar in shape, structure, material, size, and the like from each other within the finished garment 210. The pattern of the cuffs 285 and 287 is restricted only by the fashion and the minimum amount of the material of the cuffs 285 and 287 that is necessary to complete the remaining steps or operations of the process of manufacture.

The cuff seams 308 and 310 of the present invention may take on a variety of structures or configurations known in the art. One embodiment of the cuff seams 308 and 310 is an out-turned configuration as illustrated in FIG. 21. Such configured cuff seams 308 and 310 are formed by securing together at least a portion of the out-turned portions of the cuff edge 307 and the sleeve opening end edge 284 and the cuff edge 309 and the sleeve opening end edge 286, respectively, of the garment 210. The inner surface 211 of the cuff edges 307 and 309 of the cuffs 285 and 287, respectively, are brought into contact with the inner surface 211 of the sleeve opening edges 284 and 286 of the sleeves 276 and 278, respectively.

Another embodiment of the cuff seams 308 and 310 is an in-turned configuration as illustrated in FIG. 22. Such configured cuff seams 308 and 310 are formed by securing together at least a portion of the in-turned portions of the cuff edge 307 and the sleeve opening edge 284 and the cuff edge 309 and the sleeve opening edge 286, respectively, of the garment 210. The outer surface 213 of the cuff edges 307 and 309 of the cuffs 285 and 287, respectively, are brought into contact with the outer surface 213 of the sleeve opening edges 284 and 286 of the sleeves 276 and 278, respectively.

Another embodiment of the cuff seams 308 and 310 is an over-lapped configuration as illustrated in FIG. 20. Such configured cuff seams 308 and 310 are formed by securing together at least a portion of the over-lapped portions of the cuff edge 307 and the sleeve opening edge 284 and the cuff edge 309 and the sleeve opening edge 286 of the sleeves 276 and 278, respectively. The inner surface 211 of one of the cuff edge 307 or the sleeve opening edge 284 and the cuff edge 309 or the sleeve opening edge 286, are brought into contact with the outer surface 213 of the other cuff edge 307 or the sleeve opening edge 284 and the cuff edge 309 or the sleeve opening edge 286 of the sleeves 276 and 278, respectively.

Another embodiment of the cuff seams 308 and 310 is an over-lapped configuration as illustrated in FIG. 23. Such configured cuff seams 308 and 310 are formed by folding back the cuff edge 307 or the sleeve opening end edge 284 and the cuff edge 309 or the sleeve opening end edge 286 of the sleeves 276 and 278, respectively. The outer surface 213 of the folded portions and the inner surface 211 of the unfolded portions of the cuff edge 307 or the sleeve opening end edge 284 and the cuff edge 309 or the sleeve opening end edge 286 and the corresponding portions of the cuffs 285 and 287 or the sleeves 276 and 278 are brought into contact with the inner surface 211 or the outer surface 213 of the unfolded cuff edge 307 and 309 or the sleeve opening end edge 284 and 286 and the corresponding portions of the cuffs 285 and 287 or the sleeves 276 and 278. It is understood that the folding back of a cuff edge 307 or 309 or a sleeve opening end edge 284 or 286 could be performed such that the inner surface 211 would be exposed along the fold.

The materials used for the cuffs 285 and 287 may be the same as the materials used for the other portions of the garment 210. In some embodiments, it is desirable that the materials used for the cuffs 285 and 287 have an elastic element such that the cuffs 285 and 287 will conform to the portion of the wearer's arms that come into contact with the cuffs 285 and 287.

The edge 292 of the neck opening 290 can be hemmed by any method or style known in the art. In some embodiments, it may be desirable to leave the edge 292 of the neck opening 290 unhemmed.

In other embodiments, a collar 294 may be attached to the edge 292 of the neck opening 290 of the garment 210 thereby forming a collar seam 312. The attachment of the collar 294 may be made non-refastenable by means as discussed above. (Sewing equipment 315 is shown in FIG. 2). The collar seam 312 may be constructed on a continuous or intermittent basis. In the alternative, the attachment of the collar 294 may be made refastenable by means as discussed above. The collar 294 may take on a variety of sizes and shapes. The pattern of the collar 294 is restricted only by fashion and the minimum amount of the material of the collar 294 that is necessary to complete the remaining steps or operations of the process of manufacture.

The collar seam 312 of the present invention may take on a variety of structures or configurations known in the art. One embodiment of the collar seam 312 is an out-turned configuration as illustrated in FIG. 21. Such a configured collar seam 312 is formed by securing together at least a portion of the out-turned portions of the collar edge 311 and the edge 292 of the neck opening 290 of the garment 210. The inner surface 211 of the collar edge 311 of the collar 294 is brought into contact with the inner surface 211 of the edge 292 of the neck opening 290.

Another embodiment of the collar seam 312 is an in-turned configuration as illustrated in FIG. 22. Such a configured collar seam 312 is formed by securing together at least a portion of the in-turned portions of the collar edge 311 of the collar 294 and the edge 292 of the neck opening 290 of the garment 210. The outer surface 213 of the collar edge 311 of the collar 294 is brought into contact with the outer surface 213 of the edge 292 of the neck opening 290.

Another embodiment of the collar seam 312 is an over-lapped configuration as illustrated in FIG. 20. Such a configured collar seam 312 is formed by securing together at least a portion of the over-lapped portions of the collar edge 311 of the collar 294 and the edge 292 of the neck opening 290 of the garment 210. The inner surface 211 of the collar edge 311 of the collar 294 or the edge 292 of the neck opening 290 is brought into contact with the outer surface 213 of the other, the collar edge 311 or the edge 292.

Another embodiment of the collar seam 312 is an over-lapped configuration as illustrated in FIG. 23. Such a configured collar seam 312 is formed by folding back the collar edge 311 of the collar 294 or the edge 292 of the neck opening 290. The outer surface 213 of the folded portions and the inner surface 211 of the unfolded portions of the collar edge 311 of the collar 294 or the edge 292 of the neck opening 290 and the corresponding portions of the collar 294 or the front and back panels 250 and 260 are brought into contact with the inner surface 211 or the outer surface 213 of the unfolded collar edge 311 of the collar 294 or the edge 292 of the neck opening 290 and the corresponding portions of the collar 294 or the front and back panels 250 and 260. It is understood that the folding back of the collar edge 311 of the collar 294 or the edge 292 of the neck opening 290 could be performed such that the inner surface 211 would be exposed along the fold.

Figure 24:
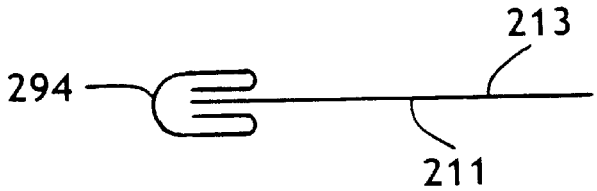
FIG. 24 is a cross sectional view of a seam.

Another embodiment of the collar seam 312 is an over-lapped configuration as illustrated in FIG. 24. Such a configured collar seam 312 is formed by folding the collar 294 about or over the edge 292 of the neck opening 290. The collar edges 311 of the collar 294 may be folded under bringing the outer surface 213 of the collar 294 into contact with the edge 292 of the neck opening and any portion of the adjacent material of the front panel 250, the back panel 260, or both as desired. The collar edges 311 may be left exposed by not being folded under.

Figure 25:
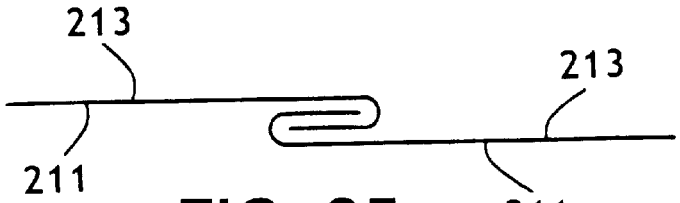
FIG. 25 is a cross sectional view of a seam.

Another embodiment of the collar seam 312 is an over-lapped configuration as illustrated in FIG. 25. Such a configured collar seam 312 is formed by folding the collar edge 311 such that the inner surface 211 of the collar 294 is brought into contact with themselves. The edge 292 of the neck opening 290 is folded such that the outer surface 213 of the front panel 250, the back panel 260, or both are brought into contact with itself. The collar edge 311 is inserted into the fold of the edge 292 of the neck opening 290. The edge 292 of the neck opening 290 is inserted into the fold of the collar edge 311. In another embodiment, the collar edge 311 is folded such that the outer surface 213 of the collar 294 is brought into contact with itself. The edge 292 of the neck opening 290 is folded such that the inner surface 211 of the front panel 250, the back panel 260, or both are brought into contact with themselves. This configured collar seam 312 may be used with any seam described herein.

The materials used for the collar 294 may be the same as the materials used for the other portions of the garment 210. In some embodiments, it is desirable that the materials used for the collar 294 have an elastic element such that the collar 294 will conform to the portion of the wearer's neck that comes into contact with the collar 294.

In various embodiments of the present invention, the front panel 250, the back panel 260, or both panels 250 and 260 may be cut or otherwise opened to form a slit 245 or 301, such as a placket. The slit 245 has two edges 257 and 261. The slit 301 has two edges, 302 and 303. The slits 245 and 301 of the front and back panels 220 and 230, respectively, may extend from the edge 292 of the neck opening 290 to the garment bottom edge 259 and 268, respectively. In the alternative, the slits 245 and 301 may extend over only a portion of the panel 250 and 260 from the edge 292 of the neck opening 290 to the garment bottom edge 259 and 268, respectively. When the garment 210 comprises both a slit 245 in the front panel 250 and a slit 301 in the back panel 260, the slits 245 and 301 may be similar or dissimilar in size, structure, shape, and the like. The slits 245 and 301 may or may not coincide with the side edges 223 and 224 and the side edges 233 and 234, respectively.

In some embodiments, the edges 257 and 261 of the slit 245 and the edges 302 and 303 of the slit 301 may be refastenably attached or secured to each other. The edges 257 and 261 may be secured together to form the front seam 313. The edges 302 and 303 may be secured together to form the back seam 314. Various fastening means, such as adhesive and mechanical type fasteners 295, see the discussion above, may be used to refastenably attach or secure the edges 257 and 261 or the edges 302 and 303 together of the slits 245 and 301, respectively.

One embodiment of the present invention is a continuous process for the manufacture of a garment comprising the following steps: providing a web of fabric including opposing web side edges; intermittently cuffing the web of fabric, forming edges defining neck openings in the web of fabric; intermittently cutting the opposing web side edges of the web of fabric, defining pairs of opposing indentations in the opposing web side edges of the web of fabric; cutting the web of fabric, defining discrete garment-sized pieces wherein each of the discrete garment-sized pieces of the web of fabric includes at least one neck opening, a front panel having a pair of opposing garment side edges, a back panel having a pair of opposing garment side edges, a portion of two pairs of the opposing indentations in the web side edges of the web of fabric, a pair of sleeve flaps, two garment end portions, and a pair of opposing piece side edges wherein the opposing piece side edges are proximate a pair of opposing garment bottom edges of the garment; folding the discrete garment-sized piece of the web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The neck openings may be intermediate the two pairs of the opposing indentations. The web of fabric may be folded, defining an arrangement of having the web of fabric wherein the opposing web side edges are adjacent each other. The web of fabric may be unfolded after at least one step of intermittently cutting the web of fabric. The web of fabric may be unfolded before the step of cutting the web of fabric into the discrete garment-sized pieces of the web of fabric. At least a portion of at least one of the opposing garment bottom edges may be hemmed. The discrete garment-sized piece of the web of fabric may include at least one sleeve flap having a sleeve opening end edge and a pair of opposing sleeve side edges. The discrete garment-sized pieces of the web of fabric may include a pair of sleeve flaps wherein each sleeve flap includes a sleeve opening end edge and a pair of opposing sleeve side edges. At least a portion of at least one of the sleeve opening end edges of the sleeve flaps may be hemmed.

A collar may be provided. At least a portion of the collar may be fastened to the edge of the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge, thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a web of fabric including opposing web side edges; intermittently cuffing the opposing web side edges of the web of fabric, defining pairs of opposing indentations in the opposing web side edges of the web of fabric; intermittently cutting the web of fabric, forming edges defining neck openings in the web of fabric wherein the neck openings are intermediate two pairs of the opposing indentations; cutting the web of fabric, defining discrete garment-sized pieces wherein each discrete garment-sized piece of the web of fabric includes at least one neck opening, a front panel having a pair of opposing garment side edges, a back panel having a pair of opposing garment side edges, a portion of the two pairs of the opposing indentations in the opposing web side edges of the web of fabric, a pair of sleeve flaps, two garment end portions, and a pair of opposing piece side edges wherein the opposing piece side edges are proximate a pair of opposing garment bottom edges of the garment; folding the discrete garment-sized piece of the web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The web of fabric may be folded, defining an arrangement of having the web of fabric wherein the opposing web side edges are adjacent each other. The web of fabric may be unfolded after at least one step of intermittently cutting the web of fabric. The web of fabric may be unfolded before the step of cutting the web of fabric into the discrete garment-sized pieces of the web of fabric. At least a portion of at least one of the opposing garment bottom edges may be hemmed. The discrete garment-sized piece of the web of fabric may include at least one sleeve flap having a sleeve opening end edge and a pair of opposing sleeve side edges. The discrete garment-sized pieces of the web of fabric may include a pair of sleeve flaps wherein each sleeve flap includes a sleeve opening end edge and a pair of opposing sleeve side edges. At least a portion of at least one of the sleeve opening end edges of the sleeve flaps may be hemmed.

A collar may be provided. At least a portion of the collar may be fastened to the edge of the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge, thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge, thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a web of fabric including an inner surface, an outer surface, and opposing web side edges; intermittently cutting the opposing web side edges of the web of fabric, defining pairs of opposing indentations in the opposing web side edges of the web of fabric; intermittently cutting the web of fabric, forming edges defining neck openings in the web of fabric wherein the neck openings are intermediate two pairs of the opposing indentations; cutting the web of fabric, defining discrete garment-sized pieces wherein each discrete garment-sized piece of the web of fabric includes at least one neck opening, a front panel having a pair of opposing garment side edges, a back panel having a pair of opposing garment side edges, a portion of the two pairs of the opposing indentations in the opposing web side edges of the web of fabric, pair of sleeve flaps, two garment end portions, and a pair of opposing piece side edges wherein the opposing piece side edges are proximate a pair of opposing garment bottom edges of the garment; hemming at least a portion of at least one of the opposing garment bottom edges; folding the discrete garment-sized pieces of the web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The web of fabric may be folded, defining an arrangement of having the web of fabric wherein the opposing web side edges are adjacent each other. The web of fabric may be unfolded after at least one step of intermittently cutting the web of fabric. The web of fabric may be unfolded before the step of cutting the web of fabric into the discrete garment-sized pieces of the web of fabric. Each of the sleeve flaps may include an inner surface, an outer surface, a sleeve opening end edge, and a pair of opposing sleeve side edges. At least a portion of at least one of the sleeve opening end edges of the sleeve flaps may be hemmed.

A collar may be provided. At least a portion of the collar may be fastened at the edge of the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a web of fabric including opposing web side edges; cutting the web of fabric, defining discrete garment-sized pieces wherein each of the discrete garment-sized pieces of the web of fabric include at least a front panel, a back panel, two garment end portions, a portion of each of the web side edges of the web of fabric and the pair of opposing piece side edges wherein the opposing piece side edges are proximate a pair of opposing garment bottom edges of the garment; cutting the discrete garment-sized pieces, forming edges defining at least one neck opening in each of the discrete garment-sized pieces; cutting the opposing garment bottom edges of the discrete garment-sized pieces, defining two pairs of opposing indentations in the opposing garment bottom edges of the discrete garment-sized pieces, thereby forming a pair of opposing garment side edges of the front panel, a pair of opposing garment side edges of the back panel, and a pair of sleeve flaps; folding each of the discrete garment-sized pieces whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The neck openings may be intermediate the two pairs of the opposing indentations. The web of fabric may be folded, defining an arrangement of having the web of fabric wherein the opposing web side edges are adjacent each other. The web of fabric may be unfolded after at least one step of intermittently cutting the web of fabric. The web of fabric may be unfolded before the step of cutting the web of fabric into the discrete garment-sized pieces of the web of fabric. Each of the sleeve flaps may include an inner surface, an outer surface, a sleeve opening end edge, and a pair of opposing sleeve side edges. At least a portion of at least one of the sleeve opening end edges of the sleeve flaps may be hemmed.

A collar may be provided. At least a portion of the collar may be fastened at the edge of the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a first web of fabric including opposing web side edges; providing a second web of fabric including opposing web side edges; aligning the first and second webs of fabric together in a side by side orientation defining an arrangement wherein one of the web side edges of the first web of fabric is adjacent one of the web side edges of the second web of fabric; fastening at least a portion of the adjacent web side edge of the first web of fabric to at least a portion of the adjacent web side edge of the second web of fabric in the side by side orientation, defining at least a portion of a center seam and a composite web of fabric having a pair of opposing web side edges; intermittently cutting the composite web of fabric, forming edges defining neck openings in the composite web of fabric; intermittently cutting the opposing web side edges of the composite web of fabric, defining pairs of opposing indentations in the opposing web side edges of the composite web of fabric; cutting the composite web of fabric, defining discrete garment-sized pieces wherein each discrete garment-sized piece of the composite web of fabric includes at least one neck opening, a front panel having a pair of opposing garment side edges, a back panel having a pair of opposing garment side edges, a portion of two pairs of the opposing indentations in the opposing web side edges of the composite web of fabric, two garment end portions, and a pair of opposing piece side edges wherein the opposing piece side edges of the discrete garment-sized piece are proximate a pair of opposing garment bottom edges of the garment; folding the discrete garment-sized piece of the composite web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The neck openings are intermediate the two pairs of the opposing indentations. At least a portion of at least one of the opposing garment bottom edges may be hemmed. The garment-sized piece of the web of fabric may comprise at least one sleeve flap having a sleeve opening end edge and a pair of opposing side edges. At least a portion of at least one of the sleeve opening end edges of the sleeve flaps may be hemmed. The openings in the composite web of fabric may be intermediate the opposing indentations.

A collar may be provided. At least a portion of the collar may be fastened at the edge of the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a first web of fabric including opposing web side edges; providing a second web of fabric including opposing web side edges; aligning the first and second webs of fabric together in a side by side orientation defining an arrangement wherein one of the web side edges of the first web of fabric is adjacent one of the web side edges of the second web of fabric; fastening at least a portion of the adjacent web side edge of the first web of fabric to at least a portion of the adjacent web side edge of the second web of fabric in the side by side orientation, defining at least a portion of a center seam and a composite web of fabric having a pair of opposing web side edges; intermittently cutting the opposing web side edges of the composite web of fabric, defining pairs of opposing indentations in the opposing web side edges of the composite web of fabric; intermittently cutting the composite web of fabric, forming edges defining neck openings in the composite web of fabric wherein the neck openings are intermediate two pairs of the opposing indentations; cutting the composite web of fabric, defining discrete garment-sized pieces wherein each discrete garment-sized piece of the composite web of fabric includes at least one neck opening, a front panel having a pair of opposing garment side edges, a back panel having a pair of opposing garment side edges, a portion of the two pairs of the opposing indentations in the opposing web side edges of the composite web of fabric, a pair of sleeve flaps, two garment end portions, and a pair of opposing piece side edges wherein the opposing piece side edges of the discrete garment-sized piece are proximate a pair of opposing garment bottom edges of the garment; folding the discrete garment-sized piece of the composite web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

At least a portion of at least one of the opposing garment bottom edges may be hemmed. Each sleeve flap may include a sleeve opening end edge and a pair of opposing sleeve side edges. At least a portion of at least one of the sleeve opening end edges of the sleeve flaps may be hemmed.

A collar may be provided. At least a portion of the collar may be fastened at the edge of the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising: providing a first web of fabric including an inner surface, an outer surface, and opposing web side edges; providing a second web of fabric including an inner surface, an outer surface, and opposing web side edges; aligning the first and second webs of fabric together in a side by side orientation defining an arrangement wherein one of the web side edges of the first web of fabric is adjacent one of the web side edges of the second web of fabric; fastening at least a portion of the adjacent web side edge of the first web of fabric to at least a portion of the adjacent web side edge of the second web of fabric in the side by side orientation, defining at least a portion of a center seam and a composite web of fabric having a pair of opposing web side edges; intermittently cutting the opposing web side edges of the composite web of fabric, defining pairs of opposing indentations in the opposing web side edges of the composite web of fabric; intermittently cutting the composite web of fabric, forming edges defining neck openings in the composite web of fabric wherein the neck openings are intermediate two pairs of the opposing indentations; cutting the composite web of fabric, defining discrete garment-sized pieces wherein each discrete garment-sized piece of the composite web of fabric includes at least one neck opening, a front panel having a pair of opposing garment side edges, a back panel having a pair of opposing garment side edges, a portion of the two pairs of the opposing indentations in the opposing web side edges of the composite web of fabric, a pair of sleeve flaps, two garment end portions, and a pair of opposing piece side edges wherein the opposing piece side edges of the discrete garment-sized piece are proximate a pair of opposing garment bottom edges of the garment; hemming at least a portion of at least one of the opposing garment bottom edges; folding the discrete garment-sized piece of the composite web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

Each sleeve flap may include a sleeve opening end edge and a pair of opposing sleeve side edges. At least a portion of at least one of the sleeve opening end edges of the sleeve flaps may be hemmed. A collar may be provided. At least a portion of the collar may be fastened at the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby, defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a first web of fabric including a first web side edge and a second web side edge; providing a second web of fabric including a first web side edge and a second web side edge; intermittently cutting the second web side edge of the first web of fabric, forming indentations; intermittently cutting the second web side edge of the second web of fabric, forming indentations; aligning the first and second webs of fabric together in a side by side orientation defining an arrangement wherein the second web side edge of the first web of fabric is adjacent the second web side edge of the second web of fabric and the indentations of the second web side edge of the first web of fabric are adjacent the indentations of the second web side edge of the second web of fabric, thereby forming edges defining neck openings; fastening at least a portion of the second web side edge of the first web of fabric to at least a portion of the second web side edge of the second web of fabric in the side by side orientation, defining at least a portion of a center seam and a composite web of fabric having a pair of opposing web side edges; intermittently cutting the opposing web side edges of the composite web of fabric, defining pairs of opposing indentations in the opposing web side edges of the composite web of fabric; cutting the composite web of fabric, defining discrete garment-sized pieces wherein each discrete garment-sized piece of the composite web of fabric includes at least one neck opening, a front panel having a pair of opposing garment side edges, a back panel having a pair of opposing garment side edges, a portion of two pairs of the opposing indentations in the opposing web side edges of the composite web of fabric, two garment end portions, and a pair of opposing piece side edges wherein the opposing piece side edges of the discrete garment-sized piece are proximate a pair of opposing garment bottom edges of the garment; folding the discrete garment-sized piece of the composite web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

Each sleeve flap may include a sleeve opening end edge and a pair of opposing sleeve side edges. At least a portion of at least one of the sleeve opening end edges of the sleeve flaps may be hemmed. A collar may be provided. At least a portion of the collar may be fastened at the neck opening. The collar may be a ribbed knit collar. At least a portion of at least one of the garment side seams may be refastenable. At least a portion of at least one of the garment side seams may be non-refastenable. At least a portion of at least one of the opposing garment bottom edges may be hemmed.

The front panel may be slit at least a portion of the distance between the edge of the neck opening and the garment bottom edge thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a first web of fabric including opposing web side edges; providing a second web of fabric including opposing web side edges; aligning the first and second webs of fabric together in a face to face orientation, defining an arrangement wherein the web side edges of the first web of fabric are adjacent the web side edges of the second web of fabric, thereby defining a first pair of adjacent web side edges comprising one web side edge of the first web of fabric and one web side edge of the second web of fabric and a second pair of adjacent web side edges comprising the other web side edge of the first web of fabric and the other web side edge of the second web of fabric; fastening at least a portion of the first pair of adjacent web side edges together in the face to face orientation, defining at least a portion of a center seam and a composite web of fabric having a pair of opposing web side edges formed from the second pair of adjacent web side edges; intermittently cutting the composite web of fabric, forming edges defining neck openings in the composite web of fabric; intermittently cutting the opposing web side edges of the composite web of fabric, defining pairs of opposing indentations in the opposing web side edges of the composite web of fabric; cutting the composite web of fabric, defining discrete garment-sized pieces wherein each of the discrete garment-sized pieces of the composite web of fabric includes at least one neck opening, a front panel having a pair of opposing garment side edges, a back panel having a pair of opposing garment side edges, a portion of the two pairs of the opposing indentations in the opposing web side edges of the composite web of fabric, a pair of sleeve flaps, two garment end portions, and a pair of opposing piece side edges wherein the opposing piece side edges of the discrete garment-sized piece are proximate a pair of opposing garment bottom edges of the garment; folding the discrete garment-sized piece of the composite web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The neck openings may be intermediate the two pairs of the opposing indentations. The discrete garment-sized piece of the composite web of fabric may include at least one sleeve flap having a sleeve opening end edge and a pair of opposing sleeve side edges. The discrete garment-sized piece of the composite web of fabric may include a pair of sleeve flaps wherein each sleeve flap includes a sleeve opening end edge and a pair of opposing sleeve side edges. The composite web of fabric may be unfolded. The discrete garment-sized piece of the composite web of fabric may be unfolded. At least a portion of at least one of the opposing garment bottom edges may be hemmed. At least a portion of at least one of the sleeve opening end edges of the sleeve flaps may be hemmed.

A collar may be provided. At least a portion of the collar may be fastened at the edge of the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a first web of fabric including opposing web side edges; providing a second web of fabric including opposing web side edges; aligning the first and second webs of fabric together in a face to face orientation, defining an arrangement wherein the web side edges of the first web of fabric are adjacent the web side edges of the second web of fabric, thereby defining a first pair of adjacent web side edges comprising one web side edge of the first web of fabric and one web side edge of the second web of fabric and a second pair of adjacent web side edges comprising the other web side edge of the first web of fabric and the other web side edge of the second web of fabric; fastening at least a portion of the first pair of adjacent web side edges together in the face to face orientation, defining at least a portion of a center seam and a composite web of fabric having a pair of opposing web side edges formed from the second pair of adjacent web side edges; intermittently cutting the opposing web side edges of the composite web of fabric, defining pairs of opposing indentations in the opposing web side edges of the composite web of fabric; intermittently cuffing the composite web of fabric, forming edges defining neck openings in the composite web of fabric wherein the neck openings are intermediate two pairs of the opposing indentations; cutting the composite web of fabric, defining discrete garment-sized pieces wherein each of the discrete garment-sized pieces of the composite web of fabric includes at least one neck opening, a front panel having a pair of opposing garment side edges, a back panel having a pair of opposing garment side edges, a portion of the two pairs of the opposing indentations in the opposing web side edges of the composite web of fabric, a pair of sleeve flaps, two garment end portions, and a pair of opposing piece side edges wherein the opposing piece side edges of the discrete garment-sized piece are proximate a pair of opposing garment bottom edges of the garment; folding the discrete garment-sized piece of the composite web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The composite web of fabric may be unfolded. The discrete garment-sized piece of the composite web of fabric may be unfolded. At least a portion of at least one of the opposing garment bottom edges may be hemmed. At least a portion of at least one of the sleeve opening end edges of the sleeve flaps may be hemmed. A collar may be provided. At least a portion of the collar may be fastened at the edge of the neck opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge, thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge, thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a first web of fabric including an inner surface, an outer surface, and opposing web side edges; providing a second web of fabric including an inner surface, an outer surface, and opposing web side edges; aligning the first and second webs of fabric together in a face to face orientation defining an arrangement wherein the web side edges of the first web of fabric are adjacent the web side edges of the second web of fabric, thereby defining a first pair of adjacent web side edges and a second pair of adjacent web side edges; fastening at least a portion of the first pair of adjacent web side edges together in the face to face orientation, defining at least a portion of a center seam and a composite web of fabric having a pair of opposing web side edges formed from the second pair of adjacent web side edges; intermittently cutting the opposing web side edges of the composite web of fabric, defining pairs of opposing indentations in the opposing web side edges of the composite web of fabric; intermittently cutting the composite web of fabric, forming edges defining neck openings in the composite web of fabric wherein the neck openings are intermediate two pairs of the opposing indentations; cutting the composite web of fabric, defining discrete garment-sized pieces wherein each of the discrete garment-sized pieces of the composite web of fabric includes at least one neck opening, a front panel having a pair of opposing garment side edges, a back panel having a pair of opposing garment side edges, a portion of each of the two pairs of the opposing indentations in the opposing web side edges of the composite web of fabric, a pair of sleeve flaps, two garment end portions, and a pair of opposing piece side edges wherein the opposing piece side edges of the discrete garment-sized piece are proximate a pair of opposing garment bottom edges of the garment; hemming at least a portion of at least one of the opposing garment bottom edges; folding the discrete garment-sized piece of the composite web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The composite web of fabric may be unfolded. The discrete garment-sized piece of the composite web of fabric may be unfolded. The discrete garment-sized piece of the composite web of fabric may include at least one sleeve flap having an inner surface, an outer surface, a sleeve opening end edge, and a pair of opposing sleeve side edges. The discrete garment-sized piece of the composite web of fabric may include a pair of sleeve flaps wherein each sleeve flap includes an inner surface, an outer surface, a sleeve opening end edge, and a pair of opposing sleeve side edges. At least a portion of at least one of the sleeve opening end edges of the sleeve flaps may be hemmed.

A collar may be provided. At least a portion of the collar may be fastened at the edge of the opening. The collar may be a ribbed knit collar. At least a portion of at least one of the garment side seams may be refastenable. At least a portion of at least one of the garment side seams may be non-refastenable.

The front panel may be slit at least a portion of the distance between the edge of the neck opening and the garment bottom edge, thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

Another embodiment of the present invention is a continuous process for the manufacture of a garment comprising the following steps: providing a first web of fabric including a first web side edge and a second web side edge; providing a second web of fabric including a first web side edge and a second web side edge; intermittently cutting the second web side edge of the first web of fabric, forming indentations; intermittently cutting the second web side edge of the second web of fabric, forming indentations; aligning the first and second webs of fabric together in a face to face orientation, defining an arrangement wherein the first web side edge of the first web of fabric is adjacent the first web side edge of the second web of fabric and the second web side edge of the first web of fabric is adjacent the second web side edge of the second web of fabric wherein the indentations of the second web side edge of the first web of fabric are adjacent the indentations of the second web side edge of the second web of fabric thereby forming edges defining neck openings; fastening at least a portion of the second web side edge of the first web of fabric to at least a portion of the second web side edge of the second web of fabric in the face to face orientation, defining at least a portion of a center seam and a composite web of fabric having a pair of opposing web side edges formed from the first web side edges of the first web of fabric and the first web side edges; intermittently cutting the composite web of fabric, forming edges defining neck openings in the composite web of fabric; intermittently cutting the opposing web side edges of the composite web of fabric, defining pairs of opposing indentations in the opposing web side edges of the composite web of fabric; cutting the composite web of fabric, defining discrete garment-sized pieces wherein each of the discrete garment-sized pieces of the composite web of fabric includes at least one neck opening, a front panel having a pair of opposing garment side edges, a back panel having a pair of opposing garment side edges, a portion of the two pairs of the opposing indentations in the opposing web side edges of the composite web of fabric, a pair of sleeve flaps, two garment end portions, and a pair of opposing piece side edges wherein the opposing piece side edges of the discrete garment-sized piece are proximate a pair of opposing garment bottom edges of the garment; folding the discrete garment-sized piece of the composite web of fabric whereby one of the garment bottom edges of the pair of opposing garment bottom edges is brought into contact with the other garment bottom edge; and, fastening at least a portion of the pair of opposing garment side edges of the front panel to at least a portion of the pair of opposing garment side edges of the back panel to form a pair of garment side seams.

The composite web of fabric may be unfolded. The discrete garment-sized piece of the composite web of fabric may be unfolded. The discrete garment-sized piece of the composite web of fabric may include at least one sleeve flap having an inner surface, an outer surface, a sleeve opening end edge, and a pair of opposing sleeve side edges. The discrete garment-sized piece of the composite web of fabric may include a pair of sleeve flaps wherein each sleeve flap includes an inner surface, an outer surface, a sleeve opening end edge, and a pair of opposing sleeve side edges. At least a portion of at least one of the sleeve opening end edges of the sleeve flaps may be hemmed.

A collar may be provided. At least a portion of the collar may be fastened at the edge of the opening. The collar may be a ribbed knit collar. At least a portion of at least one of the garment side seams may be refastenable. At least a portion of at least one of the garment side seams may be non-refastenable. At least a portion of at least one of the opposing garment bottom edges may be hemmed.

The front panel may be slit at least a portion of the distance between the edge of the neck opening and the garment bottom edge, thereby defining a pair of edges of a slit. At least a portion of the edges of the slit may be fastened to form a front seam. At least a portion of the front seam may be refastenable. At least a portion of the front seam may be non-refastenable. The back panel may be slit at least a portion of the distance between the edge of the neck opening and the garment bottom edge thereby defining a pair of edges of a slit. At least a portion of the edges of the slit may be fastened to form a back seam. At least a portion of the back seam may be refastenable. At least a portion of the back seam may be non-refastenable. At least a portion of the edge of the neck opening may be hemmed.

While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims and any equivalents thereto.

We claim:

1. A continuous process for the manufacture of a garment comprising:

a. providing a web of fabric including opposing web side edges;

b. folding said web of fabric, defining an arrangement of having said web of fabric wherein said opposing web side edges are adjacent each other;

c. intermittently cutting said web of fabric, forming edges defining neck openings in said web of fabric;

d. intermittently cutting said opposing web side edges of said web of fabric, defining pairs of opposing indentations in said opposing web side edges of said web of fabric;

e. unfolding said web of fabric before step of cutting said web of fabric into said discrete garment-sized pieces of said web of fabric;

f. cutting said web of fabric, defining discrete garment-sized pieces wherein each of said discrete garment-sized pieces of said web of fabric includes at least one said neck opening, a front panel having a pair of opposing garment side edges, a back panel having a pair of opposing garment side edges, a portion of two pairs of said opposing indentations in said web side edges of said web of fabric, a pair of sleeve flaps, two garment end portions, and a pair of opposing piece side edges wherein said opposing piece side edges are proximate a pair of opposing garment bottom edges of said garment;

g. folding said discrete garment-sized piece of said web of fabric whereby one of said garment bottom edges of said pair of opposing garment bottom edges is brought into contact with other said garment bottom edge; and, h. fastening at least a portion of said pair of opposing garment side edges of said front panel to at least a portion of said pair of opposing garment side edges of said back panel to form a pair of garment side seams.

2. A continuous process for the manufacture of a garment comprising:

a. providing a web of fabric including opposing web side edges;

b. intermittently cutting said web of fabric, forming edges defining neck openings in said web of fabric;

c. intermittently cutting said opposing web side edges of said web of fabric, defining pairs of opposing indentations in said opposing web side edges of said web of fabric;

d. cutting said web of fabric, defining discrete garment-sized pieces wherein each of said discrete garment-sized pieces of said web of fabric includes at least one said neck opening, a front panel having a pair of opposing garment side edges, a back panel having a pair of opposing garment side edges, a portion of two pairs of said opposing indentations in said web side edges of said web of fabric, a pair of sleeve flaps, two garment end portions, and a pair of opposing piece side edges wherein said opposing piece side edges are proximate a pair of opposing garment bottom edges of said garment;

e. folding said discrete garment-sized piece of said web of fabric whereby one of said garment bottom edges of said pair of opposing garment bottom edges is brought into contact with other said garment bottom edge; and, f. fastening at least a portion of said pair of opposing garment side edges of said front panel to at least a portion of said pair of opposing garment side edges of said back panel to form a pair of garment side seams, wherein at least a portion of at least one of said garment side seams is refastenable.

3. A continuous process for the manufacture of a garment comprising:

a. providing a web of fabric including opposing web side edges;

b. intermittently cutting said web of fabric, forming edges defining neck openings in said web of fabric;

c. intermittently cutting said opposing web side edges of said web of fabric, defining pairs of opposing indentations in said opposing web side edges of said web of fabric;

d. cutting said web of fabric, defining discrete garment-sized pieces wherein each of said discrete garment-sized pieces of said web of fabric includes at least one said neck opening, a front panel having a pair of opposing garment side edges, a back panel having a pair of opposing garment side edges, a portion of two pairs of said opposing indentations in said web side edges of said web of fabric, a pair of sleeve flaps, two garment end portions, and a pair of opposing piece side edges wherein said opposing piece side edges are proximate a pair of opposing garment bottom edges of said garment;

e. folding said discrete garment-sized piece of said web of fabric whereby one of said garment bottom edges of said pair of opposing garment bottom edges is brought into contact with other said garment bottom edge; and, f. fastening at least a portion of said pair of opposing garment side edges of said front panel to at least a portion of said pair of opposing garment side edges of said back panel to form a pair of garment side seams, wherein at least a portion of at least one of said garment side seams is non-refastenable.

4. A continuous process for the manufacture of a garment comprising:

a. providing a web of fabric including opposing web side edges;

b. intermittently cutting said web of fabric, forming edges defining neck openings in said web of fabric;

c. intermittently cutting said opposing web side edges of said web of fabric, defining pairs of opposing indentations in said opposing web side edges of said web of fabric;

d. cutting said web of fabric, defining discrete garment-sized pieces wherein each of said discrete garment-sized pieces of said web of fabric includes at least one said neck opening, a front panel having a pair of opposing garment side edges, a back panel having a pair of opposing garment side edges, a portion of two pairs of said opposing indentations in said web side edges of said web of fabric, a pair of sleeve flaps, two garment end portions, and a pair of opposing piece side edges wherein said opposing piece side edges are proximate a pair of opposing garment bottom edges of said garment;

e. folding said discrete garment-sized piece of said web of fabric whereby one of said garment bottom edges of said pair of opposing garment bottom edges is brought into contact with other said garment bottom edge;

f. fastening at least a portion of said pair of opposing garment side edges of said front panel to at least a portion of said pair of opposing garment side edges of said back panel to form a pair of garment side seams; and, g. slitting said front panel at least a portion of the distance between said edge of said neck opening and said garment bottom edge thereby defining a pair of edges of a slit.

5. The continuous process according to claim 4, further comprising the step of fastening at least a portion of said edges of said slit to form a front seam.

6. The continuous process according to claim 5, wherein at least a portion of said front seam is refastenable.

7. The continuous process according to claim 5, wherein at least a portion of said front seam is non-refastenable.

8. A continuous process for the manufacture of a garment comprising:

a. providing a web of fabric including opposing web side edges;

b. intermittently cutting said web of fabric, forming edges defining neck openings in said web of fabric;

c. intermittently cutting said opposing web side edges of said web of fabric, defining pairs of opposing indentations in said opposing web side edges of said web of fabric;

d. cutting said web of fabric, defining discrete garment-sized pieces wherein each of said discrete garment-sized pieces of said web of fabric includes at least one said neck opening, a front panel having a pair of opposing garment side edges, a back panel having a pair of opposing garment side edges, a portion of two pairs of said opposing indentations in said web side edges of said web of fabric, a pair of sleeve flaps, two garment end portions, and a pair of opposing piece side edges wherein said opposing piece side edges are proximate a pair of opposing garment bottom edges of said garment;

e. folding said discrete garment-sized piece of said web of fabric whereby one of said garment bottom edges of said pair of opposing garment bottom edges is brought into contact with other said garment bottom edge;

f. fastening at least a portion of said pair of opposing garment side edges of said front panel to at least a portion of said pair of opposing garment side edges of said back panel to form a pair of garment side seams; and, g. slitting said back panel at least a portion of the distance between said edge of said neck opening and said garment bottom edge thereby defining a pair of edges of a slit.

9. The continuous process according to claim 8, further comprising the step of fastening at least a portion of said edges of said slit to form a back seam.

10. The continuous process according to claim 9, wherein at least a portion of said back seam is refastenable.

11. The continuous process according to claim 9, wherein at least a portion of said back seam is non-refastenable.

12. A continuous process for the manufacture of a garment comprising:

a. providing a first web of fabric including opposing web side edges;

b. providing a second web of fabric including opposing web side edges;

c. aligning said first and second webs of fabric together in a side by side orientation defining an arrangement wherein one of said web side edges of said first web of fabric is adjacent one of said web side edges of said second web of fabric;

d. fastening at least a portion of said adjacent web side edge of said first web of fabric to at least a portion of said adjacent web side edge of said second web of fabric in said side by side orientation, defining at least a portion of a center seam and a composite web of fabric having a pair of opposing web side edges;

e. intermittently cutting said composite web of fabric, forming edges defining neck openings in said composite web of fabric;

f. intermittently cutting said opposing web side edges of said composite web of fabric, defining pairs of opposing indentations in said opposing web side edges of said composite web of fabric;

g. cutting said composite web of fabric, defining discrete garment-sized pieces wherein each of discrete garment-sized piece of said composite web of fabric includes at least one said neck opening, a front panel having a pair of opposing garment side edges, a back panel having a pair of opposing garment side edges, a portion of two pairs of said opposing indentations in said opposing web side edges of said composite web of fabric, two garment end portions, and a pair of opposing piece side edges wherein said opposing piece side edges of said discrete garment-sized piece are proximate a pair of opposing garment bottom edges of said garment;

h. folding said discrete garment-sized piece of said composite web of fabric whereby one of said garment bottom edges of said pair of opposing garment bottom edges is brought into contact with other said garment bottom edge; and, i. fastening at least a portion of said pair of opposing garment side edges of said front panel to at least a portion of said pair of opposing garment side edges of said back panel to form a pair of garment side seams.

13. The continuous process according to claim 12, wherein said neck openings are intermediate said two pairs of said opposing indentations.

14. The continuous process according to claim 12, further comprising the step of hemming at least a portion of at least one of said opposing garment bottom edges.

15. The continuous process according to claim 12, wherein said garment-sized piece of said web of fabric further comprises at least one sleeve flap having a sleeve opening end edge and a pair of opposing side edges.

16. The continuous process according to claim 15, further comprising the step of hemming at least a portion of at least one of said sleeve opening end edges of said sleeve flaps.

17. The continuous process according to claim 12, wherein said openings in said composite web of fabric are intermediate said opposing indentations.

18. The continuous process according to claim 12, further comprising the step of providing a collar.

19. The continuous process according to claim 18, further comprising the step of fastening at least a portion of said collar at said edge of said neck opening.

20. The continuous process according to claim 18, wherein said collar is a ribbed knit collar.

21. The continuous process according to claim 12, wherein at least a portion of at least one of said garment side seams is refastenable.

22. The continuous process according to claim 12, wherein at least a portion of at least one of said garment side seams is non-refastenable.

23. The continuous process according to claim 12, further comprising the step of slitting said front panel at least a portion of the distance between said edge of said neck opening and said garment bottom edge thereby defining a pair of edges of a slit.

24. The continuous process according to claim 23, further comprising the step of fastening at least a portion of said edges of said slit to form a front seam.

25. The continuous process according to claim 24, wherein at least a portion of said front seam is refastenable.

26. The continuous process according to claim 24, wherein at least a portion of said front seam is non-refastenable.

27. The continuous process according to claim 12, further comprising the step of slitting said back panel at least a portion of the distance between said edge of said neck opening and said garment bottom edge thereby defining a pair of edges of a slit.

28. The continuous process according to claim 27, further comprising the step of fastening at least a portion of said edges of said slit to form a back seam.

29. The continuous process according to claim 28, wherein at least a portion of said back seam is refastenable.

30. The continuous process according to claim 28, wherein at least a portion of said back seam is non-refastenable.

31. The continuous process according to claim 12, further comprising the step of hemming at least a portion of said edge of said neck opening.

32. A continuous process for the manufacture of a garment comprising:

a. providing a first web of fabric including opposing web side edges;

b. providing a second web of fabric including opposing web side edges;

c. aligning said first and second webs of fabric together in a side by side orientation defining an arrangement wherein one of said web side edges of said first web of fabric is adjacent one of said web side edges of said second web of fabric;

d. fastening at least a portion of said adjacent web side edge of said first web of fabric to at least a portion of said adjacent web side edge of said second web of fabric in said side by side orientation, defining at least a portion of a center seam and a composite web of fabric having a pair of opposing web side edges;

e. intermittently cutting said opposing web side edges of said composite web of fabric, defining pairs of opposing indentations in said opposing web side edges of said composite web of fabric;

f. intermittently cutting said composite web of fabric, forming edges defining neck openings in said composite web of fabric wherein said neck openings are intermediate two pairs of said opposing indentations;

g. cutting said composite web of fabric, defining discrete garment-sized pieces wherein each of discrete garment-sized piece of said composite web of fabric includes at least one said neck opening, a front panel having a pair of opposing garment side edges, a back panel having a pair of opposing garment side edges, a portion of said two pairs of said opposing indentations in said opposing web side edges of said composite web of fabric, a pair of sleeve flaps, two garment end portions, and a pair of opposing piece side edges wherein said opposing piece side edges of said discrete garment-sized piece are proximate a pair of opposing garment bottom edges of said garment;

h. folding said discrete garment-sized piece of said composite web of fabric whereby one of said garment bottom edges of said pair of opposing garment bottom edges is brought into contact with other said garment bottom edge; and, i. fastening at least a portion of said pair of opposing garment side edges of said front panel to at least a portion of said pair of opposing garment side edges of said back panel to form a pair of garment side seams.

33. A continuous process for the manufacture of a garment comprising:

a. providing a first web of fabric including an inner surface, an outer surface, and opposing web side edges;

b. providing a second web of fabric including an inner surface, an outer surface, and opposing web side edges;

c. aligning said first and second webs of fabric together in a side by side orientation defining an arrangement wherein one of said web side edges of said first web of fabric is adjacent one of said web side edges of said second web of fabric;

d. fastening at least a portion said adjacent web side edge of said first web of fabric to at least a portion of said adjacent web side edge of said second web of fabric in said side by side orientation, defining at least a portion of a center seam and a composite web of fabric having a pair of opposing web side edges;

e. intermittently cutting said opposing web side edges of said composite web of fabric, defining pairs of opposing indentations in said opposing web side edges of said composite web of fabric;

f. intermittently cutting said composite web of fabric, forming edges defining neck openings in said composite web of fabric wherein said neck openings are intermediate two pairs of said opposing indentations;

g. cutting said composite web of fabric, defining discrete garment-sized pieces wherein each of said discrete garment-sized pieces of said composite web of fabric includes at least one said neck opening, a front panel having a pair of opposing garment side edges, a back panel having a pair of opposing garment side edges, a portion of said two pairs of said opposing indentations in said opposing web side edges of said composite web of fabric, a pair of sleeve flaps, two garment end portions, and a pair of opposing piece side edges wherein said opposing piece side edges of said discrete garment-sized piece are proximate a pair of opposing garment bottom edges of said garment;

h. hemming at least a portion of at least one of said opposing garment bottom edges;

i. folding said discrete garment-sized piece of said composite web of fabric whereby one of said garment bottom edges of said pair of opposing garment bottom edges is brought into contact with other said garment bottom edge; and, j. fastening at least a portion of said pair of opposing garment side edges of said front panel to at least a portion of said pair of opposing garment side edges of said back panel to form a pair of garment side seams.

34. A continuous process for the manufacture of a garment comprising:

a. providing a first web of fabric including a first web side edge and a second web side edge;

b. providing a second web of fabric including a first web side edge and a second web side edge;

c. intermittently cutting said second web side edge of said first web of fabric, forming indentations;

d. intermittently cutting said second web side edge of said second web of fabric, forming indentations;

e. aligning said first and second webs of fabric together in a side by side orientation defining an arrangement wherein said second web side edge of said first web of fabric is adjacent said second web side edge of said second web of fabric and said indentations of said second web side edge of said first web of fabric are adjacent said indentations of said second web side edge of said second web of fabric thereby forming edges defining neck openings;

f. fastening at least a portion of said second web side edge of said first web of fabric to at least a portion of said second web side edge of said second web of fabric in said side by side orientation, defining at least a portion of a center seam and a composite web of fabric having a pair of opposing web side edges;

g. intermittently cutting said opposing web side edges of said composite web of fabric, defining pairs of opposing indentations in said opposing web side edges of said composite web of fabric;

h. cutting said composite web of fabric, defining discrete garment-sized pieces wherein each of discrete garment-sized piece of said composite web of fabric includes at least one said neck opening, a front panel having a pair of opposing garment side edges, a back panel having a pair of opposing garment side edges, a portion of two pairs of said opposing indentations in said opposing web side edges of said composite web of fabric, two garment end portions, and a pair of opposing piece side edges wherein said opposing piece side edges of said discrete garment-sized piece are proximate a pair of opposing garment bottom edges of said garment;

i. folding said discrete garment-sized piece of said composite web of fabric whereby one of said garment bottom edges of said pair of opposing garment bottom edges is brought into contact with other said garment bottom edge; and, j. fastening at least a portion of said pair of opposing garment side edges of said front panel to at least a portion of said pair of opposing garment side edges of said back panel to form a pair of garment side seams.

35. A continuous process for the manufacture of a garment comprising:

a. providing a first web of fabric including opposing web side edges;

b. providing a second web of fabric including opposing web side edges;

c. aligning said first and second webs of fabric together in a face to face orientation, defining an arrangement wherein said web side edges of said first web of fabric are adjacent said web side edges of said second web of fabric, thereby defining a first pair of adjacent web side edges comprising one said web side edge of said first web of fabric and one said web side edge of said second web of fabric and a second pair of adjacent web side edges comprising other said web side edge of said first web of fabric and other said web side edge of said second web of fabric;

d. fastening at least a portion said first pair of adjacent web side edges together in said face to face orientation, defining at least a portion of a center seam and a composite web of fabric having a pair of opposing web side edges formed from said second pair of adjacent web side edges;

e. intermittently cutting said composite web of fabric, forming edges defining neck openings in said composite web of fabric;

f. intermittently cutting said opposing web side edges of said composite web of fabric, defining pairs of opposing indentations in said opposing web side edges of said composite web of fabric;

g. cutting said composite web of fabric, defining discrete garment-sized pieces wherein each of said discrete garment-sized pieces of said composite web of fabric includes at least one said neck opening, a front panel having a pair of opposing garment side edges, a back panel having a pair of opposing garment side edges, a portion of said two pairs of said opposing indentations in said opposing web side edges of said composite web of fabric, a pair of sleeve flaps, two garment end portions, and a pair of opposing piece side edges wherein said opposing piece side edges of said discrete garment-sized piece are proximate a pair of opposing garment bottom edges of said garment;

h. folding said discrete garment-sized piece of said composite web of fabric whereby one of said garment bottom edges of said pair of opposing garment bottom edges is brought into contact with other said garment bottom edge; and, i. fastening at least a portion of said pair of opposing garment side edges of said front panel to at least a portion of said pair of opposing garment side edges of said back panel to form a pair of garment side seams.

36. A continuous process for the manufacture of a garment comprising:

a. providing a first web of fabric including opposing web side edges;

b. providing a second web of fabric including opposing web side edges;

c. aligning said first and second webs of fabric together in a face to face orientation, defining an arrangement wherein said web side edges of said first web of fabric are adjacent said web side edges of said second web of fabric, thereby defining a first pair of adjacent web side edges comprising one said web side edge of said first web of fabric and one said web side edge of said second web of fabric and a second pair of adjacent web side edges comprising other said web side edge of said first web of fabric and other said web side edge of said second web of fabric;

d. fastening at least a portion said first pair of adjacent web side edges together in said face to face orientation, defining at least a portion of a center seam and a composite web of fabric having a pair of opposing web side edges formed from said second pair of adjacent web side edges;

e. intermittently cutting said opposing web side edges of said composite web of fabric, defining pairs of opposing indentations in said opposing web side edges of said composite web of fabric;

f. intermittently cutting said composite web of fabric, forming edges defining neck openings in said composite web of fabric wherein said neck openings are intermediate two pairs of said opposing indentations;

g. cutting said composite web of fabric, defining discrete garment-sized pieces wherein each of said discrete garment-sized pieces of said composite web of fabric includes at least one said neck opening, a front panel having a pair of opposing garment side edges, a back panel having a pair of opposing garment side edges, a portion of said two pairs of said opposing indentations in said opposing web side edges of said composite web of fabric, a pair of sleeve flaps, two garment end portions, and a pair of opposing piece side edges wherein said opposing piece side edges of said discrete garment-sized piece are proximate a pair of opposing garment bottom edges of said garment;

h. folding said discrete garment-sized piece of said composite web of fabric whereby one of said garment bottom edges of said pair of opposing garment bottom edges is brought into contact with other said garment bottom edge; and, i. fastening at least a portion of said pair of opposing garment side edges of said front panel to at least a portion of said pair of opposing garment side edges of said back panel to form a pair of garment side seams.

37. A continuous process for the manufacture of a garment comprising:

a. providing a first web of fabric including an inner surface, an outer surface, and opposing web side edges;

b. providing a second web of fabric including an inner surface, an outer surface, and opposing web side edges;

c. aligning said first and second webs of fabric together in a face to face orientation defining an arrangement wherein said web side edges of said first web of fabric are adjacent said web side edges of said second web of fabric, thereby defining a first pair of adjacent web side edges and a second pair of adjacent web side edges;

d. fastening at least a portion of said first pair of adjacent web side edges together in said face to face orientation, defining at least a portion of a center seam and a composite web of fabric having a pair of opposing web side edges formed from said second pair of adjacent web side edges;

e. intermittently cutting said opposing web side edges of said composite web of fabric, defining pairs of opposing indentations in said opposing web side edges of said composite web of fabric;

f. intermittently cutting said composite web of fabric, forming edges defining neck openings in said composite web of fabric wherein said neck openings are intermediate two pairs of said opposing indentations;

g. cutting said composite web of fabric, defining discrete garment-sized pieces wherein each of said discrete garment-sized pieces of said composite web of fabric includes at least one said neck opening, a front panel having a pair of opposing garment side edges, a back panel having a pair of opposing garment side edges, a portion of each said two pairs of said opposing indentations in said opposing web side edges of said composite web of fabric, a pair of sleeve flaps, two garment end portions, and a pair of opposing piece side edges wherein said opposing piece side edges of said discrete garment-sized piece are proximate a pair of opposing garment bottom edges of said garment;

h. hemming at least a portion of at least one of said opposing garment bottom edges;

i. folding said discrete garment-sized piece of said composite web of fabric whereby one of said garment bottom edges of said pair of opposing garment bottom edges is brought into contact with other said garment bottom edge; and, j. fastening at least a portion of said pair of opposing garment side edges of said front panel to at least a portion of said pair of opposing garment side edges of said back panel to form a pair of garment side seams.

38. A continuous process for the manufacture of a garment comprising:

a. providing a first web of fabric including a first web side edge and a second web side edge;

b. providing a second web of fabric including a first web side edge and a second web side edge;

c. intermittently cutting said second web side edge of said first web of fabric, forming indentations;

d. intermittently cutting said second web side edge of said second web of fabric, forming indentations;

e. aligning said first and second webs of fabric together in a face to face orientation, defining an arrangement wherein said first web side edge of said first web of fabric is adjacent said first web side edge of said second web of fabric and said second web side edge of said first web of fabric is adjacent said second web side edge of said second web of fabric wherein said indentations of said second web side edge of said first web of fabric are adjacent said indentations of said second web side edge of said second web of fabric thereby forming edges defining neck openings;

f. fastening at least a portion of said second web side edge of said first web of fabric to at least a portion of said second web side edge of said second web of fabric in said face to face orientation, defining at least a portion of a center seam and a composite web of fabric having a pair of opposing web side edges formed from said first web side edges of said first web of fabric and said first web side edges;

g. intermittently cutting said composite web of fabric, forming edges defining neck openings in said composite web of fabric;

h. intermittently cutting said opposing web side edges of said composite web of fabric, defining pairs of opposing indentations in said opposing web side edges of said composite web of fabric;

i. cutting said composite web of fabric, defining discrete garment-sized pieces wherein each of said discrete garment-sized pieces of said composite web of fabric includes at least one said neck opening, a front panel having a pair of opposing garment side edges, a back panel having a pair of opposing garment side edges, a portion of said two pairs of said opposing indentations in said opposing web side edges of said composite web of fabric, a pair of sleeve flaps, two garment end portions, and a pair of opposing piece side edges wherein said opposing piece side edges of said discrete garment-sized piece are proximate a pair of opposing garment bottom edges of said garment;

j. folding said discrete garment-sized piece of said composite web of fabric whereby one of said garment bottom edges of said pair of opposing garment bottom edges is brought into contact with other said garment bottom edge; and, k. fastening at least a portion of said pair of opposing garment side edges of said front panel to at least a portion of said pair of opposing garment side edges of said back panel to form a pair of garment side seams.

* * * * *